US008011765B2

(12) United States Patent
Katoh

(10) Patent No.: US 8,011,765 B2
(45) Date of Patent: Sep. 6, 2011

(54) LIQUID FEEDING MEMBER FOR LIQUID EJECTION HEAD, LIQUID EJECTION DEVICE, AND IMAGE FORMING APPARATUS

(75) Inventor: Tomomi Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 460 days.

(21) Appl. No.: 12/296,218

(22) PCT Filed: Feb. 4, 2008

(86) PCT No.: PCT/JP2008/052205

§ 371 (c)(1),
(2), (4) Date: Oct. 6, 2008

(87) PCT Pub. No.: WO2008/099790

PCT Pub. Date: Aug. 21, 2008

(65) Prior Publication Data

US 2009/0284572 A1 Nov. 19, 2009

(30) Foreign Application Priority Data

Feb. 14, 2007 (JP) ..... 2007-033986
Feb. 15, 2007 (JP) ..... 2007-034252

(51) Int. Cl.
*B41J 2/175* (2006.01)

(52) U.S. Cl. ..... 347/85

(58) Field of Classification Search ..... 347/85, 347/84, 86, 87, 89
See application file for complete search history.

(56) References Cited

U.S. PATENT DOCUMENTS

| | | | |
|---|---|---|---|
| 5,439,728 | A | 8/1995 | Morozumi et al. |
| 5,975,681 | A | 11/1999 | Ogasawara et al. |
| 6,682,185 | B2 | 1/2004 | Hashimoto et al. |
| 6,913,348 | B2 | 7/2005 | Hashimoto et al. |
| 7,325,908 | B2 | 2/2008 | Katoh et al. |
| 7,364,253 | B2 | 4/2008 | Hashimoto et al. |
| 2002/0145647 | A1 | 10/2002 | Kataoka et al. |
| 2007/0008356 | A1 | 1/2007 | Katoh |

FOREIGN PATENT DOCUMENTS

| | | | |
|---|---|---|---|
| EP | 0528440 | A1 | 8/1992 |
| EP | 0791458 | A2 | 2/1997 |
| JP | 5-330073 | | 12/1993 |
| JP | 8-238772 | | 9/1996 |
| JP | 2607274 | | 2/1997 |
| JP | 9-226142 | | 9/1997 |

(Continued)

OTHER PUBLICATIONS

Apr. 19, 2011 European search report in connection with counterpart European patent application No. 08 70 4527.

*Primary Examiner* — K. Feggins
(74) *Attorney, Agent, or Firm* — Cooper & Dunham LLP

(57) ABSTRACT

A liquid ejection device ejects liquid droplets from a liquid ejection head. The liquid ejection device includes a liquid feeding member that feeds liquid to the liquid ejection head. The liquid feeding member is connected to a liquid ejection head to feed liquid to a common liquid chamber of the liquid ejection head, which liquid ejection head includes the common liquid chamber that supplies the liquid to plural individual liquid chambers communicating with plural nozzles that eject liquid droplets. The liquid feeding member includes a liquid circulation path through which the liquid circulates in a direction parallel to a direction in which the nozzles of the liquid ejection head are aligned.

16 Claims, 45 Drawing Sheets

FOREIGN PATENT DOCUMENTS

| | | |
|---|---|---|
| JP | 2821920 | 9/1998 |
| JP | 2002-144576 | 5/2002 |
| JP | 2002-292868 | 10/2002 |
| JP | 2004-160907 | 6/2004 |
| JP | 2005-178246 | 7/2005 |
| JP | 2005-193624 | 7/2005 |
| JP | 2005-212350 | 8/2005 |
| JP | 2006-168023 | 6/2006 |
| JP | 2006-192583 | 7/2006 |
| JP | 2006-213028 | 8/2006 |

LIQUID FEEDING MEMBER FOR LIQUID EJECTION HEAD, LIQUID EJECTION DEVICE, AND IMAGE FORMING APPARATUS

TECHNICAL FIELD

The present invention relates to a liquid feeding member for a liquid ejection head, a liquid ejection device, and an image forming apparatus.

BACKGROUND ART

Image forming apparatuses (e.g. printers, fax machines, copiers, and multifunction machines having functions of these machines) are known that perform image formation by ejecting liquid such as ink onto a medium with use of, e.g., a liquid ejection device while transporting the sheet. The liquid ejection device comprises a recording head including a liquid ejection head (liquid droplet ejection head) for ejecting droplets of the liquid (recording liquid). It is to be noted that the term "medium" as used herein is hereinafter also referred to as "sheet", the material of which is not limited to paper. The terms "medium to be recorded on", "recording medium", "transfer material", and "recording sheet", may be used as synonymous. The terms "recording", "printing", and "imaging" may be used as synonymous with the term "image formation".

The term "image forming apparatus" as used herein indicates an apparatus that forms images by ejecting liquid onto media such as paper, strings, fibers, cloth, leather, metal, plastic, glass, wood, and ceramics. The term "image formation" as used herein indicates not only forming images that have meanings, such as characters and figures, on a medium, but also forming images that do not have meanings, such as patterns, on a medium. The term "liquid" as used herein is not limited to recording liquid and ink, but includes any liquid that can be used for image formation. The term "liquid ejection device" as used herein indicates a device that ejects liquid from a liquid ejection head and is not limited to those for forming images.

There are several types of liquid ejection heads, such as a piezo type and a thermal type. The piezo type head is provided with a diaphragm on the wall of a liquid chamber in which ink is stored. The diaphragm is displaced using a piezo actuator or the like. Then, the volume inside the liquid chamber is changed to increase the pressure, thereby ejecting liquid droplets. The thermal type head is provided with a heating element which generates heat in response to application of a current to a liquid chamber. Bubbles generated due to heat of the heating element increase the pressure inside a liquid chamber, thereby ejecting liquid droplets.

In order to improve the operating speed, image forming apparatuses using such liquid ejection systems are provided with an increased number of nozzles and heads. Recently, line type image forming apparatuses have come into use that can form images using a long head including plural short heads connected together, which allows forming images without scanning with the head.

However, if the length of the head is increased to have more nozzles, the risk of ejection failure increases. One cause of the ejection failure is entry of bubbles into the liquid chamber. The bubbles in the liquid chamber may prevent ink from being fed, resulting in ejection of no ink, or may reduce pressure for ejecting droplets, resulting in poor ejection. Bubbles, even if they are small, near the nozzle, for example, cause ejection of liquid droplets in wrong directions, thereby failing to form an intended image.

The bubbles enter the head in various ways. The bubbles may flow through an ink feed path, or may be introduced from the nozzle. In the case of a head that ejects liquid droplets by boiling an ink film using a heating element, fine bubbles generated during the ejection process can remain in the liquid chamber.

In the case where bubbles enter the liquid chamber, the bubbles are discharged together with ink by carrying out an ejection operation which is not for forming images (often called "idle ejection" or "preliminary ejection"), or by capping a nozzle face for creation of negative pressure to perform a suction operation. Alternatively, the bubbles may be discharged by increasing the pressure of the ink feed path using a pump or the like. When discharging bubbles using these methods, although there are methods to recycle the discharged ink, a large volume of ink is generally used and wasted without being used for image formation. It is to be noted that a recycling method is disclosed in Japanese Patent Laid-Open Publication No. 2005-212350 (Patent Document 1).

Although bubbles in the liquid chamber can be removed by only the above-described methods, bubbles in the ink feed path can be removed by circulating ink inside the ink feed path. This method makes it possible to prevent entry of bubbles from the ink feed path to the liquid chamber without discharging the ink even in the case where a long head is used. However, if the bubbles in the ink feed path are discharged by circulating the ink, a meniscus in the nozzle of the head is broken due to pressure of ink circulation, so that the ink oozes off or the bubbles are introduced from the nozzle.

Japanese Patent Registration No. 2821920 (Patent Document 2) discloses an ink jet recorder configured such that the nozzle face is sealed during ink circulation. This ink jet recorder comprises an ink feed path for guiding ink from an ink tank to a common liquid chamber of a recording head, an ink discharge path for guiding the ink from the common liquid chamber to the ink tank, a discharge port sealing member for sealing the discharge port communicating with the common liquid chamber, and an ink pump for pumping ink from the ink tank to the common liquid chamber. With the discharge port sealed by the discharge port sealing member, the ink is made to circulate by the ink pump from the ink tank through the ink feed path, the common liquid chamber, and the ink discharge path, and back to the ink tank. Thus the air in the ink passage is discharged into the ink tank together with the ink.

Japanese Patent Laid-Open Application No. 08-238772 (Patent Document 3) discloses a head that prevents the pressure of ink circulation from affecting the meniscus. An ink feed path is divided by a partition wall having plural communication passages into a portion near and a portion away from individual liquid chambers of the head. The portion away from the individual liquid chamber is provided with an ink inlet pipe and an ink outlet pipe. More specifically, a circulation path with an ink feed unit therein is provided between a thermal head and an ink tank. A common liquid chamber communicates with plural liquid paths that communicate with plural ink discharge ports for ejecting ink. The common liquid chamber includes a first common liquid chamber and a second common liquid chamber. The first common liquid chamber directly communicates with the liquid paths, while the second common liquid chamber is located at the side of the first common liquid chamber opposite to the side of the liquid chambers and communicates with the first common liquid chamber through the plural communication passages.

The second common liquid chamber forms a part of the circulation path, and is provided with an inlet port for the ink flowing from the ink tank and an outlet port to the ink tank.

As mentioned above, if the bubbles in the ink feed path are discharged by circulation of ink, a meniscus in the nozzle of the head is broken due to pressure of the ink circulation, so that the ink oozes off or the bubbles are introduced from the nozzle. To solve such a problem, techniques disclosed in Patent Document 2 and 3 may be used.

However, in the case of the ink jet recorder of Patent Document 2 in which the nozzle face is sealed while circulating liquid, it is difficult to completely seal the nozzle face if a head is long. Further, images cannot be formed by ejecting liquid while circulating the liquid.

In the case of the head of Patent Document 3, the pressure of ink circulation is prevented from affecting the meniscus by dividing the ink feed path with the partition wall having plural communication passages into the portion that is near the individual liquid chambers of the head and the portion that is spaced away from individual liquid chambers and provided with the liquid inlet pipe and liquid outlet pipe so as to prevent bubbles in the ink feed path from entering the individual liquid chamber. However, if bubbles generated in the individual liquid chambers and bubbles introduced from the nozzle are carried upstream due to buoyant forces, the bubbles remain in the portion near the individual liquid chambers because of the presence of the partition wall and cannot be discharged by the circulating current.

DISCLOSURE OF THE INVENTION

In view of the foregoing, the present invention is directed to provide a liquid feeding member for a liquid ejection head which liquid feeding member discharges bubbles in a liquid feed path, including bubbles introduced from the head, using a circulating current without throwing away the liquid to the outside and prevents adverse effects such as meniscuses being broken due to pressure of the circulation. The present invention is also directed to provide a liquid ejection device, and an image forming apparatus including this liquid feeding member.

In an embodiment of the present invention, there is provided a liquid ejection device that ejects liquid droplets from a liquid ejection head. The liquid ejection device comprises a liquid feeding member that feeds liquid to the liquid ejection head, the liquid feeding member being connected to a liquid ejection head to feed liquid to a common liquid chamber of the liquid ejection head, which liquid ejection head includes the common liquid chamber that supplies the liquid to plural individual liquid chambers communicating with plural nozzles that eject liquid droplets. The liquid feeding member comprises a liquid circulation path through which the liquid circulates in a direction parallel to a direction in which the nozzles of the liquid ejection head are aligned. A feed port through which the liquid is supplied to the liquid circulation path and a discharge port through which the liquid is discharged from the liquid circulation path are disposed at opposing longitudinal ends of the liquid circulation path. A communication opening communicating with the common liquid chamber is disposed at the side of the common liquid chamber in the liquid circulation path. The communication opening has a smaller width than a width of the liquid circulation path.

In one embodiment of the present invention, there is provided a liquid ejection device that ejects liquid droplets from a liquid ejection head. The liquid ejection device comprises a liquid feeding member that feeds liquid to the liquid ejection head, the liquid feeding member being connected to a liquid ejection head to feed liquid to a common liquid chamber of the liquid ejection head, which liquid ejection head includes the common liquid chamber that supplies the liquid to plural individual liquid chambers communicating with plural nozzles that eject liquid droplets. The liquid feeding member comprises a liquid circulation path through which the liquid circulates in a direction parallel to a direction in which the nozzles of the liquid ejection head are aligned. A feed port through which the liquid is supplied to the liquid circulation path and a discharge port through which the liquid is discharged from the liquid circulation path are disposed at opposing longitudinal ends of the liquid circulation path. A communication opening communicating with the common liquid chamber is disposed at the side of the common liquid chamber in the liquid circulation path. Plural ribs are disposed around the communication opening.

In an embodiment of the present invention, there is provided a liquid ejection device that ejects liquid droplets from plural liquid ejection heads. The liquid ejection device comprises the plural liquid ejection heads elongated in a longitudinal direction of a liquid ejection member and arranged longitudially offset from one another in a direction orthogonal to the longitudinal direction; and the liquid feeding member connected to the plural liquid ejection heads to feed liquid to common liquid chambers of the liquid ejection heads, each of which liquid ejection heads includes the common liquid chamber from which the liquid is supplied to plural individual liquid chambers communicating with plural nozzles that eject liquid droplets. The liquid feeding member comprises a liquid passage through which the liquid passes in a direction parallel to a direction in which the nozzles of each of the liquid ejection heads are aligned. A feed port through which the liquid is supplied to the liquid passage and a discharge port through which the liquid is discharged from the liquid passage are provided in the liquid passage. The liquid passage has a greater cross-sectional area at portions connected to the liquid ejection heads than at portions between the adjacent common liquid chambers.

In an embodiment of the present invention, there is provided a liquid feeding member to be connected to a liquid ejection head to feed liquid to a common liquid chamber of the liquid ejection head, which liquid ejection head includes the common liquid chamber that supplies the liquid to plural individual liquid chambers communicating with plural nozzles that eject liquid droplets. The liquid feeding member comprises a liquid circulation path through which the liquid circulates in a direction parallel to a direction in which the nozzles of the liquid ejection head are aligned, wherein a feed port through which the liquid is supplied to the liquid circulation path and a discharge port through which the liquid is discharged from the liquid circulation path are disposed at opposing longitudinal ends of the liquid circulation path; and wherein plural ribs are formed on an inner wall at the side of the common liquid chamber in the liquid feeding member.

In an embodiment of the present invention, there is provided a liquid feeding member to be connected to a liquid ejection head to feed liquid to a common liquid chamber of the liquid ejection head, which liquid ejection head includes the common liquid chamber that supplies the liquid to plural individual liquid chambers communicating with plural nozzles that eject liquid droplets. The liquid feeding member comprises a liquid circulation path through which the liquid circulates in a direction parallel to a direction in which the nozzles of the liquid ejection head are aligned, wherein a feed port through which the liquid is supplied to the liquid circulation path and a discharge port through which the liquid is discharged from the liquid circulation path are disposed at opposing longitudinal ends of the liquid circulation path; wherein the liquid circulation path is narrower at a substantial center portion and wider at end portions in a cross section orthogonal to the flow of the liquid from the feed port toward the discharge port; and wherein one of the ends communicates with an opening of the common liquid chamber, and the feed port and the discharge port are disposed at the other one of the end portions.

In an embodiment of the present invention, there is provided a liquid feeding member to be connected to a liquid ejection head to feed liquid to a common liquid chamber of the liquid ejection head, which liquid ejection head includes the common liquid chamber that supplies the liquid to plural individual liquid chambers communicating with plural nozzles that eject liquid droplets. The liquid feeding member comprises a liquid circulation path through which the liquid circulates in a direction parallel to a direction in which the nozzles of the liquid ejection head are aligned, wherein a feed port through which the liquid is supplied to the liquid circulation path and a discharge port through which the liquid is discharged from the liquid circulation path are provided; wherein one of the feed port and the discharge port is disposed at a portion not at a longitudinal end of the liquid circulation path; and wherein a flow guide member that guides the flow of the liquid is provided between the common liquid chamber and said one of the feed port and the discharge port at the portion not at the longitudinal end.

Other objects, features and advantages of the present invention will become more apparent from the following detailed description when read in conjunction with the accompanying drawings.

BEST MODE FOR CARRYING OUT THE INVENTION

Figure 1:
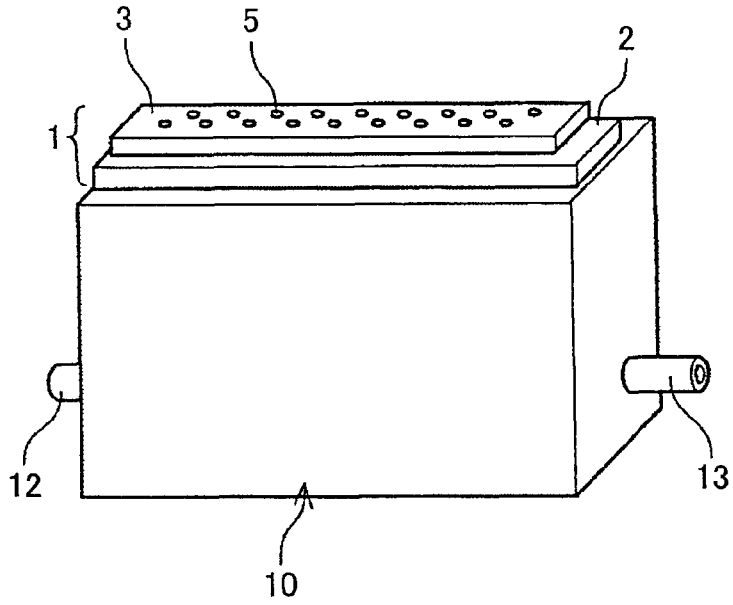
FIG. 1 is a perspective view showing an integrated head unit including a liquid ejection head and a liquid feeding member of a first embodiment of the present invention.
Figure 2:
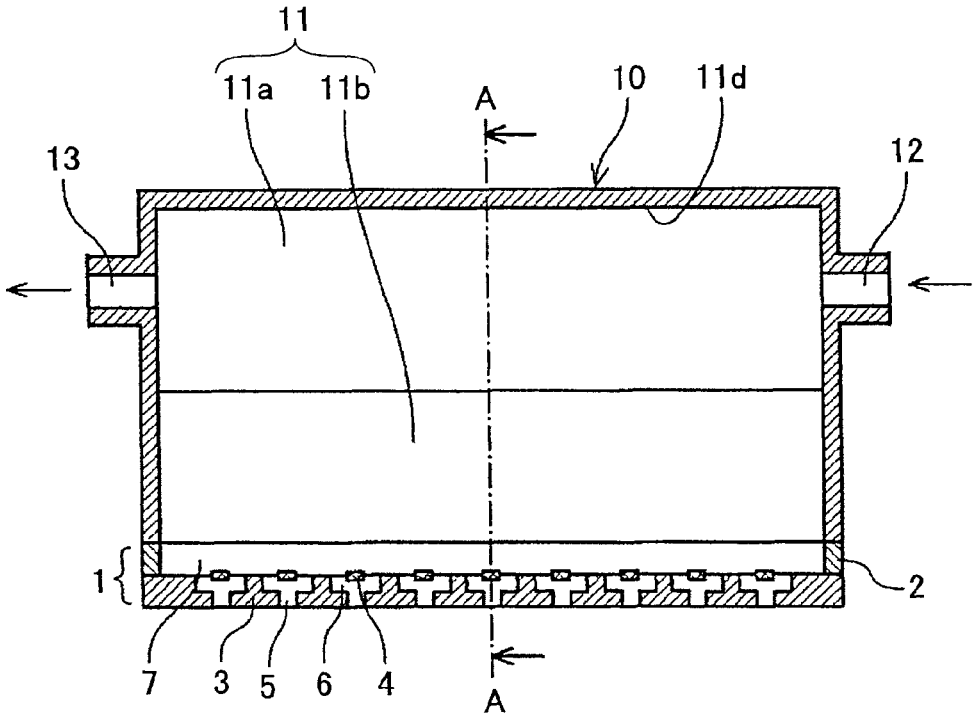
FIG. 2 is a longitudinal cut-away view showing the head unit.
Figure 3:
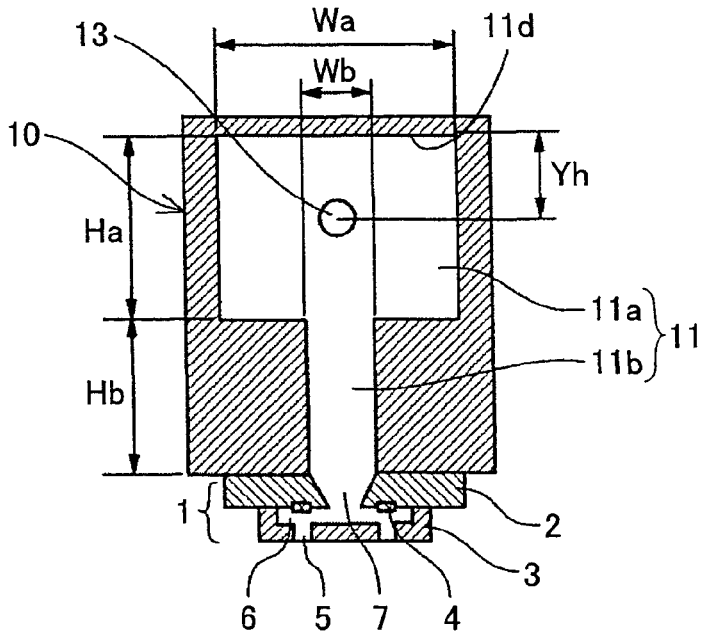
FIG. 3 is a cross-sectional view of the head unit taken along line A-A of FIG. 2.

Preferred embodiments of the present invention are described hereinafter with reference to the accompanying drawings. A liquid feeding member 10 of an embodiment of the present invention for a liquid ejection head 1 is described below with reference to FIGS. 1 through 3. FIG. 1 is a perspective view showing an integrated head unit including a liquid ejection head 1 and a liquid feeding member 10 of this embodiment of the present invention. FIG. 2 is a longitudinal cut-away view showing the head unit. FIG. 3 is a cross-sectional view of the head unit taken along line A-A of FIG. 2.

The liquid ejection head 1 is a thermal type and includes a heating element substrate 2 and a flow passage substrate 3. The flow passage substrate 3 is provided with plural nozzles 5 for ejecting liquid droplets and individual liquid chambers 6 communicating with the corresponding nozzles 5. The heating element substrate 2 is provided with heating elements 4 corresponding to the individual liquid chambers 6. A power supply unit (not shown) such as an FPC is connected to the heating element substrate 2. When a pulse voltage is applied to the heating elements 4 from the power supply unit, the heating elements 4 are driven to cause film boiling of the liquid in the individual liquid chambers 6, thereby ejecting droplets of the liquid from the nozzles 5. In this embodiment, as shown in FIG. 1, two nozzle arrays are formed, each including plural nozzles 5 aligned in the longitudinal direction of the liquid ejection head 1. Referring to FIG. 3, the individual liquid chambers 6 corresponding to the nozzles 5 receive liquid from a common liquid chamber 7 disposed in the center of the heating element substrate 2.

As shown in FIGS. 2 and 3, a liquid circulation path 11 of the liquid feeding member 10 of this embodiment is connected to the opening of the common liquid chamber 7 in the heating element substrate 2 of the liquid ejection head 1.

The liquid feeding member 10 includes the liquid circulation path 11 through which liquid circulates. In the liquid circulation path 11, the region connected to the liquid ejection head 1 is defined by a narrow communication passage 11*b* having a relatively small cross-sectional opening area (a small cross-sectional area), which narrow communication passage 11*b* defines a communication opening for liquid communication from the liquid feeding member 10 to the common liquid chamber 7 of the liquid ejection head 1, and a region spaced apart from the head 1 is defined by a main passage 11*a* having a greater cross-sectional opening area. A feed port 12 through which the liquid is supplied and a discharge port 13 through which the liquid is discharged are formed at the opposing longitudinal ends of the liquid feeding member 10 (in a direction parallel to the direction in which nozzles 5 of the liquid ejection head 1 are aligned). Both the feed port 12 and the discharge port 13 communicate with the main passage 11*a*. The term "cross-sectional opening area" as used herein indicates the opening area of a cross section, such as that shown in the cut-away side view of FIG. 3, in the direction (transverse direction of the liquid feeding member 10) orthogonal to the longitudinal direction of the liquid feeding member 10 (the direction in which the nozzles 5 of the liquid ejection head 1 are aligned, the direction of generating the circulating current).

As will be described below, the liquid feeding member 10 is disposed in a liquid feed path (not shown) in which the liquid is made to circulate to flow through the liquid circulation path 11 from the feed port 12 toward the discharge port 13. In FIG. 2 and certain other figures, the arrow pointing to the feed port 12 and the arrow pointing outward from the discharge port 13 indicate the direction in which the liquid is introduced and the direction in which the liquid is discharged, respectively.

The function of the liquid feeding member 10 is described below in comparison with a comparative example 1 shown in FIGS. 4 and 5 and a comparative example 2 shown in FIGS. 8 and 9.

The liquid ejection head 1 ejects the liquid supplied from the feed port 12. In some cases, bubbles 50 enter from a liquid feed path (not shown) connected to the feed port 12 and stay and accumulate at the top of the liquid circulation path 11 (on a ceiling 11*d*) as shown in FIGS. 4 and 5. No problems occur as long as the amount of the bubbles 50 is small. However, if the amount of the bubbles 50 increases, the bubbles 50 enter the individual liquid chambers 6 together with the liquid and cause trouble such as ejection failures.

To prevent such a problem, the liquid feeding member 10 is configured such that the liquid flows from the feed port 12 to the discharge port 13 so as to circulate in the not-shown liquid feed path. Thus, the bubbles 50 are carried by the circulating current of the liquid and are discharged out of the liquid circulation path 11 through the discharge port 13. In the liquid circulation path 11 of the liquid feeding member 10, the main passage 11*a* having a relatively large cross-sectional area orthogonal to the direction of generating the circulating current is connected to the feed port 12 and the discharge port 13 for allowing circulation of the liquid, while the narrow communication passage 11*b* having a relatively small cross-sectional area orthogonal to the direction of generating the circulating current is provided between the main passage 11*a* and the liquid ejection head 1. This configuration prevents the circulating current from causing trouble in the liquid ejection head 1.

Figure 6:
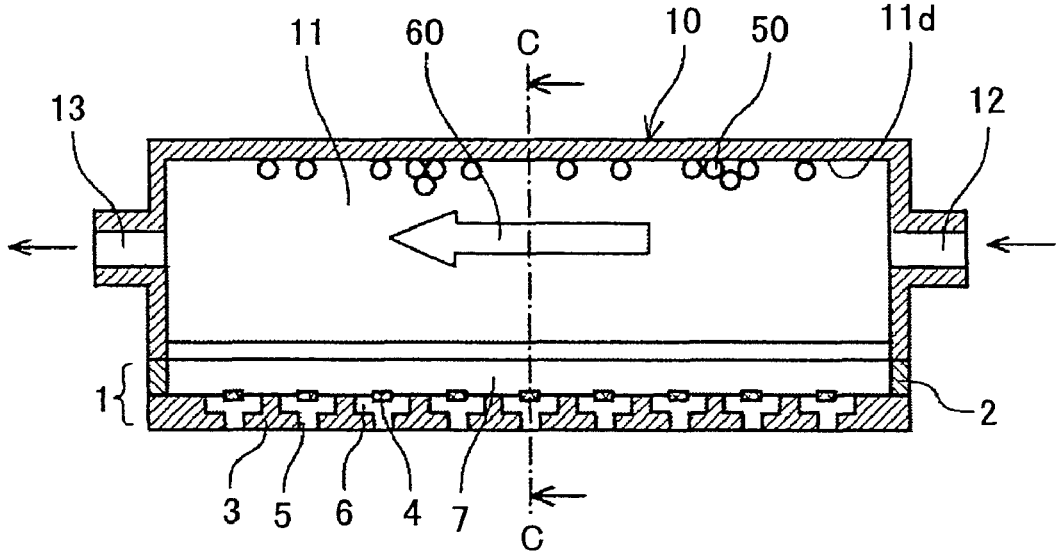
FIG. 6 is a longitudinal cut-away view showing a head unit of a comparative example 1.
Figure 7:
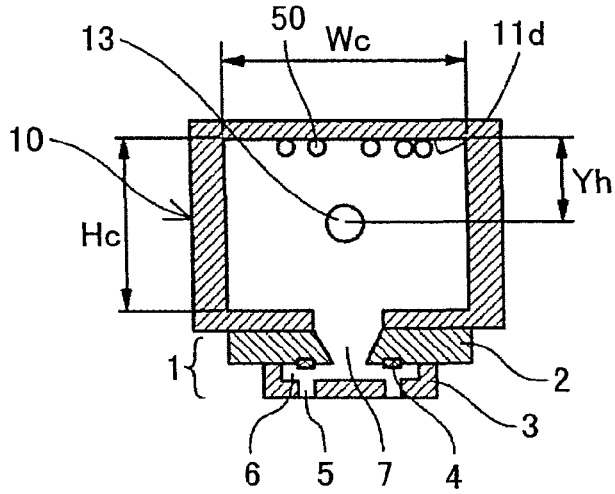
FIG. 7 is a cross-sectional view taken along line C-C of FIG. 6.

For example, in the case of the comparative example 1 shown in FIGS. 6 and 7, a liquid circulation path 11 of a liquid feeding member 10 with a uniform cross-sectional area is provided near a liquid ejection head 1. When a circulating current is generated between a feed port 12 and a discharge port 13, bubbles 50 are carried by a high-speed flow indicated by the arrow 60 and are efficiently discharged from the discharge port 13. However, because the high-speed circulating current is generated very close to a common liquid chamber 7 of the liquid ejection head 1, meniscuses in nozzles 5 of the liquid ejection head 1 are broken, and trouble occurs such as the liquid overflowing from the nozzles 5 or, to the contrary, bubbles being introduced from the nozzles 5.

Figure 8:
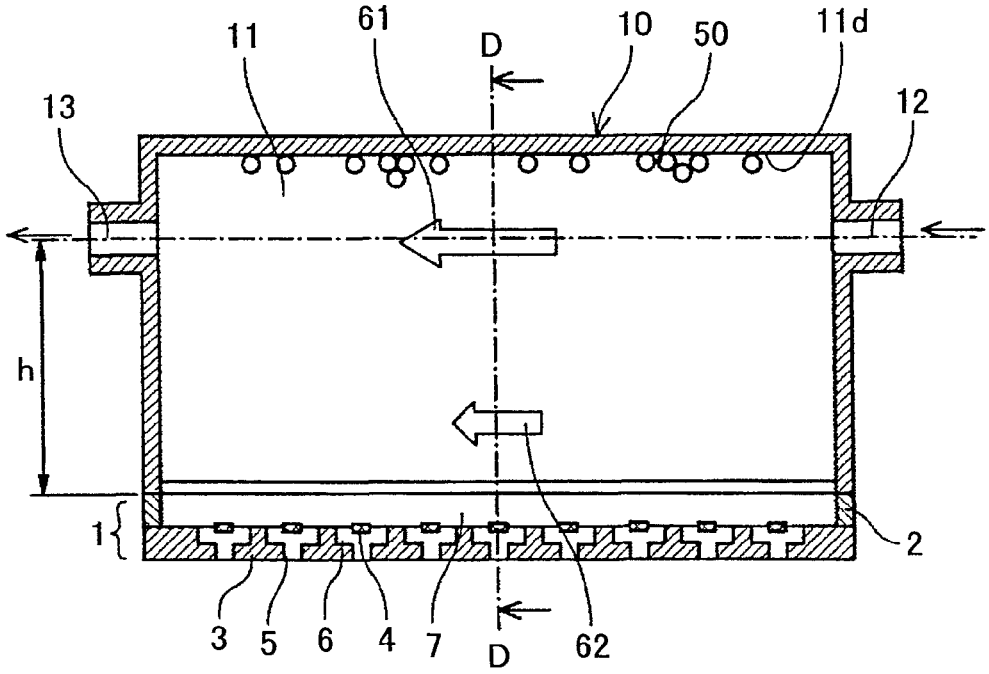
FIG. 8 is a longitudinal cut-away view showing a head unit of a comparative example 2.
Figure 9:
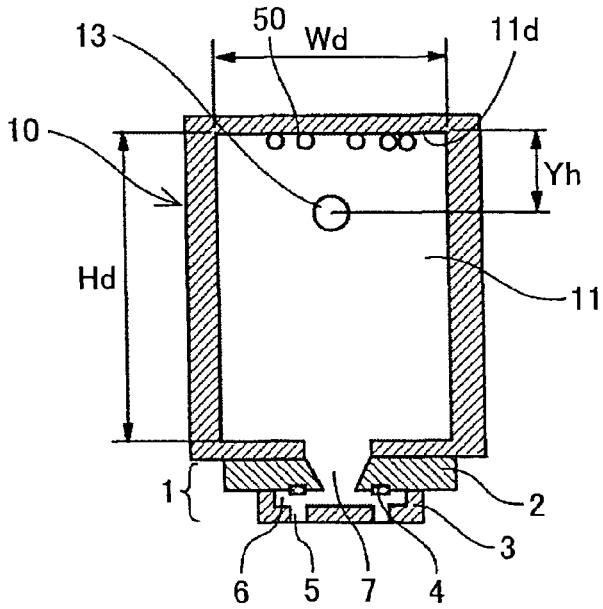
FIG. 9 is a cross-sectional view taken along line D-D of FIG. 8.

In the case of the comparative example 2 shown in FIGS. 8 and 9, a circulating current is generated in a region spaced apart from a liquid ejection head 1. That is, in this comparative example 2, a feed port 12 and a discharge port 13 are formed at the upper side in a liquid circulation path 11. Thus, a relatively high-speed flow indicated by the arrow 61 is generated at the upper side in the liquid circulation path 11, while a relatively low-speed flow indicated by the arrow 62 is generated at the lower side inside the liquid circulation path 11. If a height h from the liquid ejection head 1 to the line connecting the feed port 12 and the discharge port 13 is increased such that the circulating current is spaced apart from the liquid ejection head 1, unlike the comparative example 1, it is possible to prevent the meniscuses from being broken.

However, with the configuration of the comparative example 2, the speed of the circulating current is reduced due to the increased cross-sectional area of the liquid circulation path 11, resulting in lowering the performance of discharging bubbles. Increasing the flow rate of the circulating current rate for improvement of the bubble discharge performance adversely affects the meniscuses in the liquid ejection head 1, so that it becomes difficult to produce a preferable condition.

Figure 4:
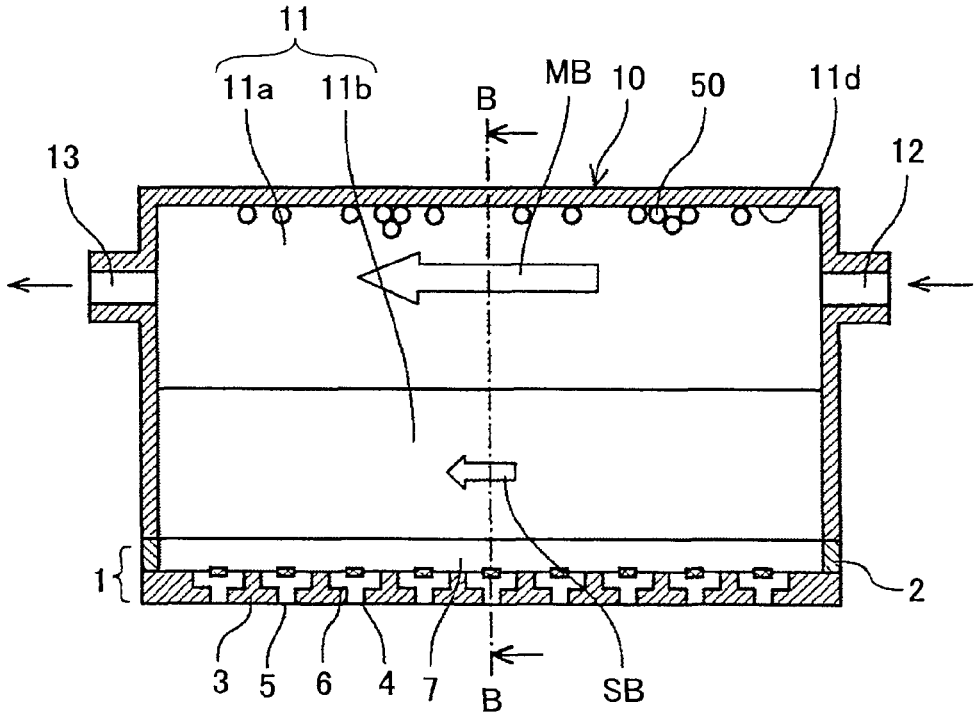
FIG. 4 is a longitudinal cut-away view of the head unit for illustrating the second embodiment.
Figure 5:
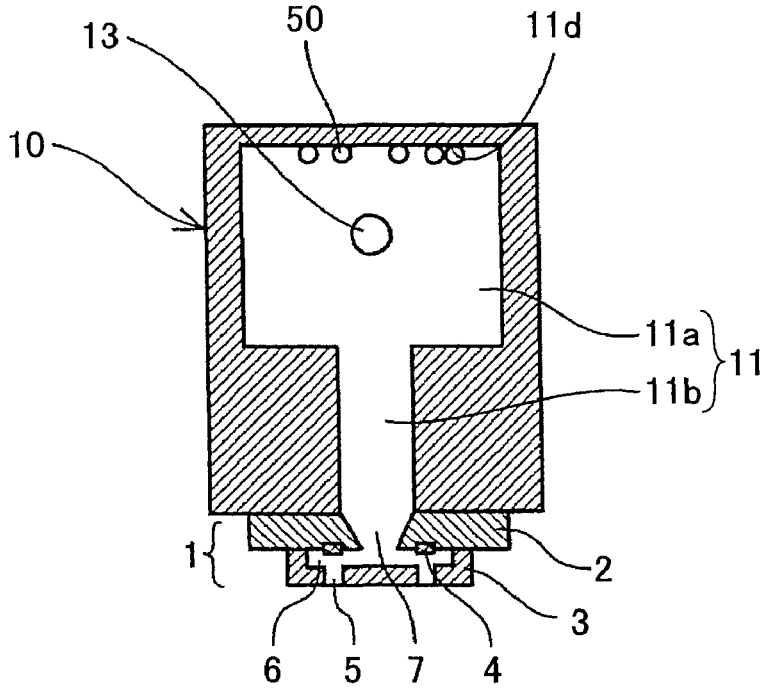
FIG. 5 is a cross-sectional view of the head unit taken along line B-B of FIG. 4.

In the case of the liquid feeding member 10 of this embodiment, as shown in FIGS. 4 and 5, the liquid circulation path 11 includes the narrow communication passage 11*b* having a small cross-sectional area at the side connected to the liquid ejection head 1 and the main passage 11*a* having a large cross-sectional area at the side spaced apart from the liquid ejection head 1. Because the liquid in the narrow communication passage 11*b* flows at low speed due to its wall surfaces being close to each other (the flow rate and speed is indicated by the arrow SB), the circulating current is generated substantially in the main passage 11*a* (the flow rate and the speed is indicated by the arrow MB). Therefore, it is possible to generate a high-speed circulating current and efficiently discharge bubbles 50 from the liquid circulation path 11 without breaking the meniscuses in the nozzles 5.

Further, in the liquid feeding member 10 of this embodiment, as shown in FIGS. 2 and 3, the narrow communication passage 11*b* defining the communication opening of the liquid feeding member 10 is open to the entire opening of the common liquid chamber 7 of the liquid ejection head 1. No component, such as a partition wall, that blocks the flow of the liquid is disposed between the common liquid chamber 7 and the ceiling 11*d* of the liquid circulation path 11. Therefore, bubbles that have been generated inside the individual liquid chambers 6 of the liquid ejection head 1 or introduced from the nozzles 5 and moved to the common liquid chamber 7 can rise up to the ceiling 11*d* of the liquid circulation path 11 due to buoyancy and can be discharged by the circulating current.

Figure 10A:
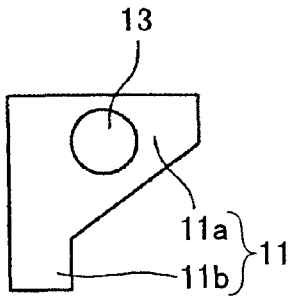
FIGS. 10A through 10C are schematic diagrams for illustrating different cross-sectional shapes of a liquid circulation path of the second embodiment.
Figure 10B:
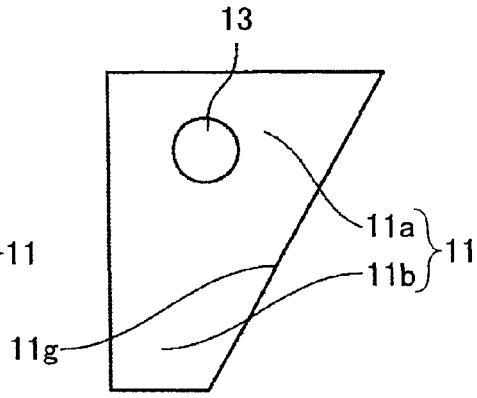
Figure 10C:
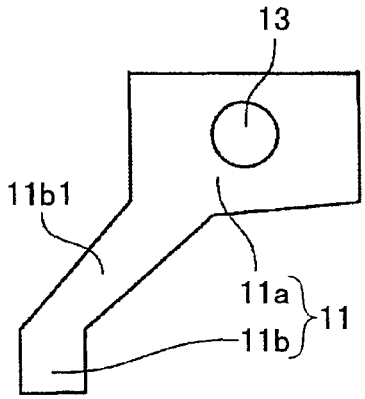

The shape of the cross section orthogonal to the flow of the liquid in the liquid circulation path 11 of the liquid feeding member 10 is not limited to the plane parallel shape shown in FIG. 3. For example, as shown in FIG. 10A, the cross section may have a non-parallel-plane shape in which the narrow communication passage 11*b* is shifted relative to the main passage 11*a* in the traverse direction. As shown in FIG. 10B, the cross section may have a shape in which the main passage 11*a* and the narrow communication passage 11*b* are connected to form a slope 11*g*. As shown in FIG. 10C, the cross section may have a shape such that, even if the joint with the liquid ejection head 1 does not directly face the ceiling of the main passage 11*a*, bubbles can rise along a slope 11*b*1 of the narrow communication passage 11*b*. Although not shown, the sides and corners may be curved. Although the feed port 12 and the discharge port 13 have the same inner diameters in this embodiment, they may have different inner diameters.

As described above, the liquid feeding member 10 includes the liquid circulation path 11 through which the liquid circulates in a direction parallel to the direction in which the nozzles 5 of the liquid ejection head 1 are aligned. The feed port 12 through which the liquid is supplied to the liquid circulation path 11 and the discharge port 13 through which the liquid is discharged from the liquid circulation path 11 are disposed at the opposing longitudinal ends of the liquid circulation path 11. The communication opening communicating with the common liquid chamber 7 is formed at the side of the common liquid chamber 7 in the liquid circulation path 11. The communication opening has a smaller width than the liquid circulation path 11. With this configuration, it is possible to discharge, by the circulating current, the bubbles generated in the liquid ejection head 1 or introduced into the liquid ejection head 1 from upstream of the liquid feed path while preventing the meniscuses in the liquid ejection head 1 from being broken.

Figure 11:
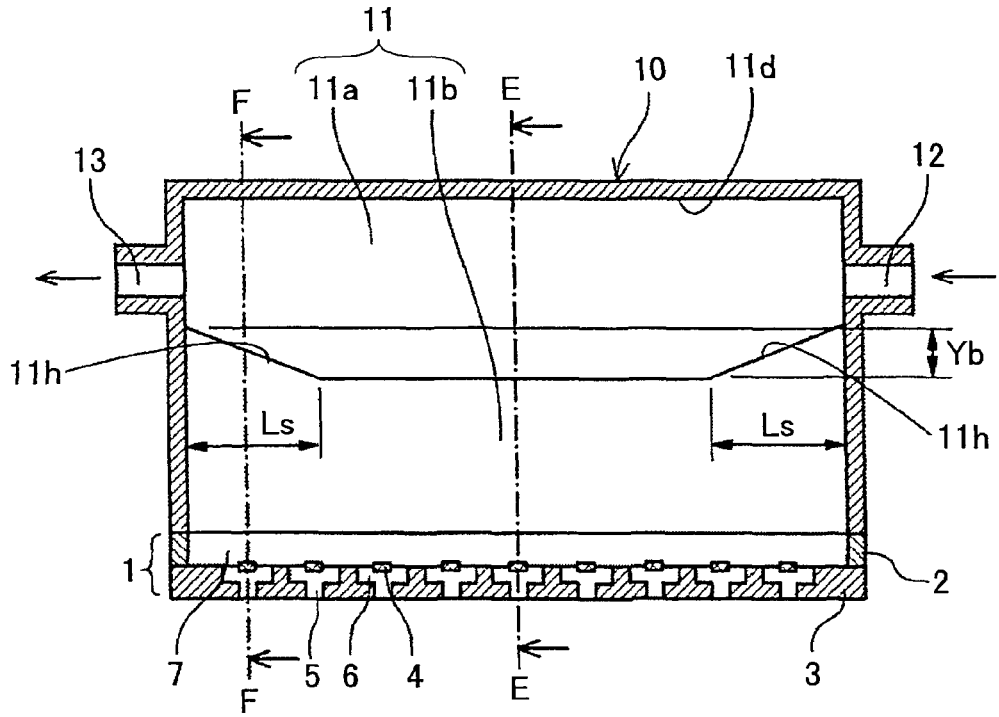
FIG. 11 is a longitudinal cut-away view of a head unit for illustrating a liquid feeding member of a second embodiment of the present invention.
Figure 12:
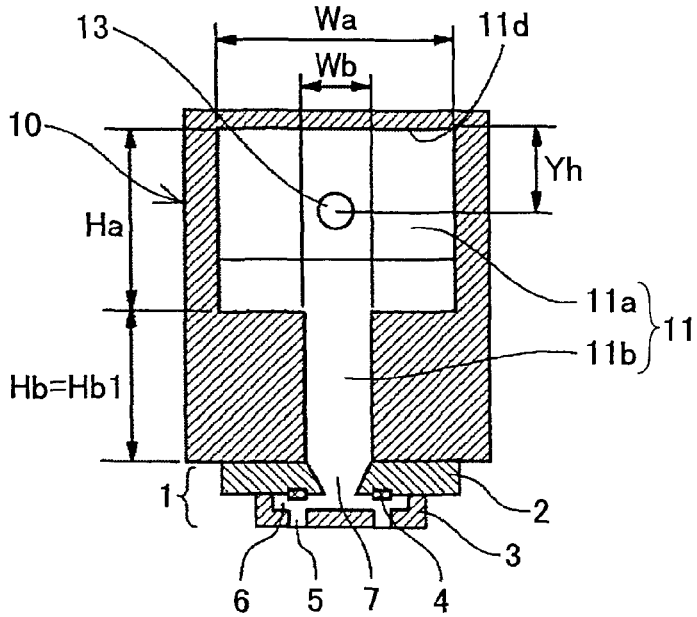
FIG. 12 is a cross-sectional view of the head unit taken along line E-E of FIG. 11.
Figure 13:
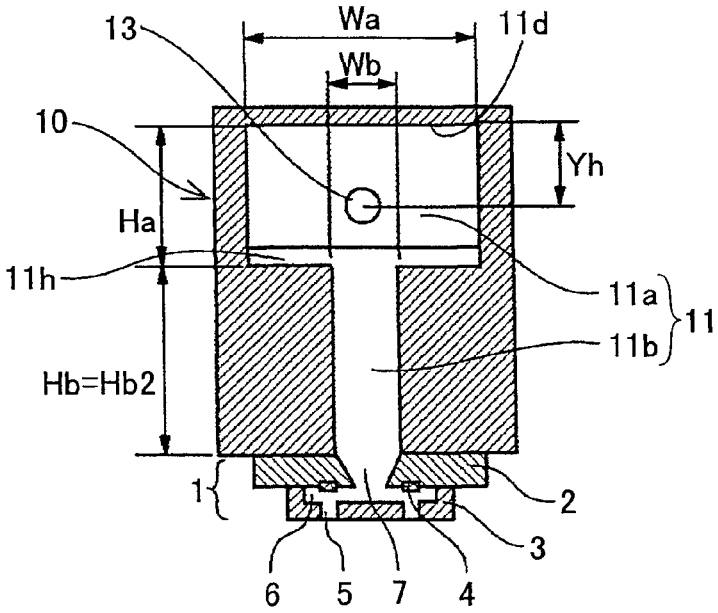
FIG. 13 is a cross-sectional view of the head unit taken along line F-F of FIG. 11.

A liquid feeding member 10 of a second embodiment of the present invention is described below with reference to FIGS. 11 through 13. FIG. 11 is a longitudinal cut-away view showing a head unit according to this embodiment. FIG. 12 is a cross-sectional view of the head unit taken along line E-E of FIG. 11. FIG. 13 is a cross-sectional view of the head unit taken along line F-F of FIG. 11.

In the liquid feeding member 10 of this head unit, a narrow communication passage 11*b* has different depths at the end portions where a feed port 12 and a discharge port 13 are disposed and the center portion.

More specifically, the region (feed-side region) within a distance (length) Ls from the feed port 12 and the region (ejection-side region) within a distance Ls from the discharge port 13 are defined as the end portions. The region excluding the feed-side region and the ejection-side region is defined as the center portion. A depth Hb of the narrow communication passage 11*b* is greater at the end portions (e.g., in the position shown in the cross section of FIG. 13, the depth Hb=Hb2) and is smaller at the center portion (the depth Hb=Hb1 in FIG. 12). The difference between the highest part of the center portion and the lowest part of the end portions is Yb. Slopes 11*h* are formed such that the depth Hb of the narrow communication passage 11*b* gradually increases from the center portion toward the feed port 12 and the discharge port 13.

This configuration more reliably prevents meniscuses at the end portions of the liquid ejection head 1 from being broken. Because the feed port 12 and the discharge port 13 have smaller cross-sectional opening areas than the liquid circulation path 11, the liquid flows faster at the feed port 12 and the discharge port 13 than in the liquid circulation path 11. Therefore, the adverse effect of the circulation of the liquid on meniscuses is greater at the end portions that are close to the ports 12 and 13 than at the center portion that is spaced apart from the ports 12 and 13. Since the narrow communication passage 11*b* has a greater depth at the end portions where the feed port 12 and the discharge port 13 are disposed than at the center portion, it is possible to more reliably prevent meniscuses at the end portions of the liquid ejection head 1 from being broken.

Further, since the cross-sectional shape gradually changes in the vicinities of the joint between the feed port 12 and the main passage 11*a* and the joint between the discharge port 13 and the main passage 11*a*, i.e., since the depth of the narrow communication passage 11*b* gradually increases from the center portion toward the feed port 12 and the discharge port 13 as described above, the flow of the liquid inside the main passage 11*a* is stabilized.

As described above, the liquid feeding member 10 includes the liquid circulation path 11 through which the liquid circulates in a direction parallel to the direction in which the nozzles 5 of the liquid ejection head 1 are aligned. The feed port 12 through which the liquid is supplied to the liquid circulation path 11 and the discharge port 13 through which the liquid is discharged from the liquid circulation path 11 are disposed at the opposing longitudinal ends of the liquid circulation path 11. The communication opening communicating with the common liquid chamber 7 is formed at the side of the common liquid chamber 7 in the liquid circulation path 11. The communication opening has a smaller width than the liquid circulation path 11 and has a greater depth at the feed port side or at the discharge port side than at the remaining portion. With this configuration, it is possible to discharge, by the circulating current, the bubbles generated in the liquid ejection head 1 or introduced into the liquid ejection head 1 from upstream of the liquid feed path while more reliably preventing the meniscuses in the liquid ejection head 1 from being broken.

Figure 14:
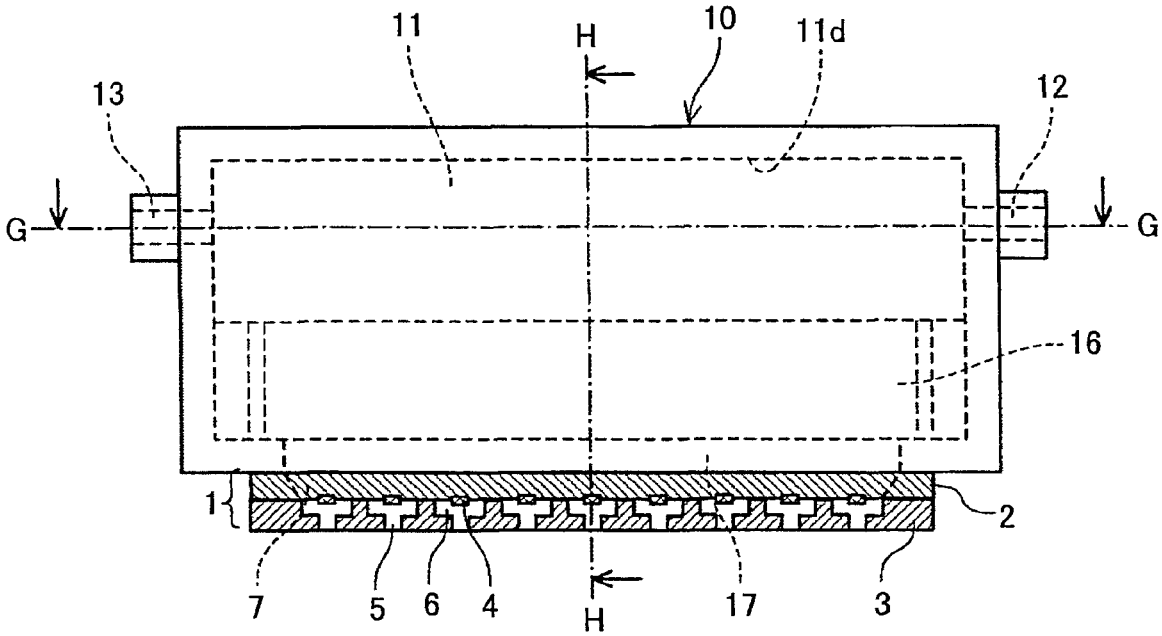
FIG. 14 is a longitudinal cut-away view of a head unit for illustrating a liquid feeding member of a third embodiment of the present invention.
Figure 15:
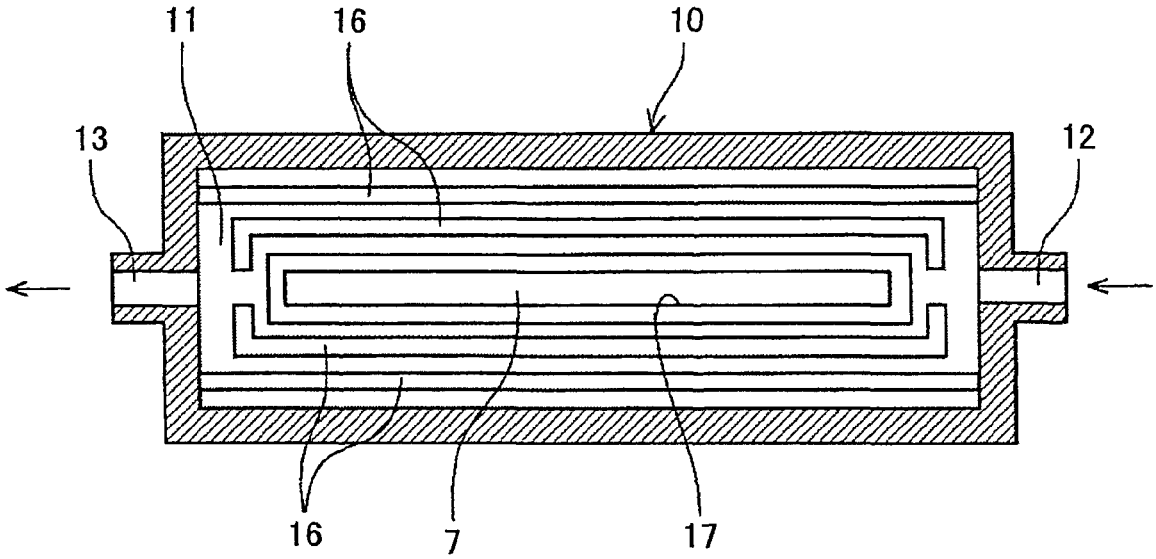
FIG. 15 is a cross-sectional view of the head unit taken along line G-G of FIG. 14.
Figure 16:
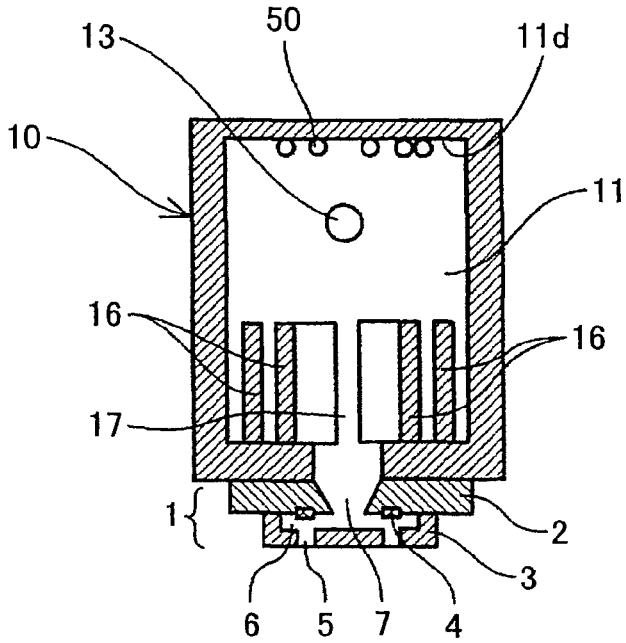
FIG. 16 is a cross-sectional view of the head unit taken along line H-H of FIG. 14.

A liquid feeding member 10 of a third embodiment of the present invention is described below with reference to FIGS. 14 through 16. FIG. 14 is a longitudinal cut-away view showing a head unit according to this embodiment. FIG. 15 is a cross-sectional view of the head unit taken along line G-G of FIG. 14. FIG. 16 is a cross-sectional view of the head unit taken along line H-H of FIG. 14.

In the liquid feeding member 10 of this head unit, a communication opening 17 communicating with a common liquid chamber 7 of a liquid ejection head 1 is formed at the side of the common liquid chamber 7 in a liquid circulation path 11. Around the communication opening 17 are disposed plural ribs 16 upright toward the main passage 11*a*.

The provision of the ribs 16 increases the contact area between the circulating liquid and the wall at the side of the common liquid chamber 7 in the liquid circulation path 11. Accordingly, when the liquid inside the liquid feeding member 10 is circulated, the circulating current is slowed down at the side of the common liquid chamber 7 in the liquid circulation path 11, resulting in reducing the adverse effect of the circulating current on meniscuses.

As described above, the liquid feeding member 10 includes the liquid circulation path 11 through which the liquid circulates in a direction parallel to the direction in which the nozzles 5 of the liquid ejection head 1 are aligned. The feed port 12 through which the liquid is supplied to the liquid circulation path 11 and the discharge port 13 through which the liquid is discharged from the liquid circulation path 11 are disposed at the opposing longitudinal ends of the liquid circulation path 11. The communication opening 17 communicating with the common liquid chamber is formed at the side of the common liquid chamber 7 in the liquid circulation path 11. The ribs 16 are disposed around the communication opening 17. With this configuration, it is possible to discharge, by the circulating current, the bubbles generated in the liquid ejection head 1 or introduced into the liquid ejection head 1 from upstream of the liquid feed path while preventing the meniscuses in the liquid ejection head 1 from being broken.

Figure 17:
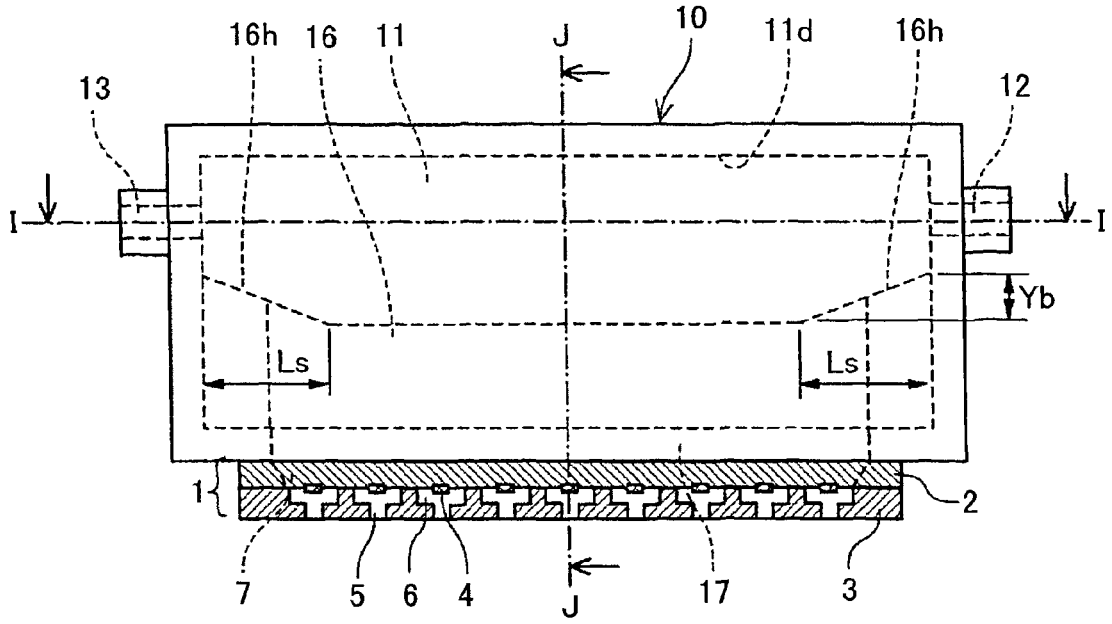
FIG. 17 is a schematic diagram of a head unit for illustrating a liquid feeding member of a fourth embodiment of the present invention.
Figure 18:
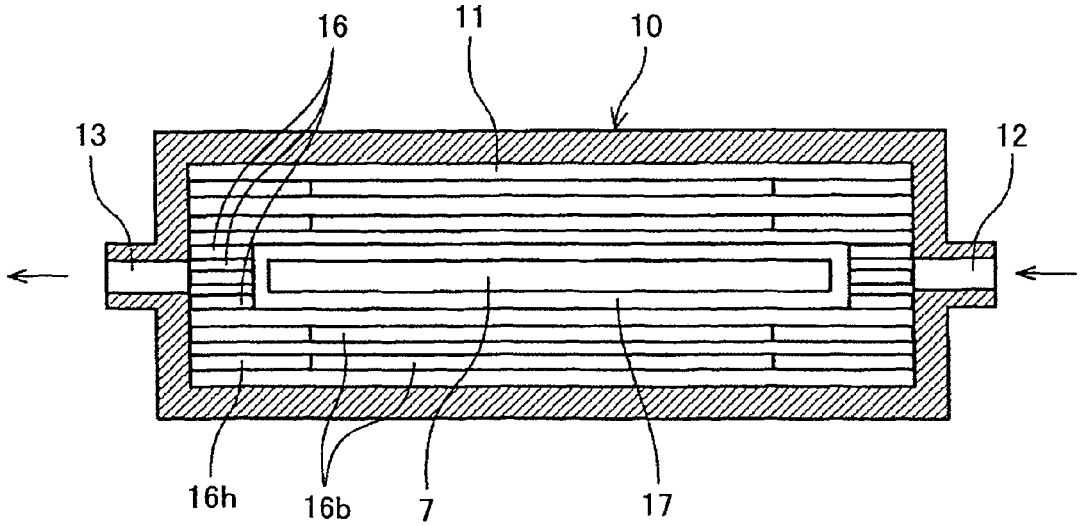
FIG. 18 is a cross-sectional view of the head unit taken along line I-I of FIG. 17.
Figure 19:
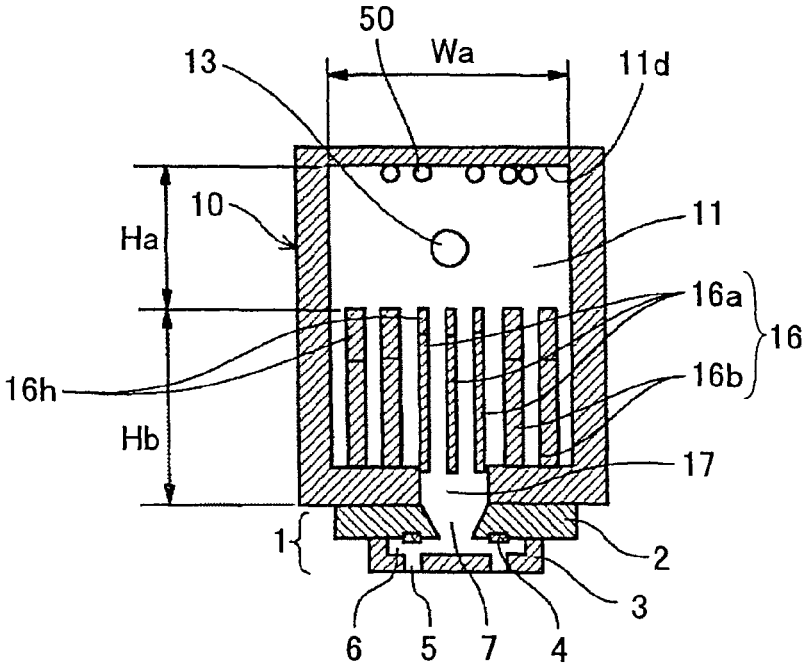
FIG. 19 is a cross-sectional view of the head unit taken along line J-J of FIG. 17.

A liquid feeding member 10 of a fourth embodiment of the present invention is described below with reference to FIGS. 17 through 19. FIG. 17 is a longitudinal cut-away view showing a head unit according to this embodiment. FIG. 18 is a cross-sectional view of the head unit taken along line I-I of FIG. 17. FIG. 19 is a cross-sectional view of the head unit taken along line J-J of FIG. 17.

In the liquid feeding member 10 of this head unit, plural ribs 16 are formed on the inner wall at the side of a common liquid chamber 7 of a liquid ejection head 1. Each rib 16 has different heights at the end portions where a feed port 12 and discharge port 13 are disposed and at the center portion.

More specifically, similar to the second embodiment, the region (feed-side region) within a distance Ls from the feed port 12 and the region (ejection-side region) within a distance Ls from the discharge port 13 are defined as the end portions. The region excluding the feed-side region and the ejection-side region is defined as the center portion. A height Hb of each rib 16 is greater at the end portions and is smaller at the center portion. The height difference of the rib 16 between the end portions and the center portion is Yb. Slopes 16*h* are formed at ribs 16*a* and 16*b* such that the heights of the ribs 16*a* and 16*b* gradually increase from the center portion toward the feed port 12 and the discharge port 13.

This configuration more reliably prevents meniscuses at the end portions of the liquid ejection head 1 from being broken. Because the feed port 12 and the discharge port 13 have smaller cross-sectional opening areas than the liquid circulation path 11, the liquid flows faster at the feed port 12 and the discharge port 13 than in the liquid circulation path 11. Therefore, the adverse effect of the circulation of the liquid on meniscuses is greater at the end portions that are close to the ports 12 and 13 than at the center portion that is spaced apart from the ports 12 and 13. Since the flow at the side of the common liquid chamber 7 is reduced as in the case of the third embodiment and since the ribs 16 have greater heights at the end portions where the feed port 12 and the discharge port 13 are disposed than at the center portion, it is possible to more reliably prevent meniscuses at the end portions of the liquid ejection head 1 from being broken. Further, since the heights of the ribs 16 gradually increase at the end portions, the cross-sectional shape gradually changes in the vicinities of the joint between the feed port 12 and the liquid circulation path 11 and the joint between the discharge port 13 and the liquid circulation path 11, resulting in a stable liquid flow.

As described above, the liquid feeding member 10 includes the liquid circulation path 11 through which the liquid circulates in a direction parallel to the direction in which the nozzles 5 of the liquid ejection head 1 are aligned. The feed port 12 through which the liquid is supplied to the liquid circulation path 11 and the discharge port 13 through which the liquid is discharged from the liquid circulation path 11 are disposed at the opposing longitudinal ends of the liquid circulation path 11. The ribs 16 are formed on the inner wall at the side of the common liquid chamber 7 in the liquid feeding member 10. With this configuration, it is possible to discharge, by the circulating current, the bubbles generated in the liquid ejection head 1 or introduced into the liquid ejection head 1 from upstream of the liquid feed path while preventing the meniscuses in the liquid ejection head 1 from being broken.

Figure 20:
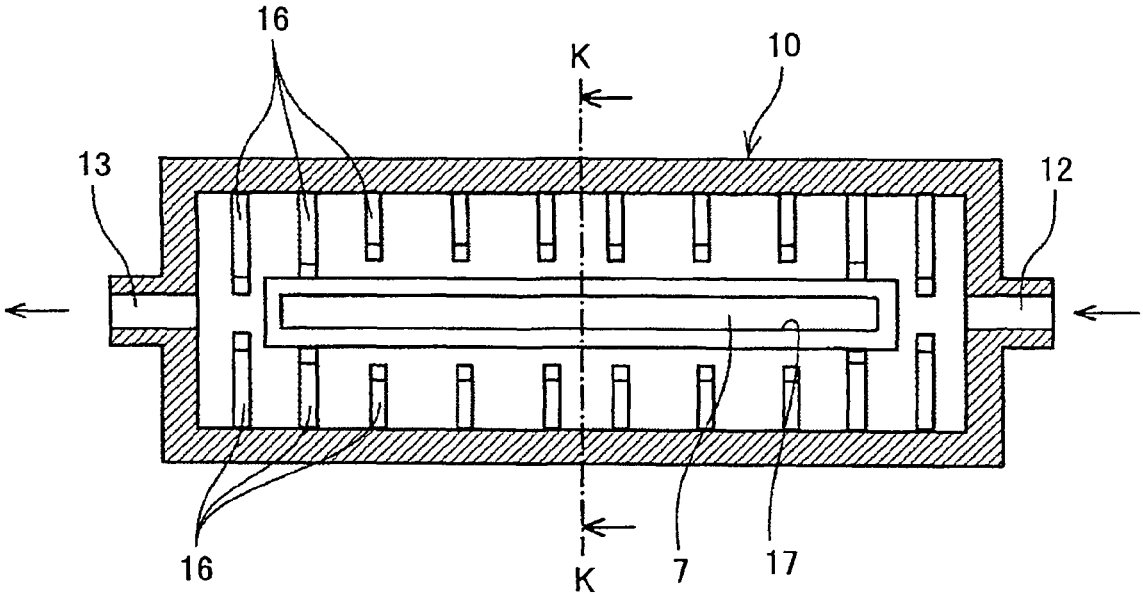
FIG. 20 is a cut-away plan view of a head unit for illustrating a liquid feeding member of a fifth embodiment of the present invention.
Figure 21:
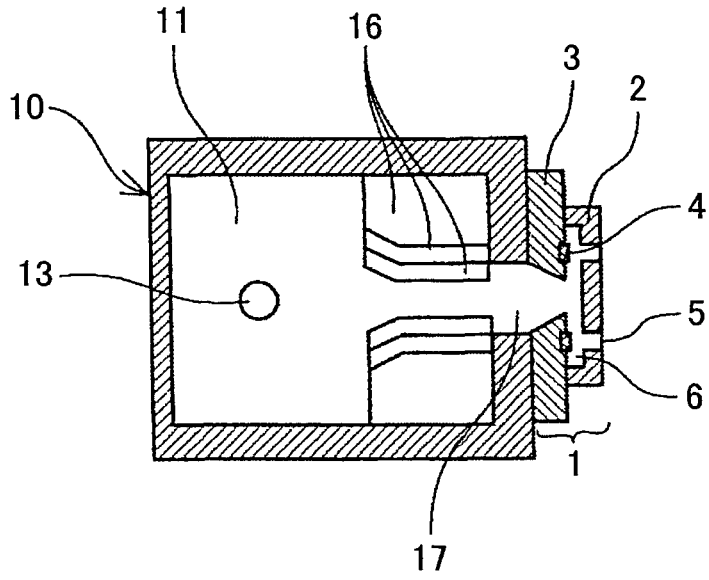
FIG. 21 is a cross-sectional view of an example of the head unit taken along line K-K of FIG. 20.
Figure 22:
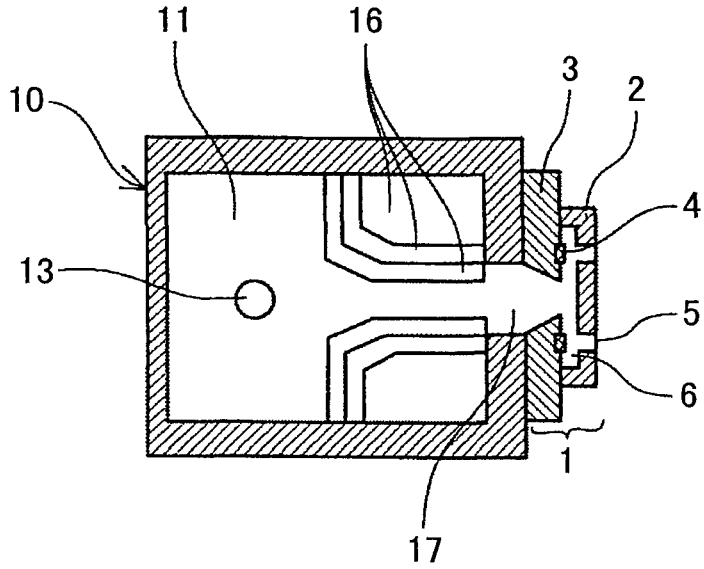
FIG. 22 is a cross-sectional view of another example of the head unit taken along line K-K of FIG. 20.

A liquid feeding member 10 of a fifth embodiment of the present invention is described below with reference to FIGS. 20 through 22. FIG. 20 is a horizontal cut-away view showing a head unit according to this embodiment. FIG. 21 is a cross-sectional view of an example of the head unit taken along line K-K of FIG. 20. FIG. 22 is a cross-sectional view of another example of the head unit taken along line K-K of FIG. 20.

In the third and fourth embodiment, the ribs 16 are formed generally parallel to the longitudinal direction of the liquid circulation path 11 (the direction of generating the circulating current). On the other hand, in the liquid feeding member 10 of the head unit of this embodiment, ribs 16 are formed in the direction orthogonal to the longitudinal direction of a liquid circulation path 11.

This configuration not only increases the contact area between the circulating liquid and the wall at the side of the common liquid chamber 7 in the liquid circulation path 11 but also allows a further reduction of the flow at the region where the ribs 16 are provided due to the change in the cross-sectional area of the liquid circulation path 11 in the direction of generating the circulating current. Accordingly, when the liquid inside the liquid feeding member 10 is circulated, the circulating current is slowed down at the side of the common liquid chamber 7 in the liquid circulation path 11, resulting in reducing the adverse effect of the circulating current on meniscuses.

As in the example shown in FIG. 22, if the ribs 16 near the feed port 12 and the discharge port 13 (at the end portions) are made to have greater heights than the ribs at the center portion, it is possible to more reliably prevent meniscuses at the end portions of the liquid ejection head 1 from being broken for the same reason as in the case of the fourth embodiment. Further, the cross-sectional shape gradually changes in the vicinities of the joint between the feed port 12 and the liquid circulation path 11 and the joint between the discharge port 13 and the liquid circulation path 11, resulting in a stable liquid flow.

Figure 23:
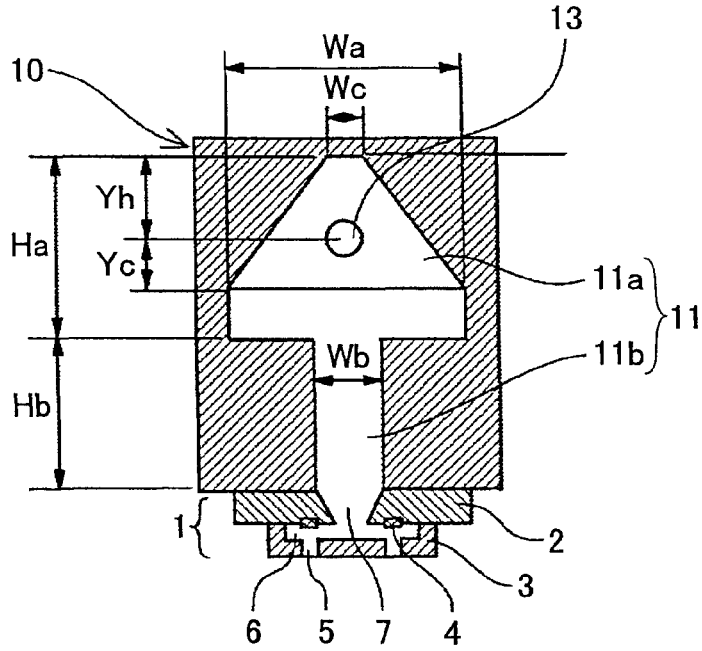
FIG. 23 is a transverse cut-away view of a head unit for illustrating a liquid feeding member of a sixth embodiment of the present invention.

A liquid feeding member 10 of a sixth embodiment of the present invention is described below with reference to FIG. 23. FIG. 23 is a transverse cut-away view showing a head unit according to this embodiment.

In the liquid feeding member 10 of this head unit, a main passage 11*a* has a shape of a triangle having an apex pointing vertically upward in the cross section of a liquid circulation path 11 orthogonal to the direction of generating the circulating current. Since the main passage 11*a* has the triangular cross-sectional shape pointing upward and is narrowed toward a ceiling 11*d*, bubbles in the liquid circulation path 11 are collected at the top, making it easy to discharge the bubbles by the circulating current. Further, small bubbles are combined into bigger bubbles on the ceiling 11*d*, making it easy to discharge the bubbles.

Figure 24:
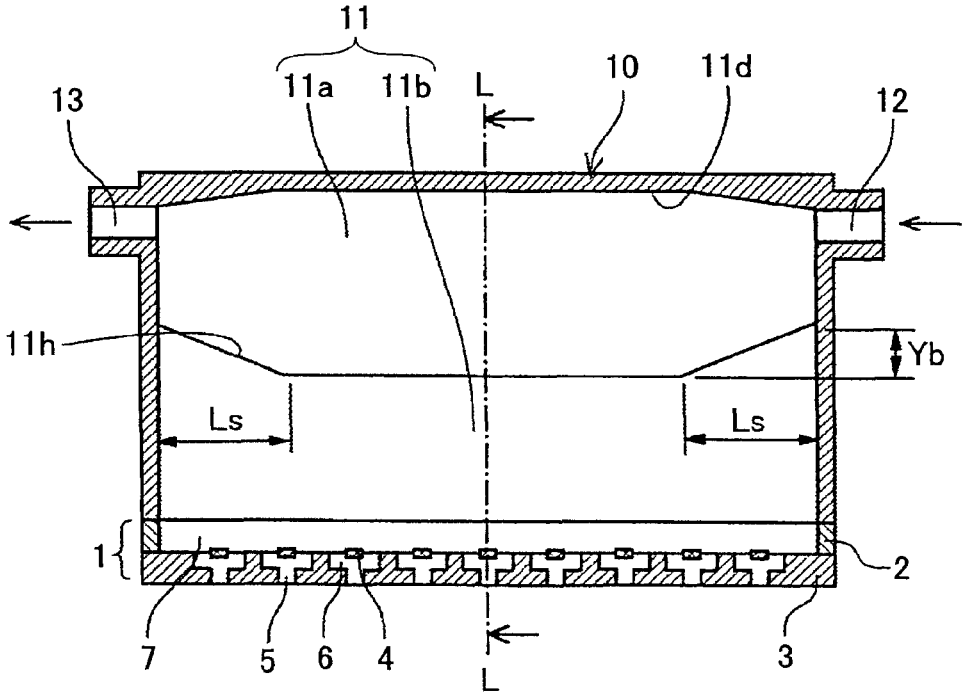
FIG. 24 is a longitudinal cut-away view of a head unit for illustrating a liquid feeding member of a seventh embodiment of the present invention.
Figure 25:
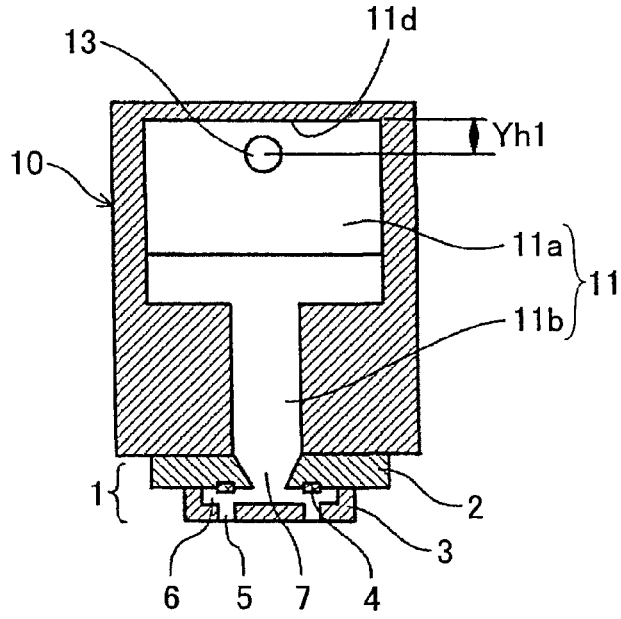
FIG. 25 is a cross-sectional view of the head unit taken along line L-L of FIG. 25.

A liquid feeding member 10 of a seventh embodiment of the present invention is described below with reference to FIGS. 24 and 25. FIG. 24 is a longitudinal cut-away view showing a head unit according to this embodiment. FIG. 25 is a cross-sectional view of the head unit taken along line L-L of FIG. 24.

In the liquid feeding member 10 of this head unit, a feed port 12 and a discharge port 13 are disposed at the longitudinal ends in positions closer to a top surface 11*d* (ceiling) of a liquid circulation path 11 than in the liquid feeding member 10 of the second embodiment.

More specifically, in the second embodiment, the feed port 12 and the discharge port 13 are disposed in the positions spaced away from the ceiling 11*d* of the liquid circulation path 11 by a height Yh. In this embodiment, the feed port 12 and the discharge port 13 are disposed in the positions spaced away from the ceiling 11*d* of the liquid circulation path 11 by a height Yh1 (Yh1<Yh).

Because the bubbles 50 float and stay on the top surface of the liquid circulation path 11 due to the buoyancy, if the circulating current is generated to have an increased speed at the position close to the ceiling 11*d* of the liquid circulating path 11, the bubbles 50 are easily discharged. Therefore, the feed port 12 and the discharge port 13 are disposed in positions close to the ceiling 11*d* of the liquid circulation path 11, thereby increasing the flow speed near the ceiling 11*d*.

As in the case of the liquid feeding members 10 of the first through seventh embodiments, because the feed port 12 and the discharge port 13 are disposed to face in the longitudinal direction of the liquid circulation path 11, i.e., the direction of generating the circulating current, the circulating current tends to flow in only one direction, resulting in increasing the effect of discharging the bubbles.

Figure 26:
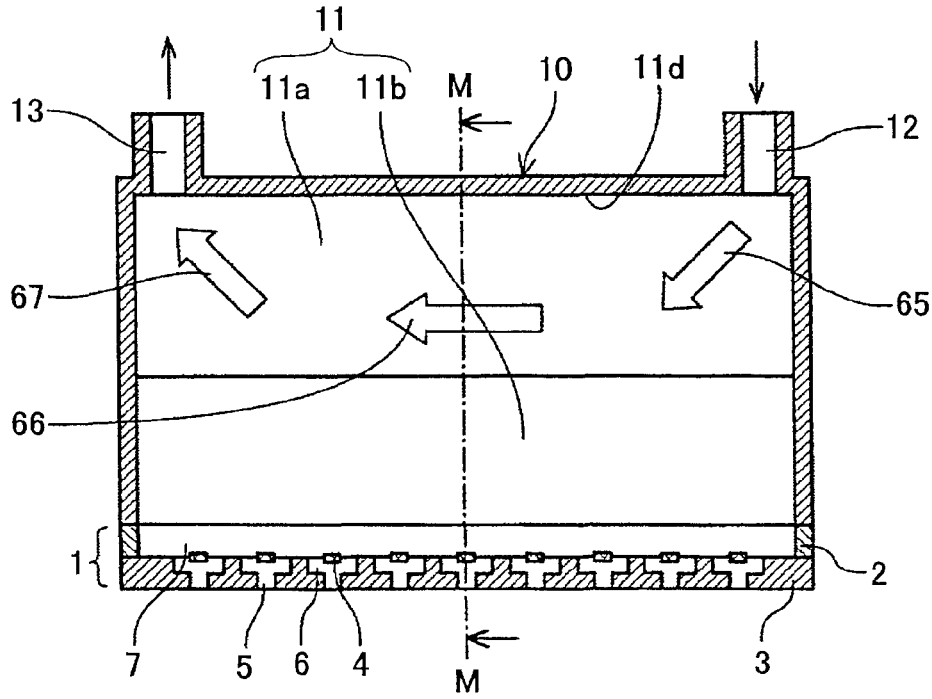
FIG. 26 is a longitudinal cut-away view showing a head unit of a comparative example 3.
Figure 27:
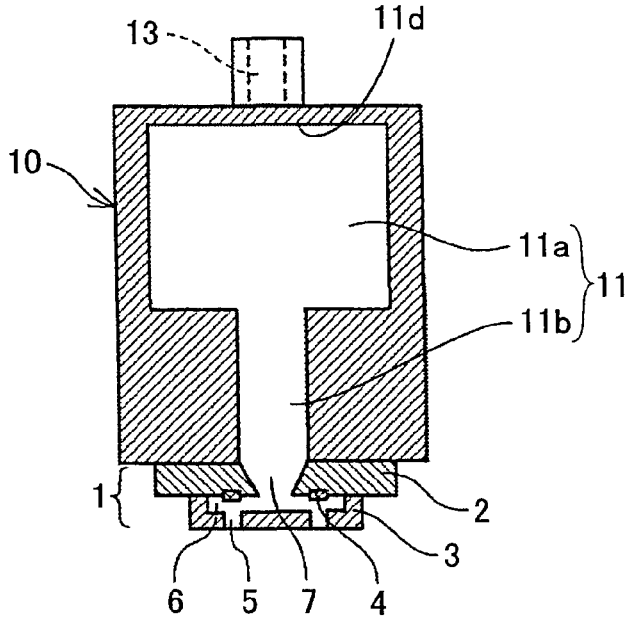
FIG. 27 is a cross-sectional view of the head unit taken along line M-M of FIG. 26.

Even in the case of a comparative example 3 shown in FIGS. 26 and 27 in which a feed port 12 and a discharge port 13 are formed in the surface (a ceiling 11*d*) opposing the surface of a liquid feeding member 10 connected to a liquid ejection head 1 (so as to be connected to the liquid circulation path 11), a circulating current is generated. However, the circulating current flows as indicated by the arrows 65 through 67, so that the flow rate component in the direction of the liquid ejection head 1 is undesirably increased.

Figure 28:
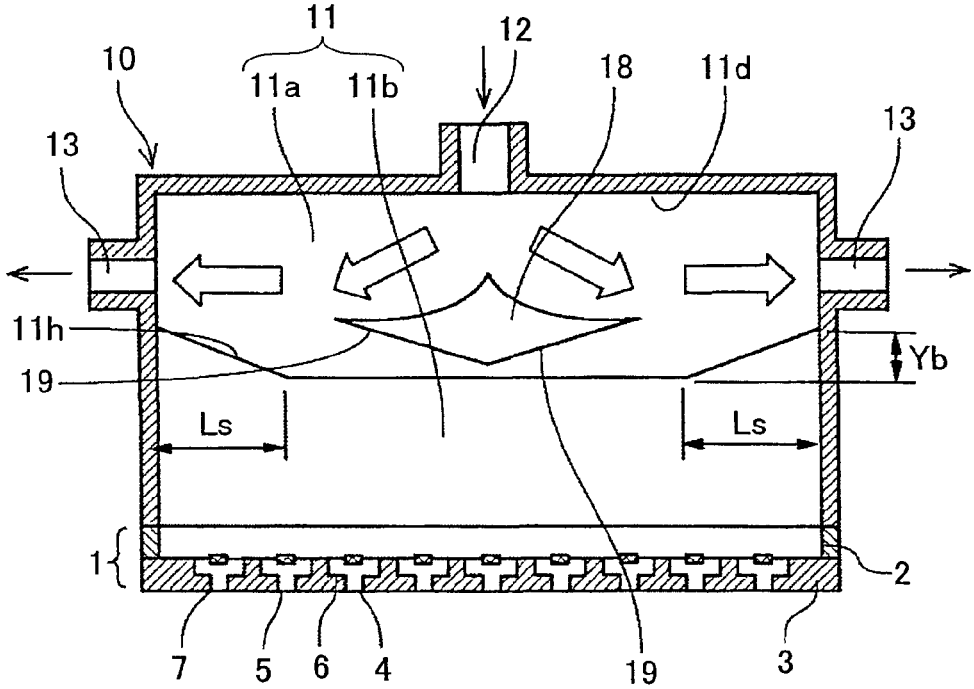
FIG. 28 is a longitudinal cut-away view of a head unit for illustrating a liquid feeding member of an eighth embodiment of the present invention.

A liquid feeding member 10 of an eighth embodiment of the present invention is described below with reference to FIG. 28. FIG. 28 is a longitudinal cut-away view showing a head unit according to this embodiment.

The liquid feeding member 10 of this head unit is different from the liquid feeding member 10 of the second embodiment in that a feed port 12 is disposed at the longitudinal center portion in the surface (at the side of a ceiling 11*d*, also referred to as a ceiling portion) opposing the surface of a liquid feeding member 10 connected to a liquid ejection head 1, and discharge ports 13, 13 are disposed at the longitudinal ends (alternatively, feed ports 12, 12 may be disposed at the ends, and a discharge port 13 may be disposed at the center portion at the ceiling side).

A flow guide member 18 for guiding the flow of the liquid from the feed port 12 toward the discharge ports 13, 13 is provided between the feed port 12 and a common liquid chamber 7 of a liquid ejection head 1. The surface of the flow guide member 18 opposing the common liquid chamber 7 forms a slope 19 so as not to entrap bubbles rising from the common liquid chamber 7.

In the case where the feed port 12 (or the discharge port 13) is disposed at the longitudinal center portion in the ceiling portion of the liquid feeding member 10, the provision of the flow guide member 18 can prevent the circulating current from adversely affecting meniscuses in the liquid ejection head 1.

Figure 29:
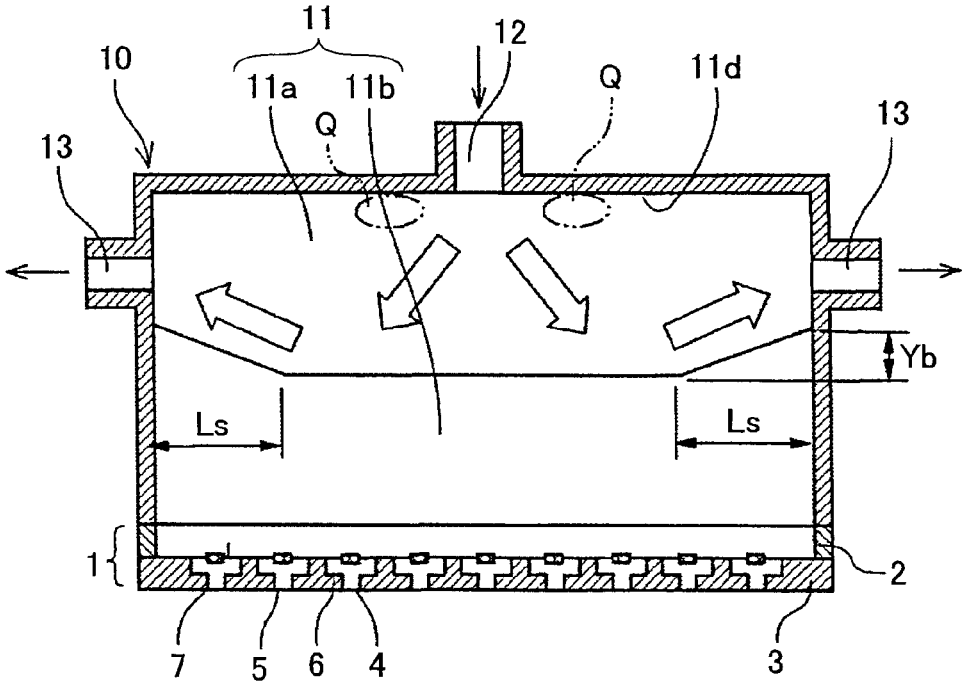
FIG. 29 is a longitudinal cut-away view of a head unit for illustrating the eighth embodiment.

In the case of a comparative example 4 shown in FIG. 29 in which no flow guide member 18 is provided, bubbles can easily be discharged due to the short distance between a feed port 12 and each discharge port 13. However, an adverse effect on meniscuses is more likely to occur due to an increased flow rate component in the direction of a liquid ejection head 1. Further, the liquid flows in two opposite directions in one pipe, which may result in stagnation and swirling of the flow at the boundary. Thus, the performance of discharging bubbles is lower than in the configuration where the liquid flows in only one direction.

Therefore, in the case where the feed port 12 or the discharge port 13 is not disposed in the direction of the flow of the circulating current, the flow guide member 18 is provided between the feed port 12 or the discharge port 13 and the common liquid chamber 7 of the liquid ejection head 1 so as to guide the flow. Thus, it is possible to prevent the circulating current from adversely affecting meniscuses in the liquid ejection head 1.

As described above, the liquid feeding member 10 includes the liquid circulation path 11 through which the liquid circulates in a direction parallel to the direction in which the nozzles 5 of the liquid ejection head 1 are aligned. The feed port 12 through which the liquid is supplied to the liquid circulation path 11 and the discharge ports 13, 13 through each of which the liquid is discharged from the liquid circulation path 11 are provided. The feed port 12 is disposed at a portion not at a longitudinal end of the liquid circulation path 11. A flow guide member 18 that guides the flow of the liquid is provided between the feed port 12 disposed at the portion not at a longitudinal end and a common liquid chamber 7. With this configuration, it is possible to discharge, by the circulating current, the bubbles generated in the liquid ejection head 1 or introduced into the liquid ejection head 1 from upstream of the liquid feed path while preventing the meniscuses in the liquid ejection head 1 from being broken. Further, even when the feed port 12 or the discharge port 13 is disposed at the portion not at the longitudinal end of the liquid feeding member 10, the flow guide member 18 can change the direction of the flow of the liquid generated by the circulation of the liquid to and thus can prevent adverse effects on the liquid ejection head 1. Therefore, the liquid feeding member can be provided with a large number of ports so as to improve the performance of discharging bubbles.

Figure 30:
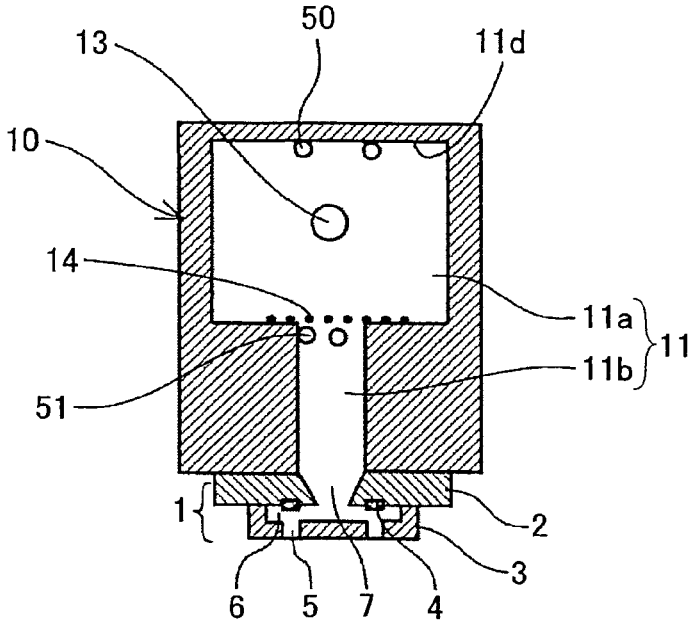
FIG. 30 is a transverse cut-away view showing a head unit of a comparative example 5.

It is not preferable to provide a filter 14 inside the liquid circulation path 11 of the liquid feeding member 10 as in a comparative example 5 shown in FIG. 30. The provision of the filter 14 is effective in reducing the influence of the flow of the circulating current on the liquid ejection head side and in preventing the bubbles 50 inside the main passage 11*a* from entering the liquid ejection head 1. However, when bubbles 51 that have been introduced from the nozzles 5 or generated inside the individual liquid chambers 6 move toward the main passage 11*a* of the liquid circulation path 11 through the common liquid chamber 7, the bubbles 51 are blocked by the filter 14 and cannot be discharged by the circulating current. The bubbles 51 cannot be discharged by the circulating current and can only be discharged from the nozzles 5 together with the liquid. For this reason, it is not preferable to provide a filter 14 inside the liquid ejection head 1 and the liquid circulation path 11.

Figure 31:
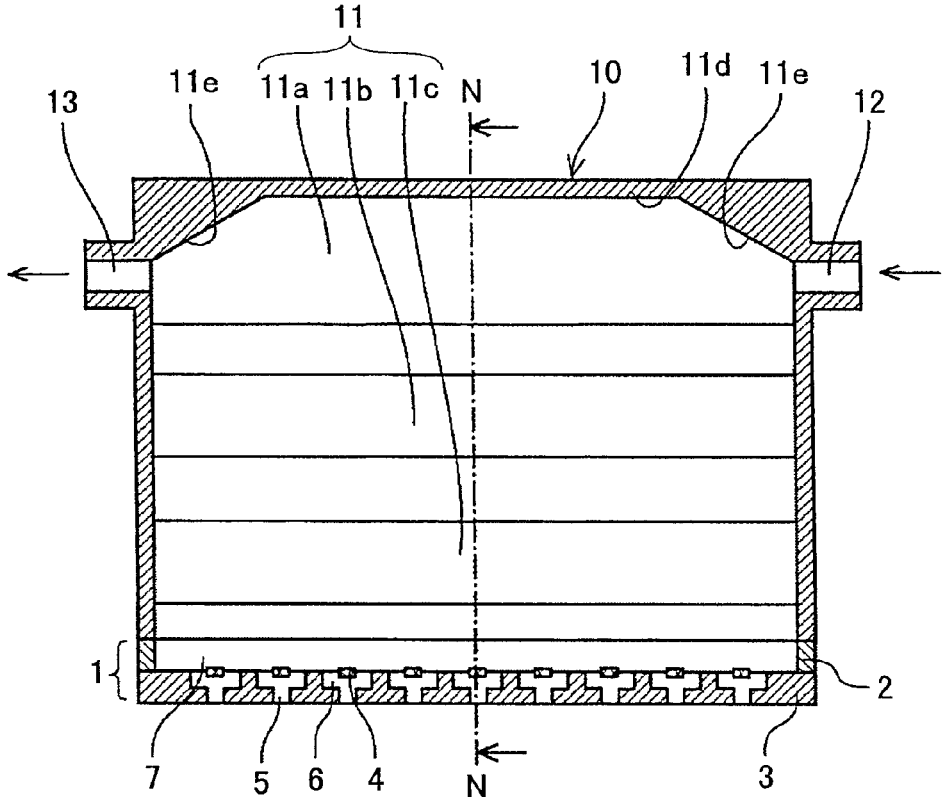
FIG. 31 is a longitudinal cut-away view of a head unit for illustrating a liquid feeding member of a ninth embodiment of the present invention.
Figure 32:
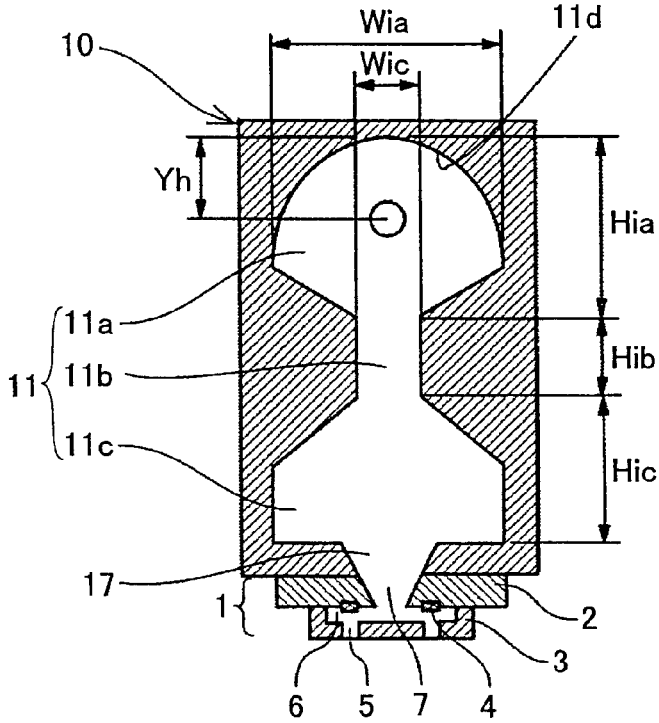
FIG. 32 is a cross-sectional view of the head unit taken along line N-N of FIG. 31.

A liquid feeding member 10 of a ninth embodiment of the present invention is described below with reference to FIGS. 31 and 32. FIG. 31 is a longitudinal cut-away view showing a head unit according to this embodiment. FIG. 32 is a cross-sectional view of the head unit taken along line N-N of FIG. 31.

The forgoing description illustrates the liquid feeding member 10 such as that of the second embodiment in which the narrow communication passage 11*b* of the liquid circulation path 11 is directly connected to the common liquid chamber 7 of the liquid ejection head 1, and the liquid feeding member 10 such as that of the third embodiment in which the ribs 16 are formed at the side of the common liquid chamber 7 in the liquid circulation path 11.

In the liquid feeding member 10 of the head unit of the ninth embodiment, a liquid buffer passage 11*c* is provided between a narrow communication passage 11*b* of a liquid circulation path 11 and a liquid ejection head 1. More specifically, the liquid circulation path 11 is narrower at the substantial center (at the narrow communication passage 11*b*) and wider at the end portions (at the main passage 11*a* and the liquid buffer passage 11*c*) in a cross section orthogonal to the flow of the liquid from the feed port 12 toward the discharge port 13. The liquid buffer passage 11*c* forming one of the wider portions communicates with the common liquid chamber 7 through a communication opening 17. The feed port 12 and the discharge port 13 are disposed at the side of the main passage 11*a* forming the other one of the wider portions.

With this configuration, bubbles in the liquid ejection head 1 and the liquid circulation path 11 can be discharged using the circulating current without breaking meniscuses. Further, the liquid buffer passage 11*c* attenuates a pressure wave due to an ejection of liquid droplets, thereby enhancing the stability of ejection of liquid droplets.

A ceiling 11*d* of the main passage 11*a* of the liquid circulation path 11 has an upwardly-curved convex shape in the cross section orthogonal to the longitudinal direction. The main passage 11*a* is connected smoothly with the feed port 12 and the discharge port 13 by slopes 11*e*. This configuration prevents development of swirling flow and separated flow in the main passage 11*a*, and can efficiently discharge bubbles.

As described above, the liquid feeding member 10 includes the liquid circulation path 11 through which the liquid circulates in a direction parallel to the direction in which the nozzles 5 of the liquid ejection head 1 are aligned. The feed port 12 through which the liquid is supplied to the liquid circulation path 11 and the discharge port 13 through which the liquid is discharged from the liquid circulation path 11 are disposed at the opposing longitudinal ends of the liquid circulation path 11. The liquid circulation path 11 is narrower at a substantial center portion and wider at end portions in a cross section orthogonal to the flow of the liquid from the feed port 12 toward the discharge port 13. One of the end portions communicates with an opening of the common liquid chamber 7. The feed port 12 and the discharge port 13 are disposed at the other one of the end portions. With this configuration, it is possible to discharge, by the circulating current, the bubbles generated in the liquid ejection head 1 or introduced into the liquid ejection head 1 from upstream of the liquid feed path while preventing the meniscuses in the liquid ejection head 1 from being broken.

Further, the region with the feed port 12 and the discharge port 13 in which the circulating current is generated has a reduced area to increase the flow speed of the circulating current while maintaining the usual flow rate of feeding the liquid, thereby further improving the performance of discharging bubbles. The region close to the liquid ejection head 1 has a wider space to function as buffer space for preventing failures due to transmission of ejection pressure, thereby further increasing the ejection stability.

Figure 33:
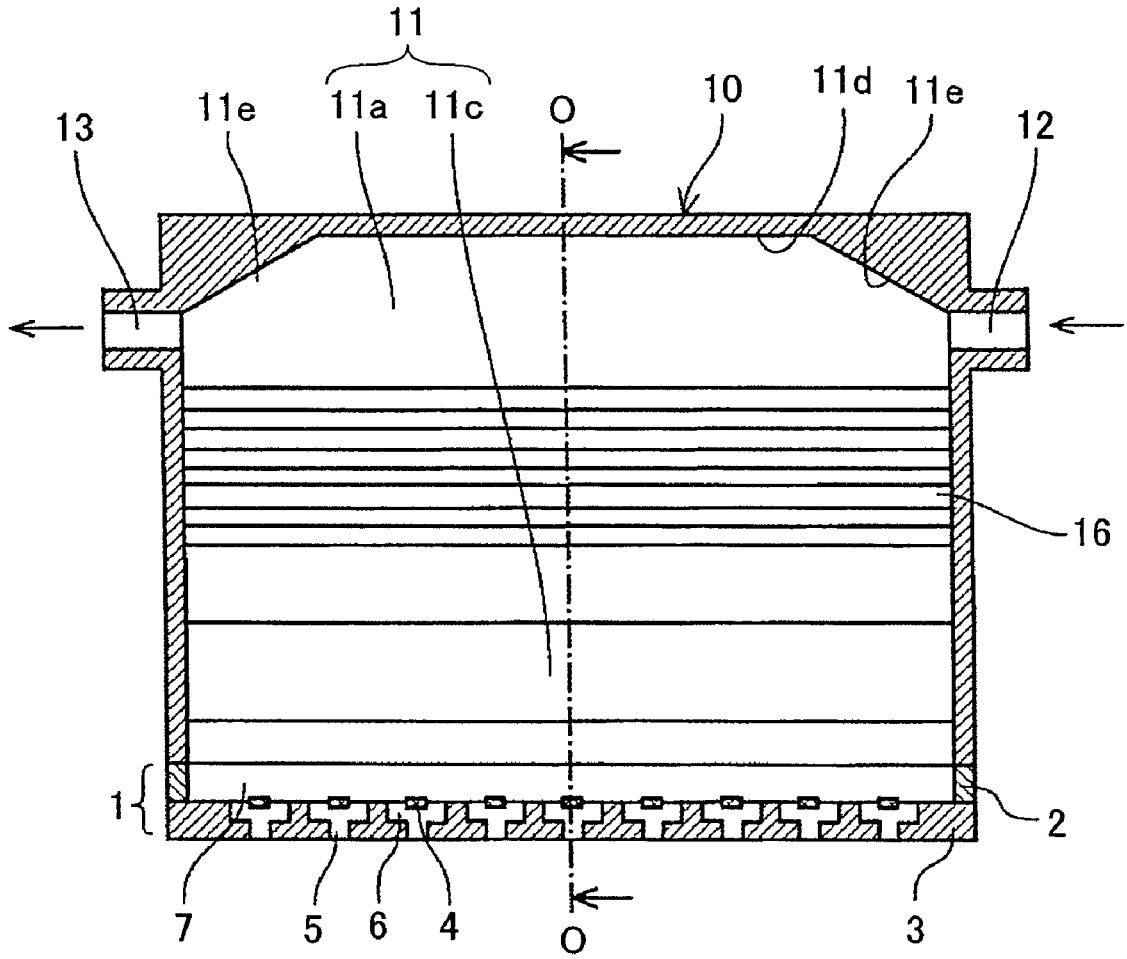
FIG. 33 is a longitudinal cut-away view of a head unit for illustrating a liquid feeding member of a tenth embodiment of the present invention.
Figure 34:
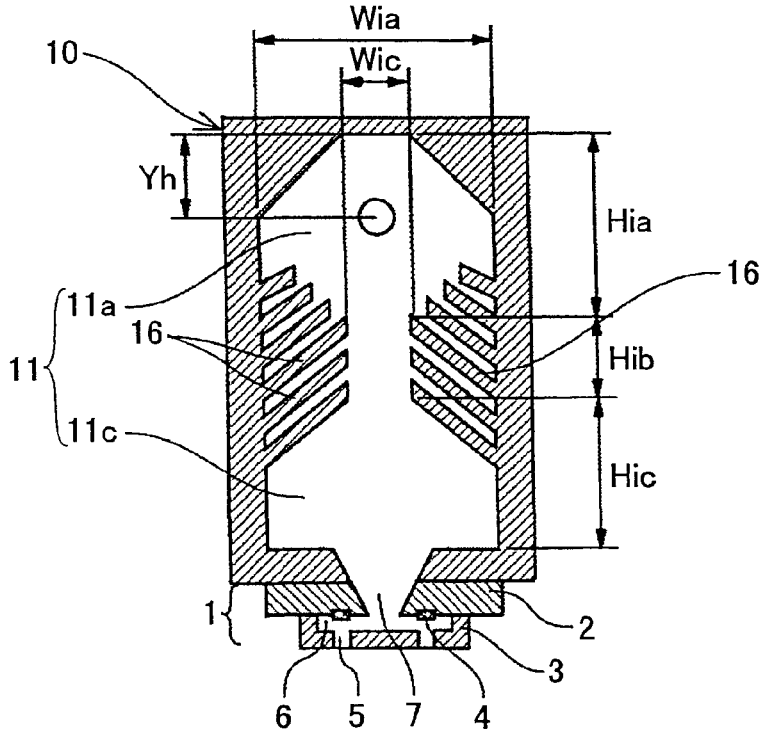
FIG. 34 is a cross-sectional view of the head unit taken along line O-O of FIG. 34.

A liquid feeding member 10 of a tenth embodiment of the present invention is described below with reference to FIGS. 33 and 34. FIG. 33 is a longitudinal cut-away view showing a head unit according to this embodiment. FIG. 34 is a cross-sectional view of the head unit taken along line O-O of FIG. 33.

The third embodiment and the ninth embodiment are applied to this embodiment, in which ribs 16 are provided at the center in a liquid circulation path 11 while a liquid buffer passage 11*c* is provided on the upper part of a common liquid chamber 7.

With this configuration, bubbles in a liquid ejection head 1 and the liquid circulation path 11 can be discharged using the circulating current without breaking meniscuses. Further, the liquid buffer passage 11*c* attenuates a pressure wave due to an ejection of liquid droplets, thereby enhancing the stability of ejection of liquid droplets.

Figure 35:
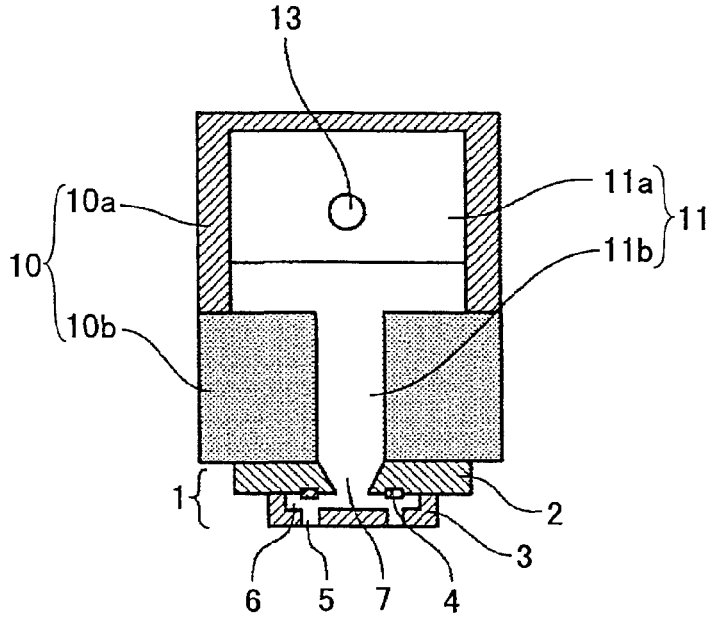
FIG. 35 is a transverse cut-away view of a head unit for illustrating a liquid feeding member of an eleventh embodiment of the present invention.

A liquid feeding member 10 of an eleventh embodiment of the present invention is described below with reference to FIG. 35. FIG. 35 is a transverse cut-away view showing a head unit according to this embodiment.

According to the liquid feeding member 10 of this head unit, a main passage part 10*a* defining a main passage 11*a* and a narrow communication passage part 10*b* defining a narrow communication passage 11*b* are separate members (components) made of different materials. The narrow communication passage part 10*b* is made of a material having a higher thermal conductivity than the material of the main passage part 10*a*. Preferable examples of a material having a higher thermal conductivity include metal materials and resin materials containing thermal conductive fillers such as silica, alumina, boron nitride, magnesia, aluminum nitride, and silicon nitride.

As the ejection frequency of the liquid ejection head 1 increases, the temperature of the liquid ejection head 1 increases due to heat generated by itself. Especially, the thermal type liquid ejection heat that ejects liquid droplets through film boiling using a heating element shows a significant temperature increase. The temperature rise of the liquid ejection head 1 raises the temperature of the liquid inside thereof. The fluctuation of the temperature of the liquid to be ejected leads to fluctuation of ejection volume and ejection speed of liquid droplets.

If, as in this embodiment, the narrow communication passage part 10*b* of the liquid feeding member 10 defining the narrowest portion of the passage of the liquid to be supplied to the liquid ejection head 1 is made of a material having high thermal conductivity, the heat generated by the liquid ejection head 1 is effectively transferred to the narrow communication passage part 10*b* to prevent a temperature increase. This facilitates stabilization of the temperature of the liquid to be supplied to the liquid ejection head 1 and achievement of consistent properties of droplet ejection.

Figure 36:
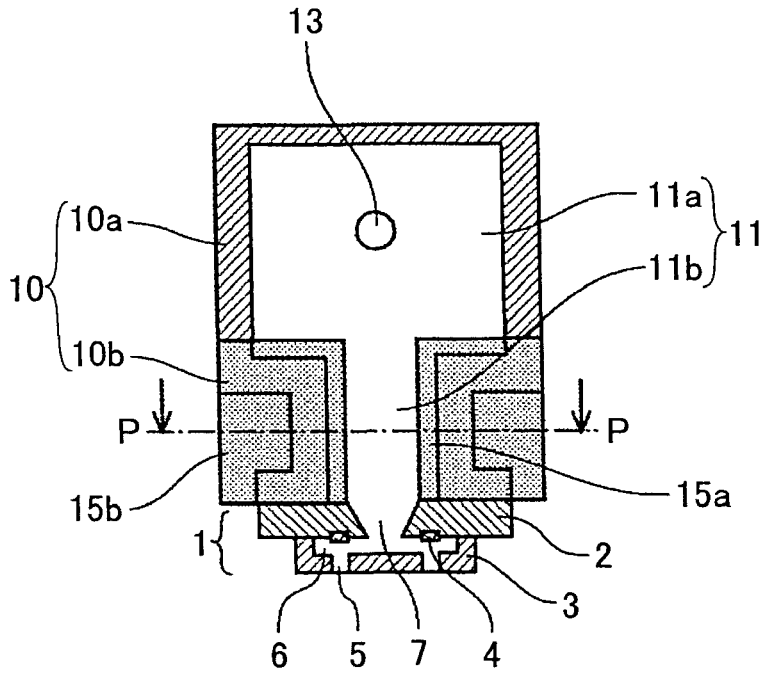
FIG. 36 is a transverse cut-away view of a head unit for illustrating a liquid feeding member of a twelfth embodiment of the present invention.
Figure 37:
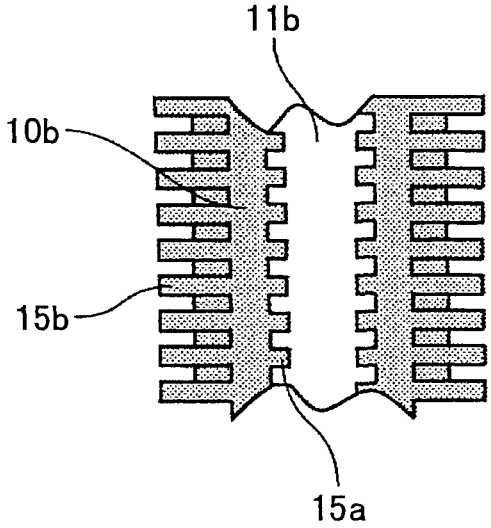
FIG. 37 is a cross-sectional view taken along line P-P of FIG. 36.

A liquid feeding member 10 of a twelfth embodiment of the present invention is described below with reference to FIGS. 36 and 37. FIG. 36 is a transverse cut-away view showing a head unit according to this embodiment. FIG. 37 is a cross-sectional view of the head unit taken along line P-P of FIG. 36.

According the liquid feeding member 10 of this head unit, as in the case of the eleventh embodiment, a main passage part 10*a* including a main passage 11*a* and a narrow communication passage part 10*b* including a narrow communication passage 11*b* are separate members (components) made of different materials. In order to further increase the heat transfer effect of the narrow communication passage part 10*b*, an inner fin 15*a* and an outer fin 15*b* are disposed at the inner side and the outer side, respectively, of the liquid circulation path 11.

This configuration increases the contact area with the liquid inside the liquid circulation path 11 and the outside air, thereby further facilitating stabilization of the temperature.

Similar to the ribs 16 of the fifth embodiment, the inner fin 15*a* serves to reduce the adverse effect of the circulating current on the liquid ejection head 1. Regarding to the orientation of the inner fin 15*a*, at least on the narrow communication passage 11*b*, as shown in FIG. 36, the longitudinal direction of the inner fin 15*a* is preferably parallel to the direction from the main passage 11*a* toward the liquid ejection head 1, i.e., orthogonal to the circulating current. This configuration can further reduce the circulating current in the narrow communication passage 11*b* without preventing bubbles from rising from the common liquid chamber 7.

The following describes an image forming apparatus including a liquid ejection device of an embodiment of the present invention. In the following example, a liquid ejection device of an embodiment of the present invention is applied to an inkjet printer, which inkjet printer ejects ink as liquid and is applicable to facsimile machines, copiers, and multifunction machines with facsimile and copier functions. However, the liquid ejection device can be applied to a liquid ejection head or a liquid ejection device that ejects liquid which is not ink but is, e.g., DNA samples, resist, pattern materials, or to an image forming apparatus including such a liquid ejection head or a liquid ejection device.

Figure 38:
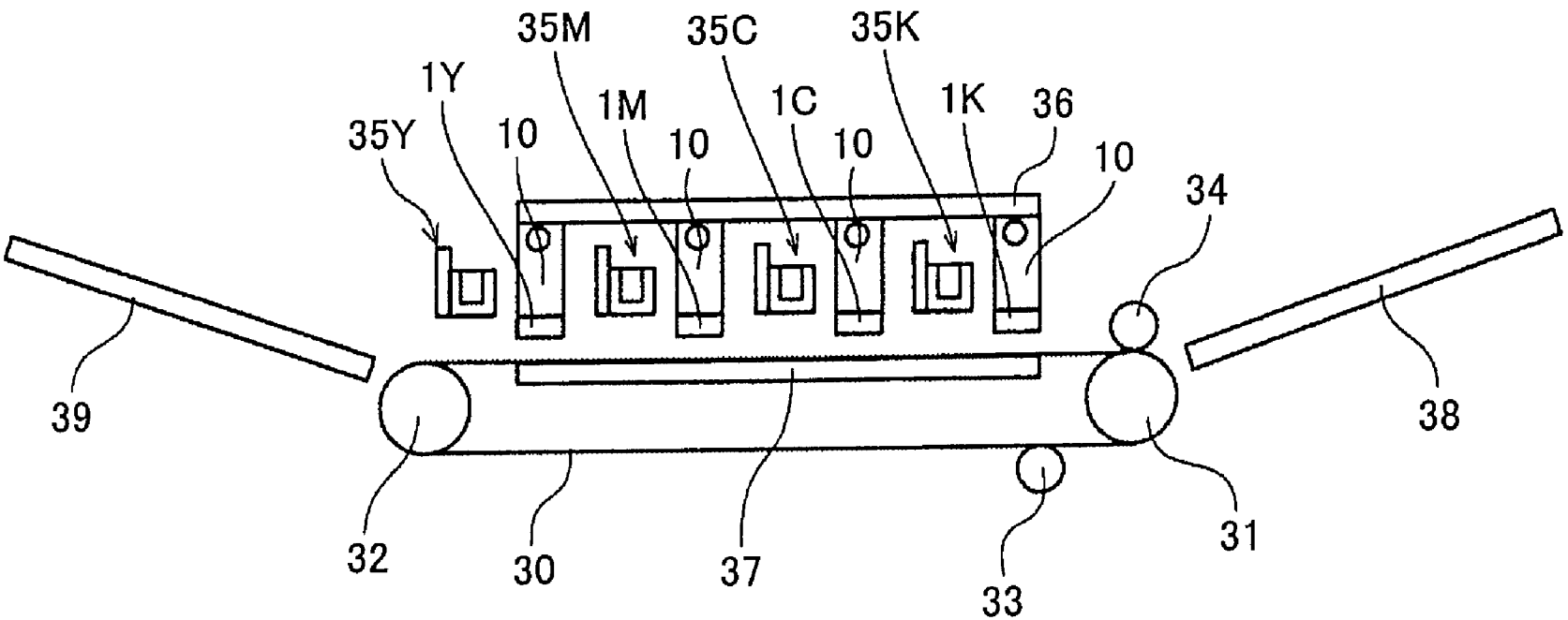
FIG. 38 is a schematic configuration diagram for illustrating an image forming apparatus of a thirteenth embodiment of the present invention.
Figure 39:
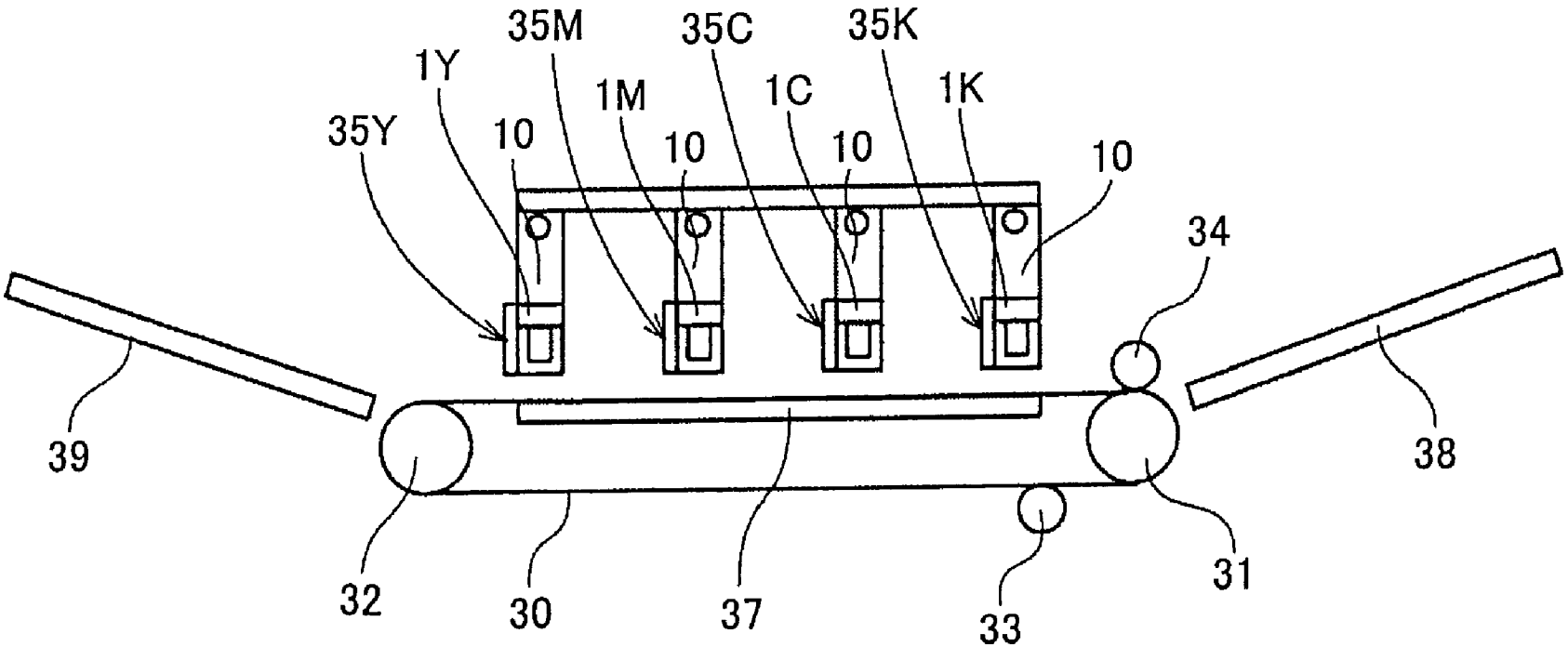
FIG. 39 is a is a diagram for illustrating a maintenance/recovery operation of the image forming apparatus.
Figure 40:
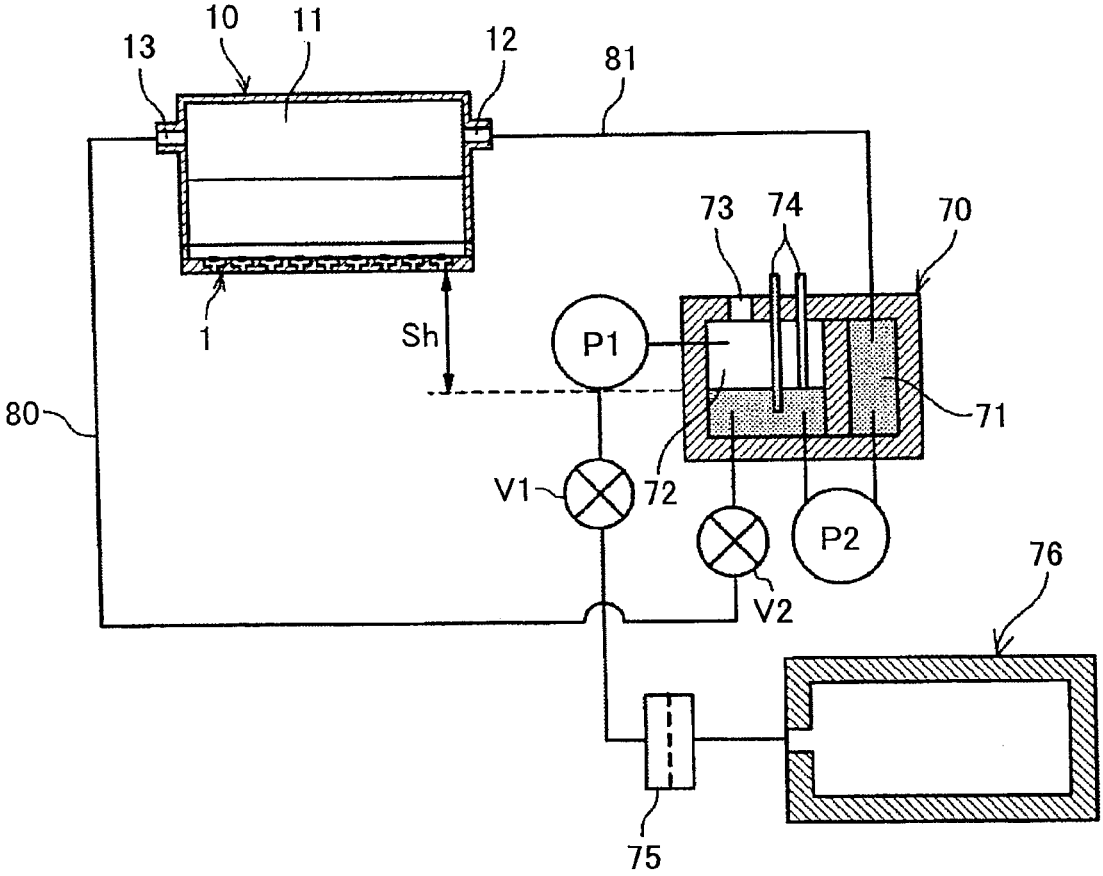
FIG. 40 is a schematic diagram for illustrating a liquid feed path of the image forming apparatus.

An image forming apparatus of a thirteenth embodiment of the present invention is described below with reference to FIGS. 38 through 40. FIG. 38 is a schematic configuration diagram of the image forming apparatus. FIG. 39 is a diagram for illustrating a maintenance/recovery operation of the image forming apparatus. FIG. 40 is a schematic diagram for illustrating a liquid feed path.

The image forming apparatus is a line printer that includes four recording heads 1 (1K, 1C, 1M, and 1Y), i.e., liquid ejection heads, for inks of four different colors (black, cyan, magenta, and yellow). Each of the recording heads 1 has an elongated shape having a length corresponding to the width of the maximum size recording sheet. The four recording heads 1 are fixed to a head frame 36 so as to be moved up and down together by a head lifting mechanism (not shown).

The recording sheet is transported directly under the recording heads 1 so that images are recorded on the recording sheet. Recording sheets are stacked in a feed tray 38, are fed one by one by a sheet separating/feeding mechanism (not shown), are transported by a sheet transport belt 30, and, after completion of recording, are discharged into a catch tray 39.

The sheet transport belt 30 extends between a belt transport roller 31 and a tension roller 32. The sheet transport belt 30 has a double layer structure including a high-resistance layer made of a resin material as a front layer and an intermediate-resistance layer made of a resin material with carbon for resistance control as a back layer. The sheet transport belt 30 is in contact with a charger roller 33. The charger roller includes a metal roller, an intermediate-resistance layer as the outer layer of the metal roller, and a thin high-resistance layer as the outermost layer.

When a high voltage is applied to the charger roller 33, electricity is discharged in an air gap near the nip between the sheet transport belt 30 and the charger roller 33, so that electric charges are attached to the sheet transport belt 30. If an alternating current is applied to the charger roller 33, the sheet transport belt 30 is alternately positively and negatively charged. When the recording sheet is on the charged sheet transport belt 30, the recording sheet is attached to the sheet transport belt 30 due to the electrostatic effect. Thus the recording sheet is firmly attached to the sheet transport belt 30 while printing is performed. Therefore, even in the case where printing is performed while transporting the sheet at high speed, it is possible to achieve consistent high quality printing.

Each recording head 1 is a thermal type such as one described in the second embodiment, which produces ejection pressure through ink film boiling using the heating element 4 as illustrated in the second embodiment. The recording head 1 has a side shooter structure in which the direction of the ink flowing toward an ejection energy application portion (heating element portion) in each individual liquid chamber 6 is at a right angle to the center axis of the opening of the corresponding nozzle 5.

This configuration is advantageous not only in efficiently converting the energy generated by the heating element 4 into energy for forming ink droplets and propelling the ink droplets, but also in quickly restoring a meniscus by feeding ink. Further, the side shooter structure prevents a so-called cavitation phenomenon, which occurs in edge shooter structures and gradually damages the heating element 4 due to the impact of collapsing bubbles. This is because, in the side shooter structure, bubbles grow and reach the nozzle 5 to communicate with the atmosphere, which prevents contraction of the bubbles due to temperature decrease. Therefore, the recording head 1 of the side shooter structure has a longer service life.

The recording head 1 can be manufactured using the following processing steps, for example. First, in order to form the heating element substrate 2, a silicon wafer is prepared that has an $SiO_2$ film formed by thermal oxidation. An $HfB_2$ film is deposited by RF magnetron sputtering to form a heat generating resistor layer on the silicon wafer. Then, Al is deposited using an EB evaporation technique to form an electrode layer. Then, the Al layer is etched with a nitrate phosphate etching solution using a photolithography technique. The heat generating resistor layer is etched using RIE. In order to expose the heating element 4, a resist film is formed except for the portion to be exposed. The Al on the portion not covered with the resist film is etched with an etching solution. Thus, the heating element 4 is formed between a pair of electrodes. An $SiO_2$ layer 2 as a passivation film is formed on an electrothermal converter. Finally, a polyimide layer is formed on a portion without the heating element 4, so that the heating element substrate 2 is formed.

Next, a dry film prepared by drying PET coated with polymethyl isopropenyl ketone (ODUR-1010, Tokyo Oka Kogyo Co. Ltd.,) is laminated and transferred onto the heating element substrate 2. After pre-baking, pattern exposure of the individual liquid chambers 6 is performed. Then, development is carried out using methyl isobutyl ketone/xylene=2/1. Then, a resin composition containing epoxy resin, photo cation polymerization initiator, and silane coupling agent is dissolved in a methyl isobutyl ketone/xylene solvent mixture at a concentration of 50 wt %. The solution is spin-coated to form a photosensitive coating material layer. Thereafter, pattern exposure of the nozzles 5 and an after baking process are performed. Then, development is performed using methyl isobutyl ketone, so that nozzles 5 are formed.

The product is dipped in methyl isobutyl ketone with application of ultrasonic waves to melt the remaining soluble resin. Then, the photosensitive coating material layer is heated for 1 hour at 150° C. to be cured completely. Finally, a common liquid chamber 7 is formed by anisotropically etching silicon using TMAH (tetramethylammonium hydroxide (TMAH) solution. To prevent damage to the obtained liquid chamber member, a passivation layer made of cyclized rubber is provided to protect the surface of the silicon substrate at the side where the nozzles 5 are formed.

With the steps described above, a line type recording head 1 can be manufactured that has a 600 dpi/array, 2400 CH/array (indicating 2400 nozzles 5 in one array), a nozzle array interval of 240 μm, a maximum opening width of the common liquid chamber 7 of about 1.8 mm, and a length of about 110 mm.

A liquid feeding member 10 used herein is the liquid feeding member 10 of the second embodiment. A component with a path (liquid circulation path 11) having a cross-sectional shape shown in FIGS. 11 through 13 is formed by cutting and pasting transparent polycarbonate resin and is bonded to the liquid ejection head 1. With reference to FIGS. 11 through 13, the inner dimension of this liquid feeding member 10 is, for example, Wa: 5 mm, Wb: 2.4 mm, Ha: 6 mm, Hb: 4 mm, Yb: 1.5 mm, and Ls: 5 mm. A feed port 12 and a discharge port 13 are disposed at the opposing ends of the liquid feeding member 10 at the cross-sectional center (in a position of Yh: 3 mm) of the main passage 11*a* and are connected to an ink feed system in a liquid feed path as shown in FIG. 40.

In this liquid feed path (liquid feed system), a head tank 70 is disposed that has a function of feeding ink to the recording head 1 and receiving bubbles to discharge them to the outside. The head tank 70 includes a first ink chamber 71 and a second ink chamber 72 with an atmosphere opening 73 at the top. A pump P2 can send ink from the second ink chamber 72 to the first ink chamber 71. An ink cartridge 76 is connected to the second ink chamber 72 such that ink that has been filtered by a filter 75 can be supplied to the second ink chamber 72 of the head tank 70 by a pump P1.

At the bottom of the second ink chamber 72 of the head tank 70 is an ink port, which is connected to the discharge port 13 of the liquid feeding member 10 of the recording head 1 through a normally-opened valve V2. The volume of the ink in the second ink chamber 72 is managed by a liquid level sensor 74 such that a height difference Sh between the ink level and the recording head 1 is maintained at a constant value (10-150 mm).

During a usual image forming operation, the pumps P1 and P2 are stopped and only the valve V2 is opened. The ink is supplied to the recording head 1 from the second ink chamber 72 through the discharge port 13. The ink level in the second ink chamber 72 drops below the predetermined position due to use of the ink, which drop is detected by the liquid level sensor 74. In response, the valve V1 is opened and the pump P1 is activated to supply ink from the ink cartridge 76 to the second ink chamber 72. The supply is stopped according to a detection signal of the liquid level sensor 74.

Figure 41:
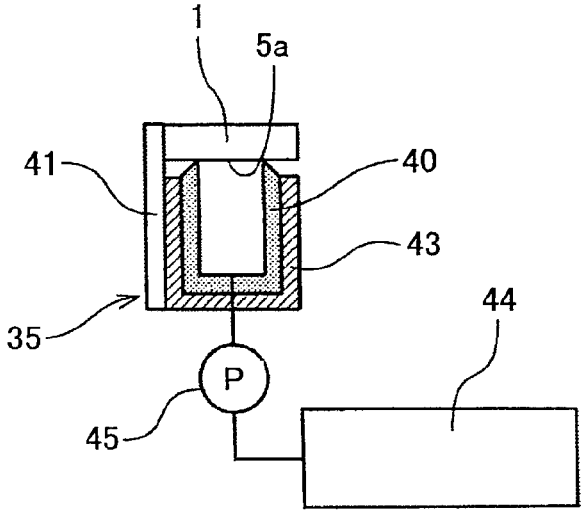
FIG. 41 is a diagram for illustrating a maintenance/recovery operation of the image forming apparatus.
Figure 42:
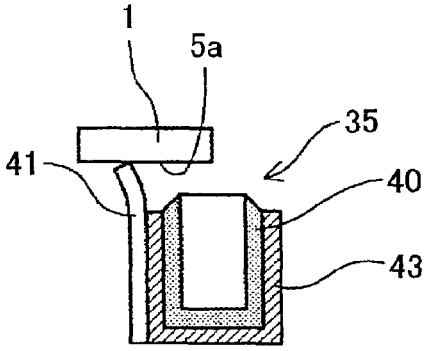
FIG. 42 is a diagram for illustrating a maintenance/recovery operation of the image forming apparatus.

In the case where the recording head 1 is clogged, a recovery operation for the recording head 1 is performed. The recording head 1 is moved up from the position shown in FIG. 38, and a maintenance unit 35 is horizontally moved (from the position shown in FIG. 38 to the right side in FIG. 38) to be located directly under the recording head 1. Then the recording head 1 is slightly moved down such that, as shown in FIG. 41, a nozzle face 5*a* with the nozzles 5 of the recording head 1 comes into tight contact with a cap 40 held by a holder 43 of the maintenance unit 35. Then, the valves V1 and V2 (FIG. 40) are closed, and only the pump P2 is activated for a predetermined time period.

Thus the ink in the first ink chamber 71 is pressurized to flow into the recording head 1. Since the valve V2 is closed, the ink is discharged from the nozzles 5 of the recording head 1. Together with the ink, bubbles and extraneous matter clogging the recording head 1 are removed. After stopping the pump P2, the recording head 1 is moved up to be out of contact with the cap 40. Then the maintenance unit 35 is horizontally moved (from the position shown in FIG. 39 to the right side in FIG. 39) to wipe the nozzle face 5*a* of the recording head 1 using a wiper blade 41 as shown in FIG. 41. After meniscuses are formed in the nozzles 5 due to wiping, the valve V2 is opened so that the recording head 1 is maintained at a negative pressure to have the height difference Sh.

The ink discharged from the recording head 1 is collected in the cap 40 and suctioned by a pump 45 to be discharged into a waste tank 44. In an alternative embodiment, the ink in the cap 40 may be filtered using a filer and transported not to the waste tank 44 but back to the second ink chamber 72 of the head tank 70 so as to be reused.

After that, the recording head 1 and the maintenance unit 35 are moved vertically and horizontally, respectively, back to the positions shown in FIG. 38 to perform a recording operation. Alternatively, the recording head 1 and the maintenance unit 35 may stay in the positions shown in FIG. 39 to wait for a recording instruction. This recovery operation removes clogging to maintain the recording head 1 in good condition.

In the liquid feed system shown in FIG. 40, flow passages 80 and 81 connecting the head tank 70 and the liquid feeding member 10 are usually resin tubes, and bubbles enter inside over time due to the air permeability of the tube material. If a large number of bubbles are accumulated inside the liquid feeding member 10, the bubbles are carried by the flow of ink into the recording head 1 during a recording operation, resulting in a failure of ink droplet ejection. Referring to FIG. 40, in order to remove the bubbles from the liquid feeding member 10, the valve V2 is opened and only the pump P2 is activated to feed the ink from the second ink chamber 72 to the first ink chamber 71. Then the ink flows from the first ink chamber 71 into the feed port 12 of the liquid feeding member 10, is discharged from the discharge port 13 together with the bubbles, and flows back to the second ink chamber 72. In the second ink chamber 72, the bubbles in the ink move up to be discharged from the atmosphere opening 73.

To evaluate the performance of discharging bubbles of the liquid feeding member 10 of this image forming apparatus, bubbles were introduced into the tube through a three-way valve upstream of the liquid feeding member 10, and then introduced into the liquid feeding member 10 by the pump P2 while observing the inside of the liquid feeding member 10. The pump V2 was stopped to wait for the flow inside the liquid feeding member 10 to stop. Then, the pump V2 was restarted to circulate the ink at a flow rate of 60 ml/min. As a result, although there were small bubbles remaining at the upper corners of the liquid feeding member 10, most bubbles could be discharged. Further, no failure such as leakage of ink from the nozzles 5 was observed at the nozzle face of the recording head 1, and image formation could be performed properly without ejection failures.

Then, after introducing bubbles into the liquid feeding chamber 10 in the same way, the ink was circulated at 90 ml/min. As a result, discharge of the bubbles could be performed properly without bubbles at the upper corners where the bubbles remained under the above-described condition. However, a leakage of ink from the nozzles 5 was found.

Then, a bubble discharge experiment was carried out in the same manner using a liquid feeding member 10 with a feed port 12 and a discharge port 13 disposed vertically upward (Yh1: 1 mm) as in the seventh embodiment (FIGS. 24 and 25). As a result, discharge of bubbles could be performed properly without failures of ink leakages from the nozzles 5 even in the case where the ink was circulated at 90 ml/min.

Another experiment was performed on a liquid feeding member 10 that includes a main passage 11*a* having chamfered upper corners and an upward pointing triangular cross-sectional shape (Wa: 5 mm, Wb: 2.4 mm, Ha: 6 mm, Hb, 4 mm, Yh: 3 mm, Yc, 1.5 mm, and Wc: 1 mm) as shown in the sixth embodiment (FIG. 23). As a result, discharge of bubbles could be performed properly without failures of ink leakages from the nozzles 5 even in the case where the ink was circulated at 60 ml/min.

In a comparative experiment, a bubble discharge experiment was performed on a liquid feeding member (Wc: 5 mm, Hc: 6 mm, and Yh: 3 mm) as shown in the comparative example 1 (FIGS. 6 and 7) that includes a liquid circulation path 11 without a narrow communication passage 11*b*. As a result, although bubbles could be discharged by circulating the ink at a flow rate of 60 ml/min, ink leakage from nozzles 5 was found. Even by reducing the circulation flow rate or shifting the positions of a feed port 12 and a discharge port 13 upward, it was impossible to discharge bubbles without leakage of ink from nozzles 5.

In another comparative experiment, bubble discharge performance of a liquid feeding member including a liquid circulation path 11 with an increased height (Wd: 5 mm, Hd: 12 mm, and Yh: 3 mm) as in the comparative example 2 (FIGS. 8 and 9) was evaluated in the same manner. As a result, the flow rate required to achieve a satisfactory bubble discharge performance was 120 ml/min or greater. Further, in the case where the ink level in the second ink chamber 72 of the head tank 70 is low during the bubble discharge operation, although not often, some nozzles 5 could not perform ejection due to broken meniscuses.

In the case where such a liquid circulation path 11 with an increased height is required, the structure as illustrated in the ninth embodiment (FIGS. 31 and 32) is effective. In the liquid feeding member 10 of the ninth embodiment, the liquid buffer passage 11*c* having large space defines a portion of the liquid circulation path 11 closest to the head 1. On the liquid buffer passage 11*c* are disposed the narrow communication passage 11*b* and the main passage 11*a*. Bubbles that have been generated in the head 1 and flowed into the common liquid chamber 7 move up to the ceiling 11*d* of the main passage 11*a* due to buoyancy. Because the upper surfaces of the liquid buffer passage 11*c* are slopes, the bubbles can easily move out of the liquid buffer passage 11*c*. Further, because the ceiling 11*d* of the main passage 11*a* has an upwardly-curved convex cross-sectional shape, bubbles are collected at the top and can easily be discharged.

With this configuration, since the position of the circulating current is spaced apart from the recording head 1, influence of the circulating current on the recording head 1 can be reduced. Further, the main passage 11*a* can be narrowed to have a minimum cross-sectional area that can achieve the flow rate required for recording so as to increase the speed of the circulating current, thereby improving the bubble discharge performance. Further, this configuration is effective to reduce interference by the ejection pressure of the recording head 1 because the ejection pressure of the recording head 1 is attenuated by a large-volume buffer portion (liquid buffer passage 11*c*) defining the portion close to the recording head 1. In this regard, this configuration is especially effective for piezo type ejection heads that eject liquid droplets of different sizes from one nozzle.

A liquid feeding member as shown in FIGS. 31 and 32 with a size of Wia: 5 mm, Wic: 2.4 mm, Hia: 4 mm, Hib: 4 mm, Hic: 6 mm, and Yh: 2 mm was prepared and its bubble discharge performance was evaluated in the same manner as described above. As a result, it was possible to discharge all the bubbles at a flow rate of 60 ml/min without breaking meniscuses in the nozzles 5. Further, it was possible to perform image formation while performing an ink circulation operation for discharging bubbles.

In the above embodiments, because no filter is provided in the liquid feeding member 10, even when bubbles were generated in the recording head 1 as a result of repeated recording operations, the bubbles moved up to the main passage 11*a* through the narrow communication passage 11*b* and were discharged by the circulating ink. By contrast, in the case of a liquid feeding member 10 in which a filter 14 is disposed between a narrow communication passage 11*b* and a main passage 11*a* as shown in FIG. 30, bubbles that were generated in a recording head 1 as a result of repeated recording operations could not pass through the filter 14 and accumulated in the narrow communication passage 11*b*. The recovery operation described above was the only way to discharge the bubbles.

As described above, in the embodiments of the present invention, a portion of the liquid feeding member communicating with a liquid ejection head 1 is made narrow to prevent adverse effects of the circulating current on meniscuses of the nozzles. Therefore, it is possible to have a circulating current during a recording operation. Since a recording operation can be performed while circulating ink, it is possible to prevent accumulation of bubbles. That is, there is no need to suspend recording to perform a bubble discharge operation, which results in increasing recording throughput.

Next, an image forming apparatus of a fourteenth embodiment of the present invention is described below.

In this embodiment, the liquid feeding member of the fourth embodiment (FIGS. 17 through 19) is used. A component with a path (liquid circulation path 11) having a cross-sectional shape shown in FIGS. 18 and 19 is manufactured by cutting and pasting transparent polycarbonate resin and is bonded to the liquid ejection head 1. With reference to FIG. 19, the inner dimensions of this liquid feeding member 10 are, for example, Wa: 7 mm, Ha: 6 mm, Hb: 4 mm, Yb: 1.5 mm, and Ls: 5 mm. As ribs 16, three ribs 16*a* each of thickness 0.4 mm are disposed at 0.9 mm pitch at each longitudinal end of the opening to the common liquid chamber 7, and two ribs 16*b* each of thickness 0.5 mm are disposed at 0.9 mm pitch at each lateral side of the opening.

A feed port 12 and a discharge port 13 are disposed at the opposing longitudinal ends of the liquid feeding member 10. As in the case of the image forming apparatus of the thirteenth embodiment, the liquid feeding member 10 is connected to an ink feed system (in a liquid feed path) as shown in FIG. 40. The performance of discharging bubbles of the liquid feeding member 10 of this embodiment was evaluated. As a result, bubbles that had been intentionally introduced into the liquid feeding member 10 could be properly discharged by circulating the ink at the flow rate of a 70 ml/min. Further, no failure such as leakage of ink from nozzles 5 was observed, and image formation could be performed properly without ejection failures.

Figure 43:
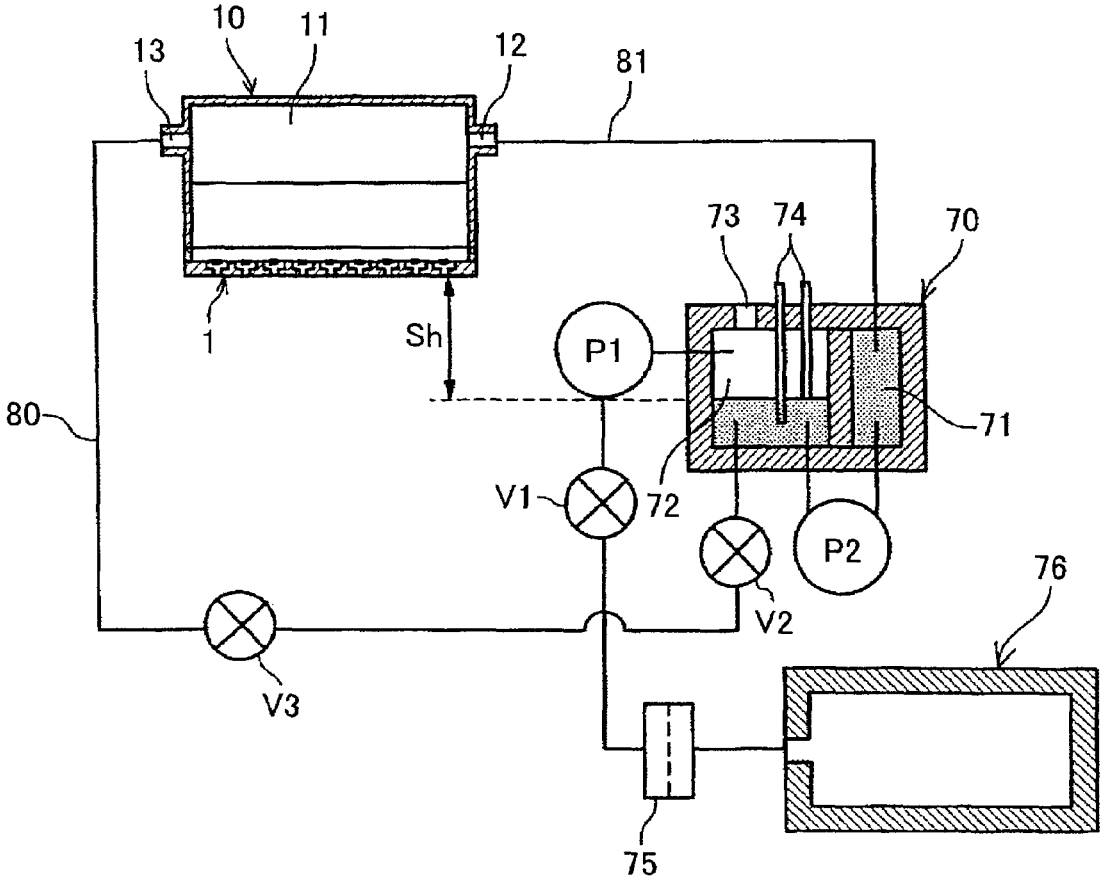
FIG. 43 is a schematic diagram for illustrating a liquid feed path of an image forming apparatus of a fifteenth embodiment of the present invention.

Next, an image forming apparatus of a fifteenth embodiment of the present invention is described below with reference also to FIG. 43.

In this embodiment, the liquid feeding member 10 of the image forming apparatus of the fourteenth embodiment is connected to an ink feed system in a liquid feed path shown in FIG. 41. This ink feed system is different from the ink feed system of FIG. 40 in that a flow regulating valve V3 is disposed downstream of a discharge port 13 of the liquid feeding member 10.

The provision of the flow regulator V3 downstream of the discharge port 13 allows adjustment of the flow rate (Qc) of the ink discharged from the discharge port 13. The ink can be forced into the liquid ejection head 1 from the liquid circulation path 11 by reducing the flow rate Qc. Thus, it is possible to discharge bubbles from liquid circulation path and discharge bubbles from the liquid ejection head 1 at the same time.

Next, a specific example of the liquid feeding members 10 of the eleventh embodiment shown in FIG. 35 and the twelfth embodiment shown in FIGS. 36 and 37 are described below.

Although the inner dimensions of the liquid feeding member 10 of this specific example are the same as the liquid feeding member 10 of the image forming apparatus of the thirteenth embodiment, the liquid feeding member 10 is made of two different materials. More specifically, a main passage part 10*a* including a main passage 11*a* is made of polycarbonate resin, while a narrow passage part 10*b* including a narrow communication passage 11*b* is made of SUS. A liquid ejection head 1 used herein is a thermal type one used in the image forming apparatus of the thirteenth embodiment.

In the case of a thermal type, because the temperature of a liquid ejection head 1 increases significantly, it is common to lower the drive frequency of the liquid ejection head 1, to temporarily suspend recording, or to reduce the number of nozzles to be driven. In the case of this liquid feeding member 10, since the narrow communication passage part 10*b* at the side of the liquid ejection head 1 is made of a material having high thermal conductivity, if disposed in direct contact with the liquid ejection head 1, the narrow communication passage part 10*b* can transfer heat directly from the liquid ejection head 1 and prevent a temperature rise of the liquid ejection head 1.

Further, since the narrow portion of the flow path is made of the high-thermal conductive material, it is possible to efficiently transfer heat from the ink and maintain stable image forming performance even when performing recording operations continuously.

In the case where plural fins 15*a* and 15*b* are provided at both the inner and outer sides of the narrow communication passage part 10*b* of the liquid feeding member 10 as in the twelfth embodiment (FIGS. 36 and 37), heat transfer efficiency is further improved, allowing printing images of a high print quality at high speed. Further, in this liquid feeding member 10, because the vertical direction of the fins 15*a* inside the flow path defines the longitudinal direction thereof, it is possible to improve the heat transfer efficiency without interrupting bubbles 51 moving up from the liquid ejection head 1. Moreover, because the fins 15*a* inside the flow path are orthogonal to the flow direction of the circulating current and because the fins 15*a* are provided also at the bottom of the main passage 11*a*, it is possible to effectively prevent flow due to the circulating current in the narrow communication passage 11*b* and reduce meniscuses broken due to the circulating current.

Next, a specific example of the liquid feeding member 10 of the eighth embodiment shown in FIG. 28 is described below.

In this liquid feeding member 10, as described above, a feed port 12 is disposed at the longitudinal center portion of the liquid feeding member 10 and discharge ports 13 are disposed at the longitudinal ends. A flow guide member 18 is disposed under the feed port 12 inside the liquid circulation path 11. The flow guide member 18 has a curved upper surface to smoothly divide the flow of supplied ink into the flows toward the two discharge ports 13 in the different directions, and has a sloped lower (bottom) surface 19 to prevent bubbles that have moved up from the liquid ejection head 1 from remaining thereon.

This liquid feeding member 10 was connected to the ink feed system shown in FIG. 40 or FIG. 30 and the bubble discharge performance was evaluated at the same circulation flow rate. As a result, it was possible to discharge bubbles in less time than in the case of the image forming apparatus of the thirteenth embodiment. In a comparative experiment, a liquid feeding member without a flow guide member as shown in FIG. 29 was prepared and evaluated in the same manner. As a result, a small amount of bubbles tended to remain at the regions Q of FIG. 29. The meniscuses in nozzles 5 at the center tended to be broken.

Figure 44:
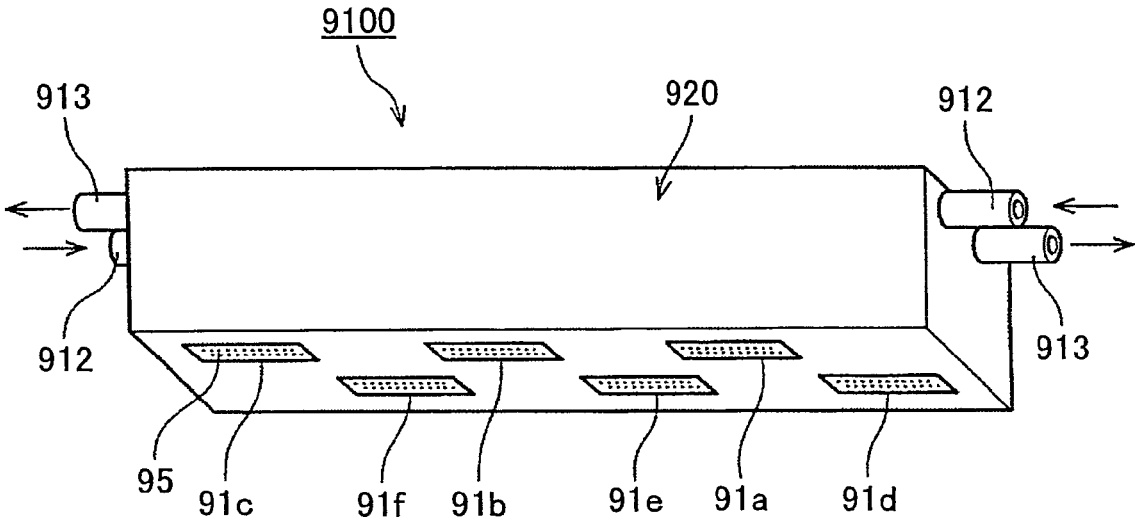
FIG. 44 is a perspective view schematically showing a head unit of a sixteenth embodiment of the present invention including a liquid feeding member for a liquid ejection head.
Figure 45:
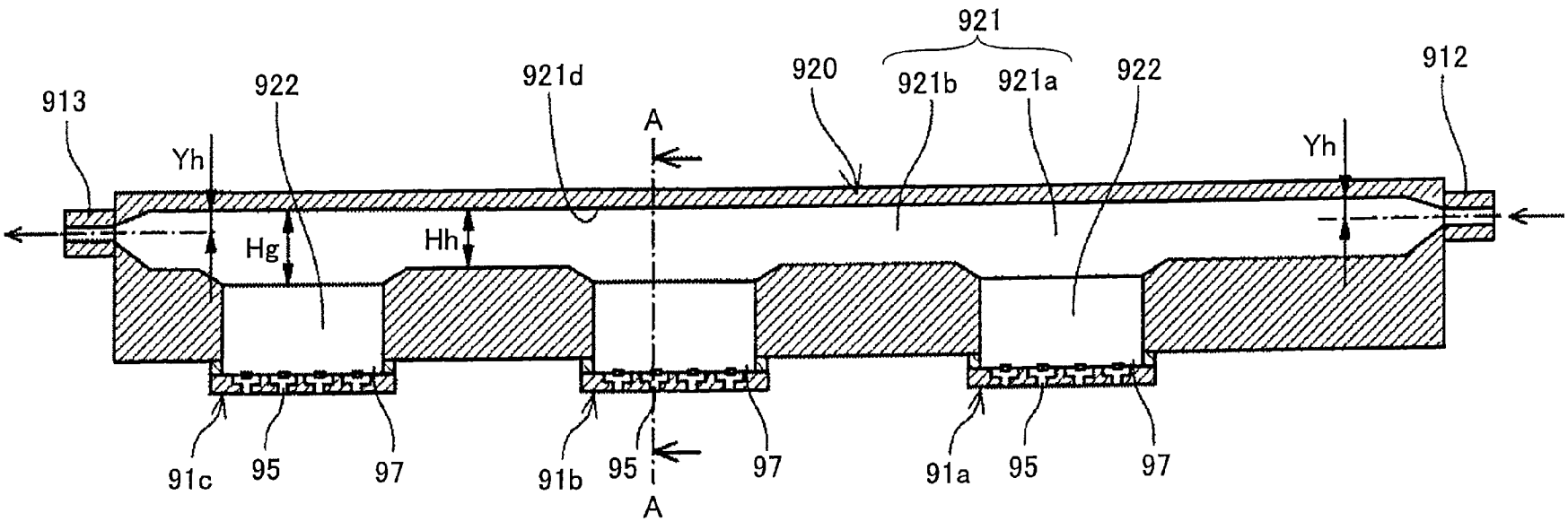
FIG. 45 is a longitudinal cut-away view showing the head unit.
Figure 46:
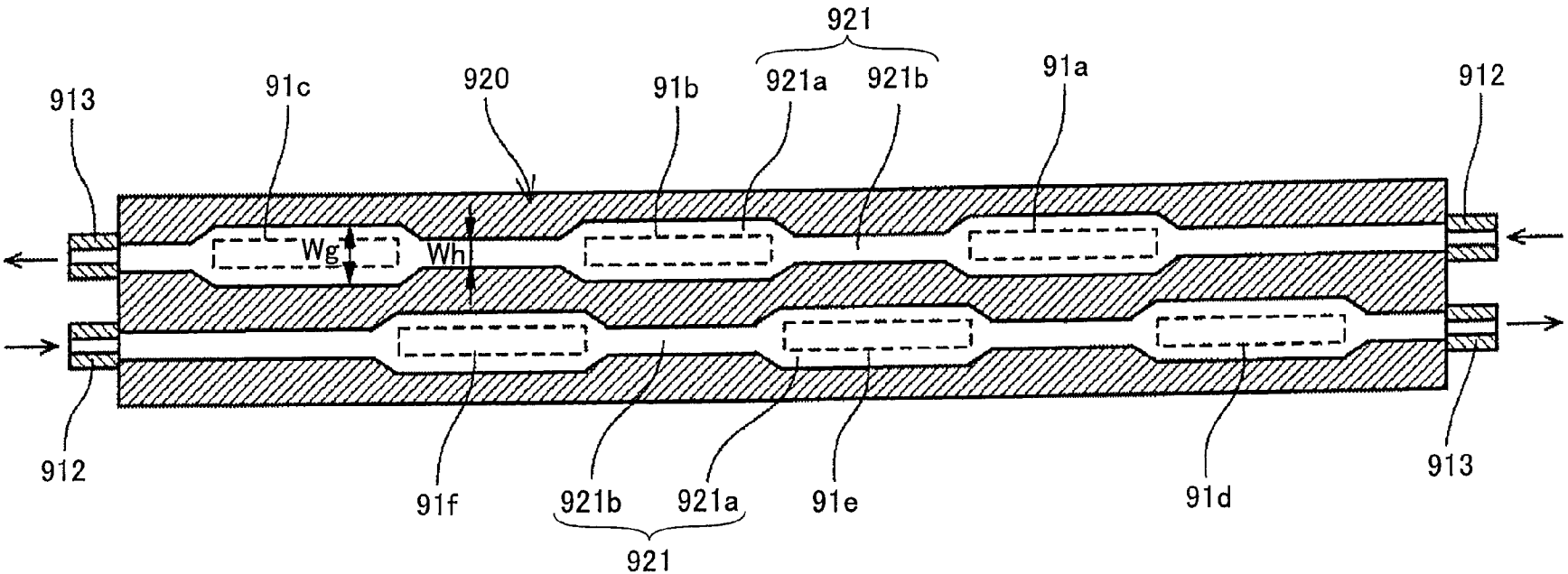
FIG. 46 is a cross-sectional view schematically showing the head unit taken along line B-B of FIG. 47.
Figure 47:
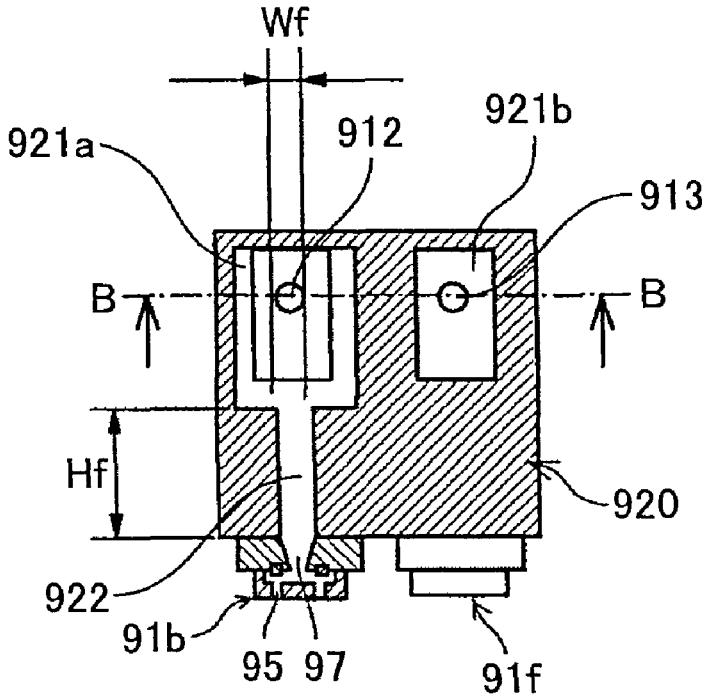
FIG. 47 is an enlarged cross-sectional view of the head unit taken along line A-A of FIG. 45.
Figure 48:
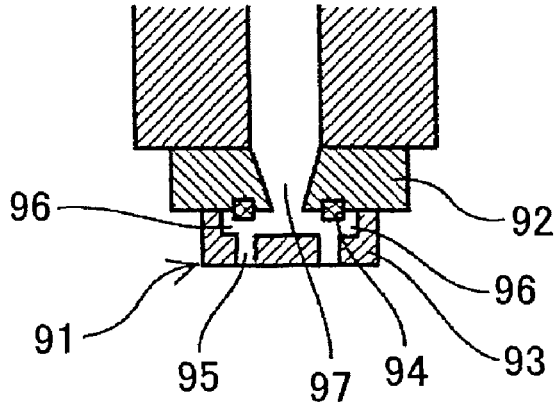
FIG. 48 is an enlarged transverse cut-away view schematically showing the liquid ejection head.

A head unit 9100 of a sixteenth embodiment of the present invention including a liquid feeding member 920 for a liquid ejection head 91 is described below with reference to FIGS. 44 through 48. FIG. 44 is a perspective view showing the integrated head unit 9100 including the liquid ejection head 91 and the liquid feeding member 920. FIG. 45 is a longitudinal cut-away view showing the head unit 9100. FIG. 46 is a cross-sectional view schematically showing the head unit 9100 taken along line B-B of FIG. 47. FIG. 47 is a cross-sectional view of the head unit 9100 taken along line A-A of FIG. 45. FIG. 48 is an enlarged transverse cut-away view of the liquid ejection head 91. In FIG. 46 and certain other drawings, the liquid ejection head 91 is shown by the broken line for explanation purposes.

The head unit 9100 is a long head such as a line type head that includes, as an integrated unit, plural short liquid ejection heads 91 (91*a*-91*f*) (in this example, the number of the liquid ejection heads 91 is six, but is not limited thereto). The liquid ejection heads 91 are elongated in the longitudinal direction of the head unit 9100 and are arranged longitudially offset from one another in a direction orthogonal to the longitudinal direction, i.e., are disposed in a staggered arrangement.

Each liquid ejection head 91 is a thermal type and includes a heating element substrate 92 and a flow passage substrate 93. The flow passage substrate 93 is provided with plural nozzles 95 for ejecting liquid droplets and individual liquid chambers 96 communicating with the corresponding nozzles 95. The heating element substrate 92 is provided with heating elements 94 corresponding to the individual liquid chambers 96. A power supply unit (not shown) such as an FPC is connected to the heating element substrate 92. When a pulse voltage is applied to the heating elements 94 from the power supply unit, the heating elements 94 are driven to cause film boiling of the liquid in the individual liquid chambers 96, thereby ejecting droplets of the liquid from the nozzles 95. In this embodiment, with reference to FIGS. 47 and 48, two nozzle arrays are formed, each including plural nozzles 95 aligned in the longitudinal direction of the liquid ejection head 91. Referring to FIGS. 45 through 47, the individual liquid chambers 96 corresponding to the nozzles 95 receive liquid from a common liquid chamber 97 disposed in the center of the heating element substrate 92.

As shown in FIGS. 45 and 46, the liquid feeding member 920 is connected to the opening forming the common liquid chamber 97 of the heating element substrate 92 of the liquid ejection head 91. Although the liquid feeding member 920 is directly connected to the liquid ejection heads 91 in this embodiment, a component such as a spacer plate may be disposed between them.

The liquid feeding member 920 includes two independent liquid passages (liquid circulation paths), namely, main passages 921, 921, through which the liquid flows in the longitudinal direction. One of the main passages (liquid passage) 921 corresponds to the array of the liquid ejection heads 91*a*, 91*b*, and 91*c*, and the other one of the main passages (liquid passage) 921 corresponds to the array of the liquid ejection heads 91*d*, 91*e*, and 91*f*. A feed port 912 through which the liquid is supplied to the liquid passage 921 and a discharge port 913 through which the liquid is discharged from the liquid passage 921 are disposed at the opposing longitudinal ends of each liquid passage 921.

As will be described below, the liquid feeding member 920 is disposed in a liquid feed path (not shown) in which the liquid is made to circulate to flow through each main passage 921 from the feed port 912 toward the discharge port 913. In FIG. 45 and certain other figures, the arrow pointing to the feed port 912 and the arrow pointing outward from the discharge port 913 indicate the direction in which the liquid is introduced and the direction in which the liquid is discharged, respectively.

Between each common liquid chamber 97 and the corresponding main passage 921 are provided narrow communication passages 922 each having a relatively smaller cross-sectional opening area (a small cross-sectional area) than the main passage 921. Each narrow communication passage 922 defines a communication opening for liquid to the common liquid chamber 97 of the corresponding liquid ejection head 91. The term "cross-sectional opening area" as used herein indicates the opening area of a cross section, such as that shown in the cut-away side view of FIG. 46, in a direction (transverse direction of the liquid feeding member 920) orthogonal to the longitudinal direction of the liquid feeding member 920 (the direction in which the nozzles 95 of each liquid ejection head 91 are aligned, the direction of generating the circulating current).

That is, to reach the liquid ejection head 91, the liquid flows from the feed port 912 into the main passage 921, passes through the narrow communication passage 922, and is supplied to the common liquid chamber 97. If bubbles are introduced from upstream of the liquid ejection head 91 or upstream of the feed port 912 into the liquid feeding member 920, the bubbles accumulate at the top (on a ceiling 921*d*) of the main passage 921 due to buoyancy. To prevent such accumulation of bubbles, a flow from the feed port 912 toward the discharge port 913 is generated in the main passage 921, thereby discharging the bubbles from the discharge port 913. As shown in FIG. 47, each narrow communication passage 922 communicating with the liquid ejection heads 91 has a smaller width than the main passage 921, thereby preventing the same flow as the flow generated in the main passage 921 from being generated in the narrow communication passage 922. Therefore, it is possible to prevent the circulating current for discharging bubbles from adversely affecting the liquid ejection heads 91.

Each main passage 921 has a greater cross-sectional area at portions 921*a* over the liquid ejection heads 91 than at portions 921*b* between the adjacent liquid ejection heads 91. In other words, each main passage 921 serving as a liquid passage has a greater cross-sectional opening area at regions (common-liquid-chamber-connected-portions 921*a*) connected to the common liquid chambers 97 than at regions (inter-common-liquid-chamber-portions 921*b*) between the adjacent common liquid chambers 97. More specifically, a height Hg and a width Wg of each common-liquid-chamber-connected-portion 921*a* are greater than a height Hh and a width Wh of each inter-common-liquid-chamber-portion 921*b*, respectively (Hg>Hh, Wg>Wh).

In the main passage 921 having such a configuration, the flow speed of the circulating current is relatively low near the liquid ejection heads 91, resulting in preventing meniscuses of the nozzles 95 of the liquid ejection heads 91 from being broken. Further, the flow speed of the circulating current is relatively high between the liquid ejection heads 91, resulting in enhancing the performance of discharging bubbles. In this embodiment, the main passage 921 has both a varying height and a varying width such that the common-liquid-chamber-connected-portions 921*a* and the inter-common-liquid-chamber-portions 921*b* have different cross-sectional opening areas. However, even in the case where the main passage 921 has either one of a varying height and a varying width, the same advantage is obtained.

Further, in this embodiment, the liquid in the main passage 921 corresponding to the liquid ejection heads 91*a*, 91*b* and 91*c* and the liquid in the main passage 921 corresponding to the liquid ejection heads 91*d*, 91*e* and 91*f* flow in opposite directions. However, they may flow in the same direction. The liquid feeding member 920 may comprise plural components. Especially, in the case where a component defining the narrow communication passages 922 is made of a material having high thermal conductivity, the liquid ejection heads 91 and the liquid therein can efficiently transfer heat, resulting in enhancing the stability of ejection of liquid droplets.

As described above, the liquid feeding member 920 includes the liquid passage 921 through which the liquid passes in a direction parallel to the direction in which the nozzles 95 of the liquid ejection head 91 are aligned. The feed port 912 through which the liquid is supplied to the liquid passage 921 and the discharge port 913 through which the liquid is discharged from the liquid passage 921 are disposed at the opposing longitudinal ends of the liquid passage 921. The liquid passage 921 has a greater cross-sectional opening area at regions connected to the common liquid chambers 97 than at regions between the adjacent common liquid chambers 97. With this configuration, it is possible to discharge, by the circulating current, the bubbles generated in the liquid ejection heads 91 or introduced into the liquid ejection heads 91 from upstream of the liquid feed path while preventing the meniscuses in the liquid ejection heads 91 from being broken.

Figure 49:
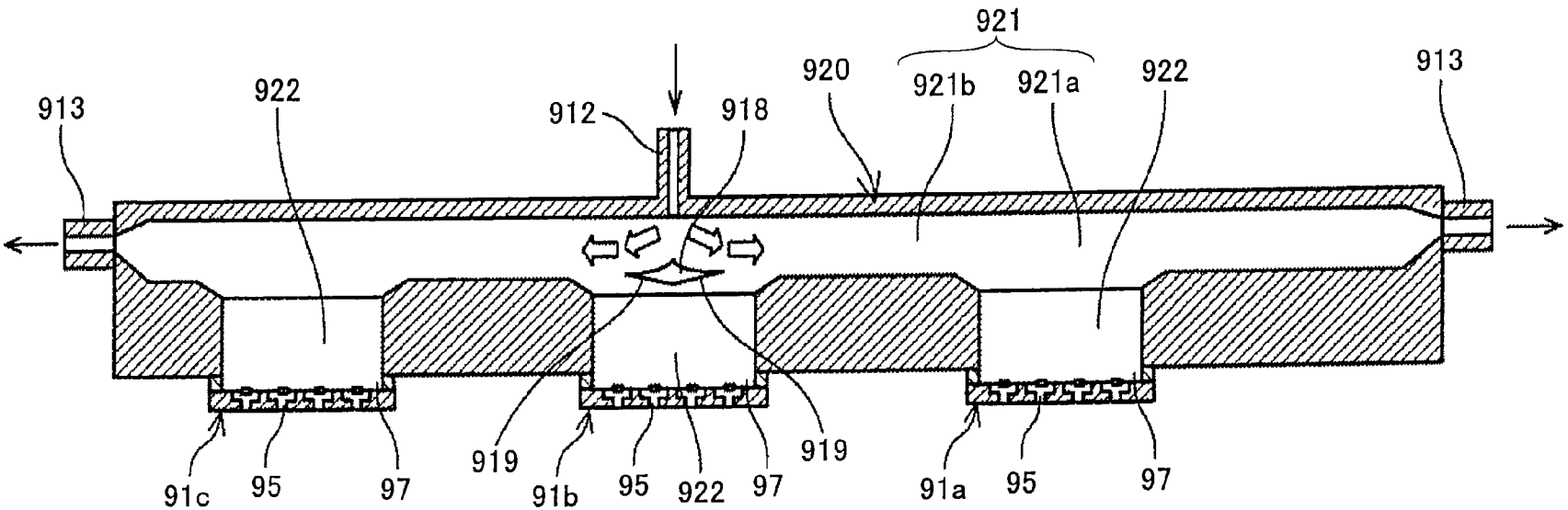
FIG. 49 is a longitudinal cut-away view showing a head unit of a seventeenth embodiment of the present invention.

A head unit 9100 of a seventeenth embodiment of the present invention is described below with reference to FIG. 49. FIG. 49 is a longitudinal cut-away view showing a head unit according to this embodiment.

In this embodiment, a feed port 912 is disposed at a substantial center of each main passage 921 of a liquid feeding member 920, and discharge ports 913, 913 are disposed at opposing longitudinal ends. With this configuration, even in the case where the length of the main passage 921 (the length of the liquid feeding member 920) is increased, the substantial length of the circulation path (main passage 921) can be reduced by the feed port 912 provided halfway along the main passage 921. Accordingly, time taken to discharge bubbles is reduced, resulting in enhancing the efficiency of discharging bubbles.

In this embodiment, because the feed port 912 is positioned over a liquid ejection head 91, a flow guide member 918 for guiding the flow of the liquid from the feed port 912 toward the discharge ports 913, 913 is provided between the feed port 912 and a narrow communication passage 922 (a common liquid chamber 97 of the liquid ejection head 91). The surface of the flow guide member 918 opposing the common liquid chamber 97 forms a slope 919 so as not to entrap bubbles rising from the common liquid chamber 97.

With this configuration, the flow of the liquid introduced from the feed port 912 is smoothly curved in the longitudinal direction of the main passage 921 as indicated by the arrows. This prevents the liquid introduced from the feed port 912 at high flow rate from flowing directly toward the liquid ejection head 91, thereby preventing adverse effects on meniscuses of nozzles 95 of the liquid ejection heads 91.

Figure 50:
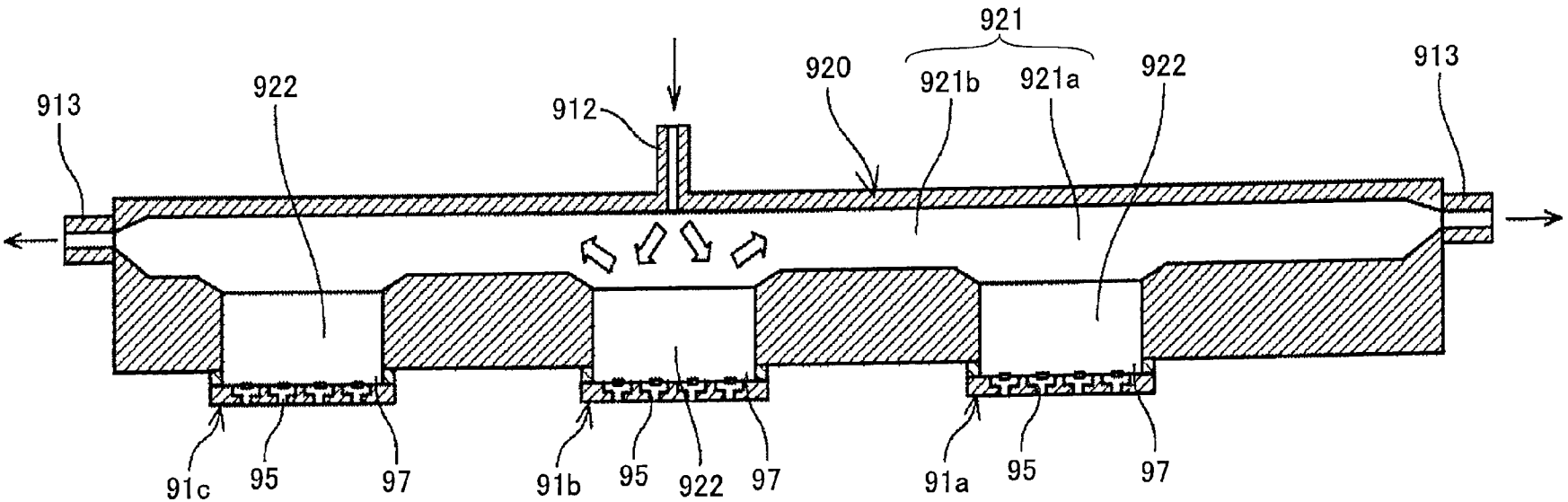
FIG. 50 is a longitudinal cut-away view showing a head unit of a comparative example 6.

In a comparative example 6 shown in FIG. 50, the flow guide member 918 is not provided. In this case, the liquid introduced from the feed port 912 flows directly toward the narrow communication passage 922 as indicated by the arrows and adversely affects the common liquid chamber 97 of the liquid ejection head 91. On the other hand, in this embodiment, the provision of the flow guide member 918 prevents such a problem.

As described above, the liquid feeding member 920 includes the liquid passage 921 through which the liquid passes in a direction parallel to the direction in which the nozzles 95 of the liquid ejection head 91 are aligned. The feed port 912 through which the liquid is supplied to the liquid passage 921 and the discharge ports 913, 913 through each of which the liquid is discharged from the liquid passage 921 are provided. The feed port 912 is disposed at a portion not at the longitudinal end of the liquid passage 921. The flow guide member 918 that guides the flow of the liquid is provided between a common liquid chamber 97 and the feed port 912 disposed at the portion not at the longitudinal end. The liquid passage 921 has a greater cross-sectional opening area at regions connected to the common liquid chambers 97 than at regions between the adjacent common liquid chambers 97. With this configuration, it is possible to discharge, by the circulating current, the bubbles introduced into the liquid ejection head 91 from upstream of the liquid feed path while preventing the meniscuses in the liquid ejection head 91 from being broken. Further, while preventing adverse effects on meniscuses of nozzles 95 of the liquid ejection heads 91, it is possible to enhance the efficiency of discharging bubbles due to the reduced substantial length of the liquid feeding member 920.

In this embodiment, the feed port 912 is disposed not at the longitudinal end of the liquid feeding member 920 but in a position facing the common liquid chamber 97. Alternatively, a discharge port 913 may be disposed in a position facing the common liquid chamber 97, and feed ports 912,912 may be disposed in the longitudinal ends. Further alternatively, both a feed port 912 and a discharge port 913 may be disposed in positions facing the common liquid chambers 97.

Figure 51:
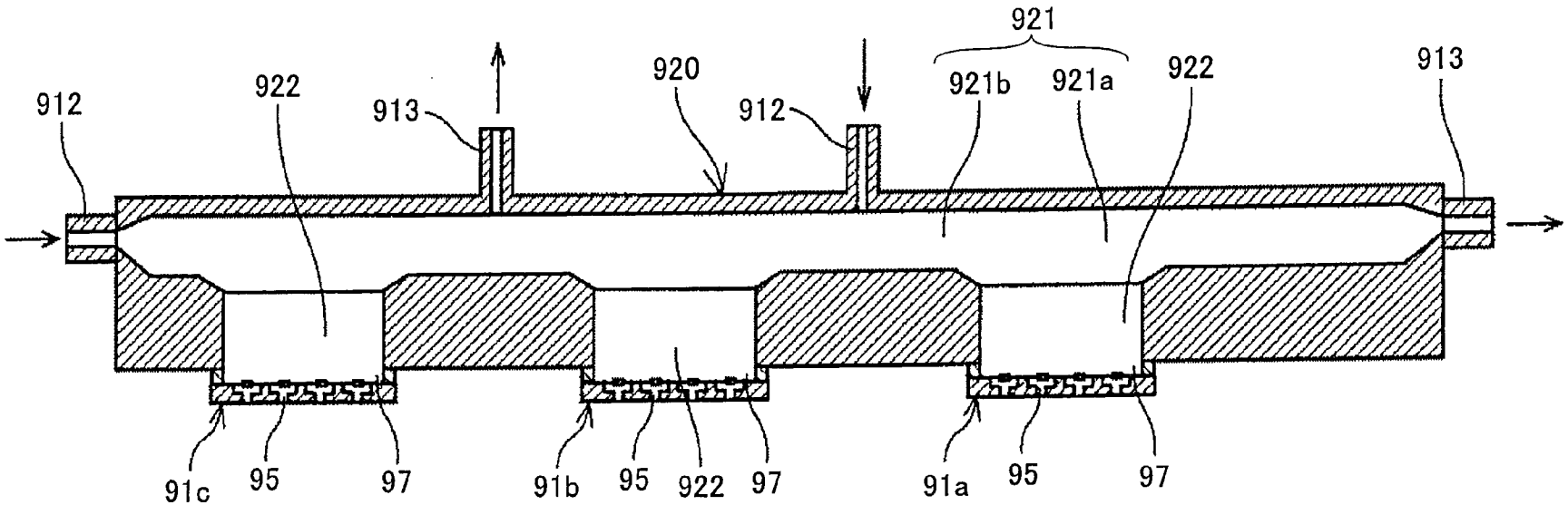
FIG. 51 is a longitudinal cut-away view showing a head unit of an eighteenth embodiment of the present invention.

An eighteenth embodiment of the present invention is described below with reference to FIG. 51. FIG. 51 is a longitudinal cut-away view showing a head unit according to this embodiment.

In this embodiment, a feed port 912 and a discharge port 913 are disposed not at the opposing longitudinal ends of the main passage 921 but in positions not facing the common liquid chambers 7 of the liquid ejection head 91 (i.e., positions facing inter-common-liquid-chamber-portions 921*b*). Further, another feed port 912 and another discharge port 913 are disposed at the opposing longitudinal ends. With this configuration, even in the case where the length of the main passage 921 (the length of the liquid feeding member 920) is increased, the provision of the feed port 912 and the discharge port 913 halfway along the main passage 921 can reduce the substantial length of the circulation path (main passage 921). Accordingly, time taken to discharge bubbles is reduced, resulting in enhancing the efficiency of discharging bubbles.

Because the feed port 912 and the discharge port 913 that are not at the opposing longitudinal ends of the main passage 921 are in positions facing the inter-common-liquid-chamber-portions 921*b* and spaced away from the liquid ejection heads 91, although the flow guide member 918 as shown in FIG. 17 is not provided, it is possible to prevent the flow of the liquid being introduced from the feed port 912 and the flow of the liquid being discharged from the discharge port 913 from adversely affecting meniscuses of the nozzles 95 of the liquid ejection head 91.

As described above, the liquid feeding member 920 includes the liquid passage 921 through which the liquid passes in a direction parallel to the direction in which the nozzles 95 of the liquid ejection head 91 are aligned. The liquid passage 921 is provided with the feed port 912 through which the liquid is supplied to the liquid passage 921 and the discharge port 913 through which the liquid is discharged from the liquid passage 921. At least either one of the feed port 912 and the discharge port 913 is disposed not at a longitudinal end of the liquid passage 921 but in a position facing one of regions between adjacent common liquid chambers 97. The liquid passage 921 has a greater cross-sectional opening area at regions connected to the common liquid chambers 97 than at the regions between the adjacent common liquid chambers 97. With this configuration, it is possible to discharge, by the circulating current, the bubbles introduced into the liquid ejection head 91 from upstream of the liquid feed path while preventing the meniscuses in the liquid ejection head 91 from being broken. Further, while preventing adverse effects on meniscuses of nozzles 95 of the liquid ejection heads 91, it is possible to enhance the efficiency of discharging bubbles due to the reduced substantial length of the liquid feeding member 920.

In this embodiment, both the feed port 912 and the discharge port 913 are disposed not at the opposing longitudinal ends but in positions facing the inter-common-liquid-chamber-portions 921*b*. Alternatively, either one of the feed port 912 and the discharge port 913 may be disposed not at the opposing longitudinal ends but in positions facing the inter-common-liquid-chamber-portion 921*b*.

Figure 52:
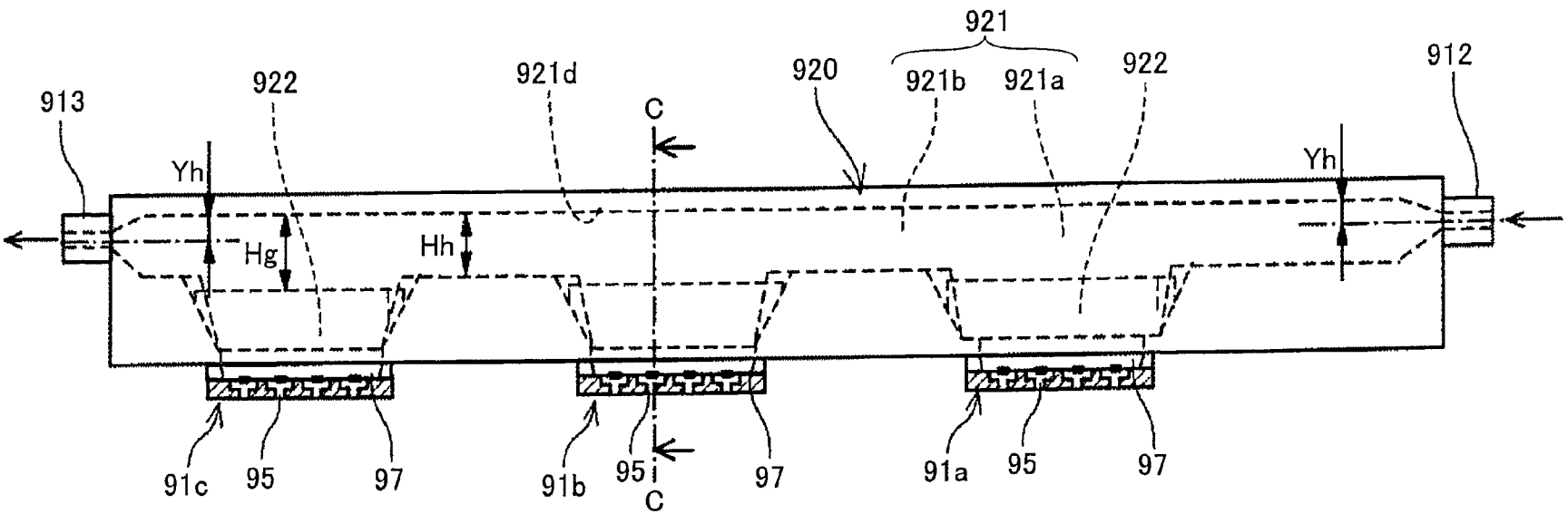
FIG. 52 is a longitudinal cut-away view schematically showing a head unit of a nineteenth embodiment of the present invention.
Figure 53:
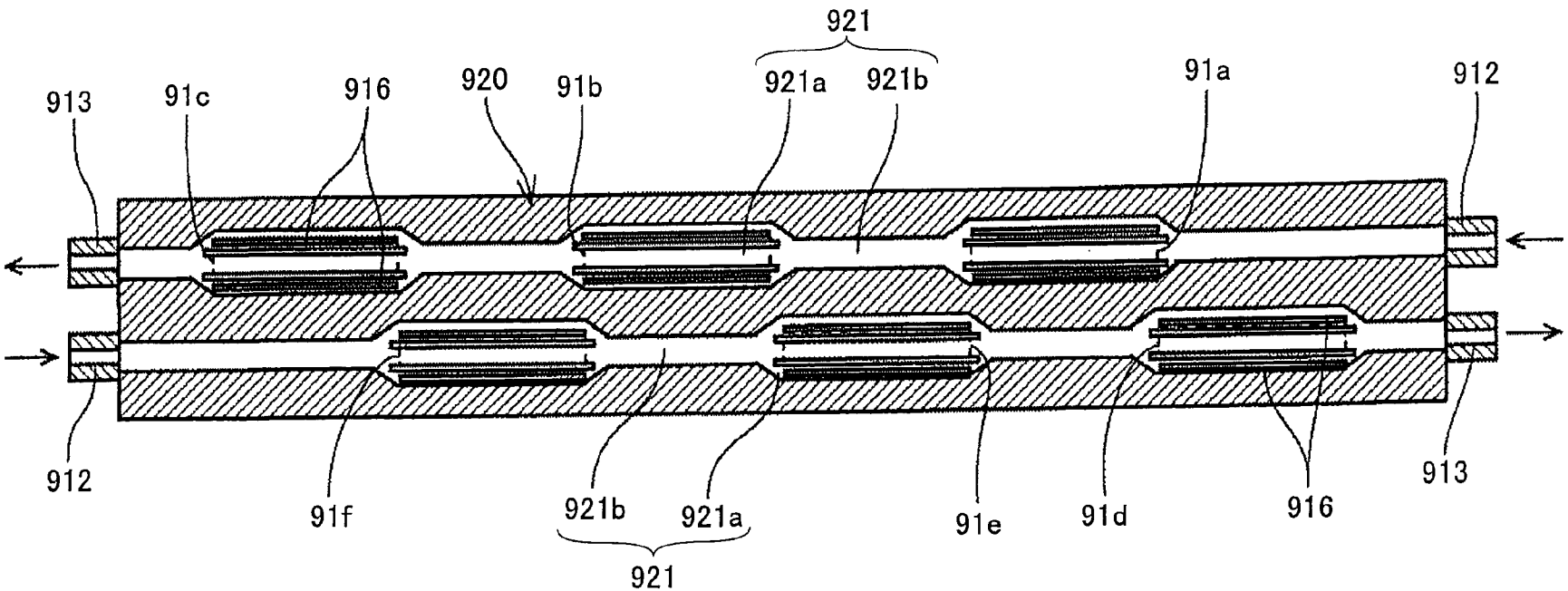
FIG. 53 is a cross-sectional view schematically showing the head unit taken along line D-D of FIG. 54.
Figure 54:
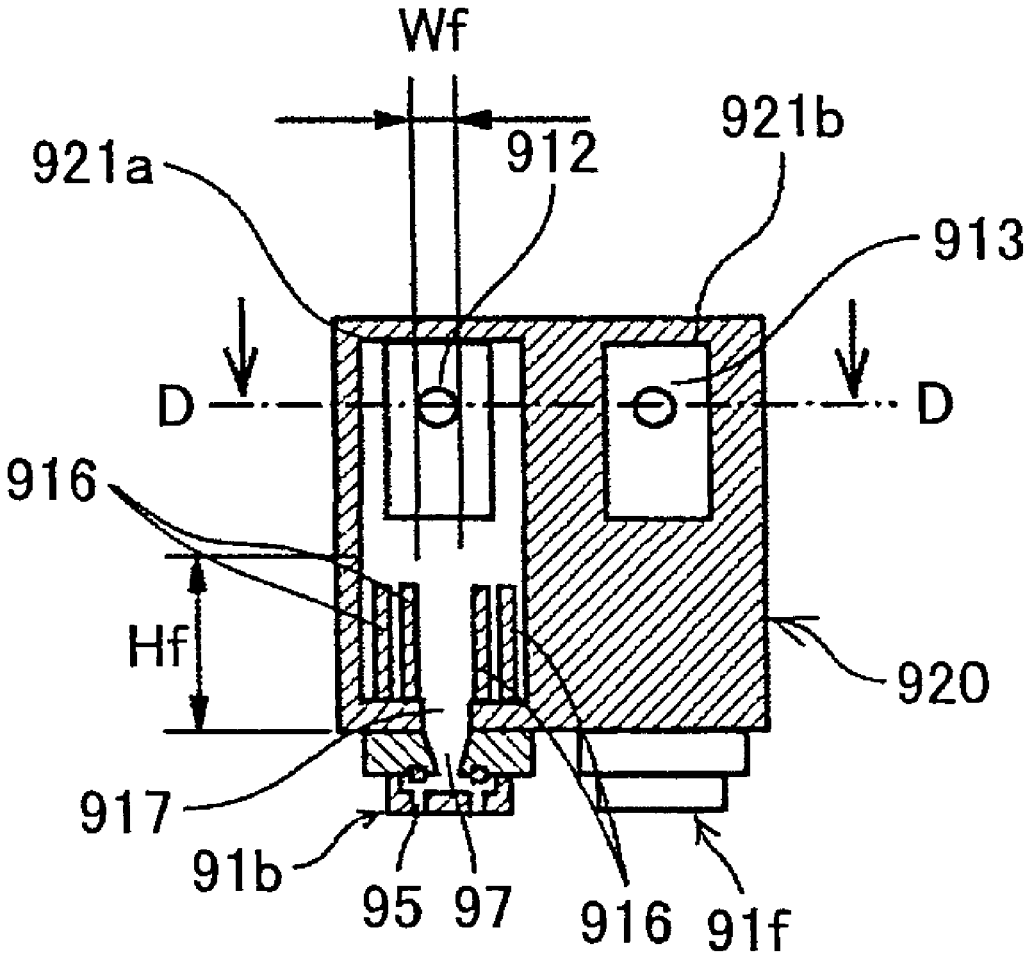
FIG. 54 is an enlarged cross-sectional view of the head unit taken along line C-C of FIG. 52.

A nineteenth embodiment of the present invention is described below with reference to FIGS. 52 through 54. FIG. 52 is a longitudinal cut-away view showing a head unit according to this embodiment. FIG. 53 is a cross-sectional view taken along line D-D of FIG. 54. FIG. 54 is a cross-sectional view of the head unit taken along line C-C of FIG. 52.

In this embodiment, unlike the forgoing embodiments, a liquid feeding member 920 does not include narrow communication passages 922. Instead, ribs 916 are formed around each communication opening 917 on a wall surface of the liquid feeding member 920 which wall surface faces common liquid chambers 97 of liquid ejection heads 91.

If bubbles are introduced from upstream of the liquid ejection heads 91 or upstream of the feed port 912 into the liquid feeding member 920, the bubbles accumulate at the top (on a ceiling 921*d*) of each main passage 921 due to buoyancy. To prevent such accumulation of bubbles, a flow from the feed port 912 toward the discharge port 913 is generated in the main passage 921, thereby discharging the bubbles from the discharge port 913.

Because the contact area is increased between the main passage 921 and the liquid at the common-liquid-chamber-connected-portions 921*a* of the main passage 921 at the side of liquid ejection heads 91, the liquid does not easily flow due to viscosity resistance of the liquid. As a result, similar to the sixteenth embodiment of the present invention, the liquid flows substantially only at the upper side of the main passage 921. Accordingly, the flow of the liquid at common-chamber-connected-portions 921*a* of the main passage 921 does not affect the flow of the liquid in the vicinity of the communication openings 917, so that the adverse effects of the circulating current, which discharges bubbles, on meniscuses of nozzles 95 of the liquid ejection heads 91 can be reduced. In this embodiment, the main surfaces of the ribs 916 are parallel to the direction of the circulating current. In an alternative embodiment, the main surfaces of the ribs 916 may be orthogonal to the direction of the circulating current.

In this embodiment, each main passage 921 has a greater cross-sectional area at portions 921*a* over the liquid ejection heads 91 than at portions 921*b* between the adjacent liquid ejection heads 91. In other words, each main passage 921 serving as a liquid passage has a greater cross-sectional opening area at regions (portions 921*a*) connected to the common liquid chambers 97 than at regions (regions 921*b*) between the adjacent common liquid chambers 97. With this configuration, the flow speed of the circulating current is relatively low near the liquid ejection heads 91, resulting in preventing meniscuses of the nozzles 95 of the liquid ejection heads 91 from being broken. Further, the flow speed of the circulating current is relatively high between the liquid ejection heads 91, resulting in enhancing the performance of discharging bubbles.

As described above, the liquid feeding member 920 includes the liquid passage 921 through which the liquid passes in a direction parallel to the direction in which the nozzles 95 of the liquid ejection head 91 are aligned. The feed port 912 through which the liquid is supplied to the liquid passage 921 and the discharge port 913 through which the liquid is discharged from the liquid passage 921 are disposed at the opposing longitudinal ends of the liquid passage 921. In the liquid passage 921, the rib 916 is formed around each communication opening 917 connected to the corresponding common liquid chamber 97. With this configuration, it is possible to discharge, by the circulating current, the bubbles generated in the liquid ejection heads 91 or introduced into the liquid ejection heads 91 from upstream of the liquid feed path while preventing the meniscuses in the liquid ejection heads 91 from being broken.

Figure 55:
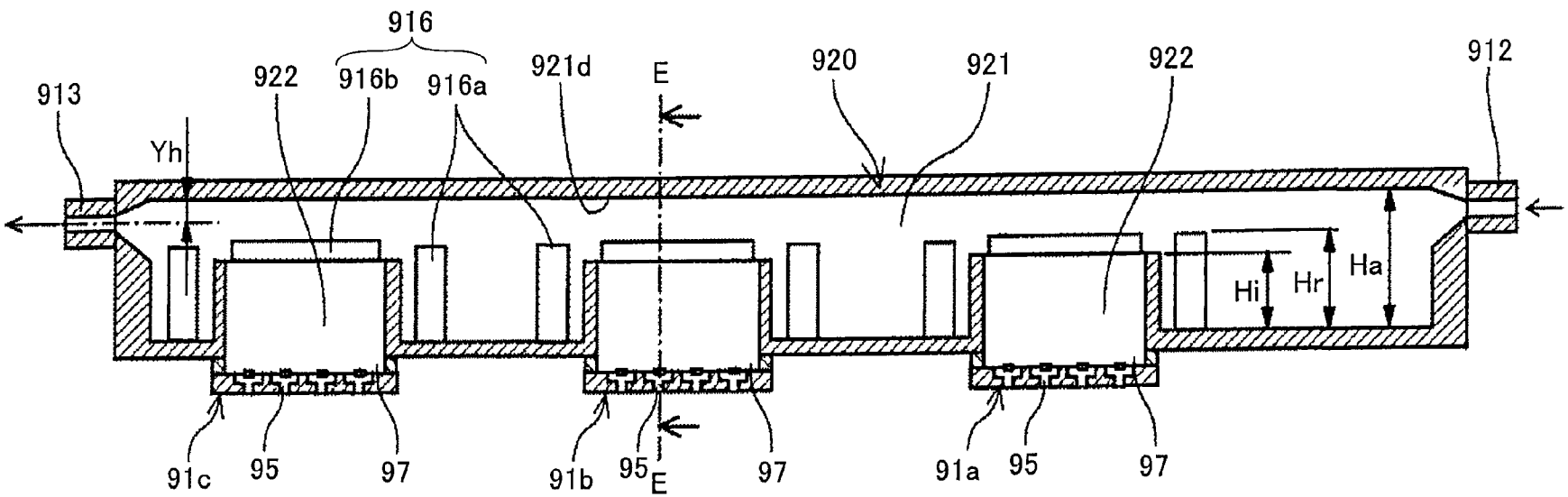
FIG. 55 is a longitudinal cut-away view schematically showing a head unit of a twentieth embodiment of the present invention.
Figure 56:
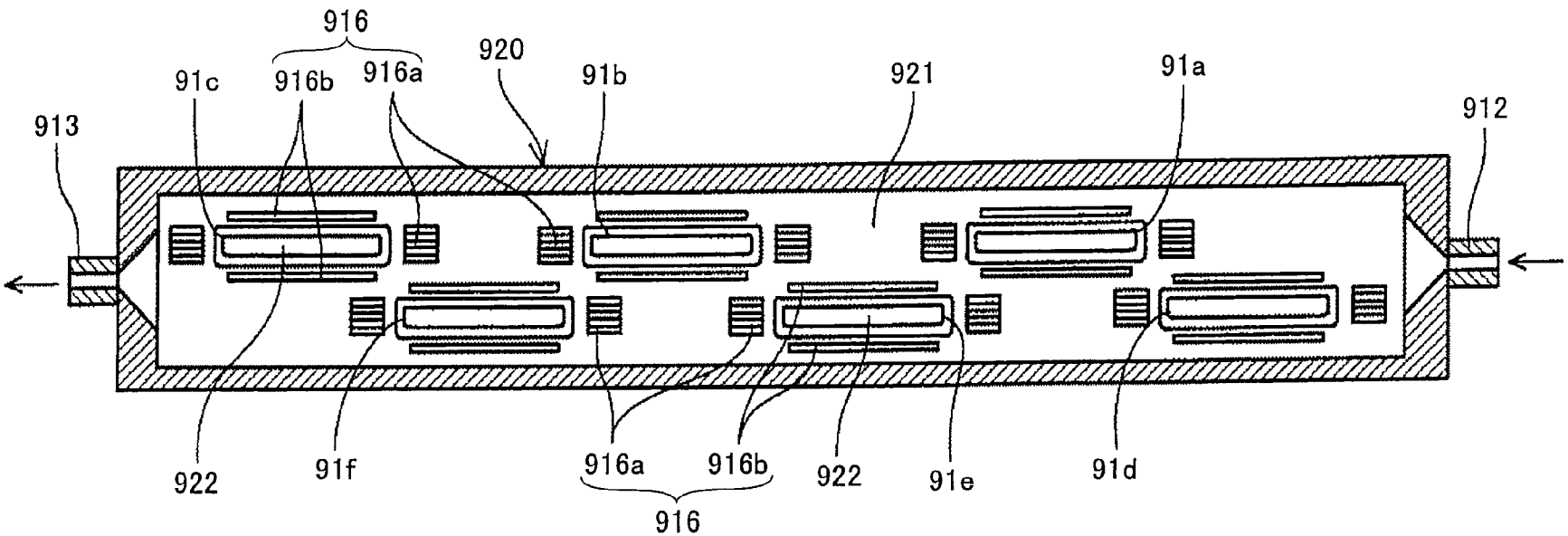
FIG. 56 is a cross-sectional view taken along line F-F of FIG. 57.
Figure 57:
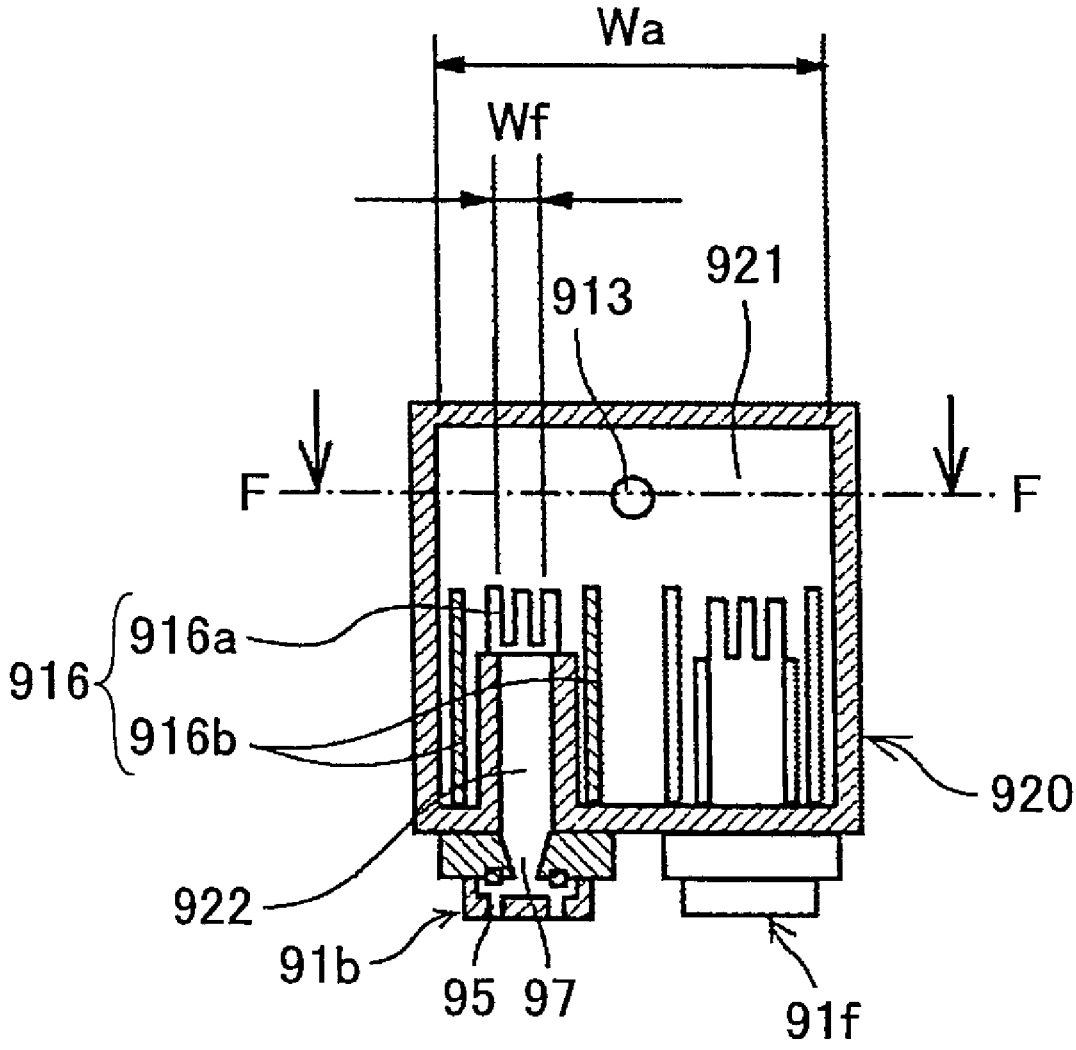
FIG. 57 is an enlarged cross-sectional view of the head unit taken along line E-E of FIG. 55.

A twentieth embodiment of the present invention is described below with reference to FIGS. 55 through 57. FIG. 55 is a longitudinal cut-away view showing a head unit according to this embodiment. FIG. 56 is a cross-sectional view taken along line D-D of FIG. 57. FIG. 57 is a cross-sectional view of the head unit taken along line C-C of FIG. 55.

The liquid feeding member 920 of this embodiment includes one main passage 921 that communicates with all of six liquid ejection heads 91. This configuration increases the internal space of the main passage 921, so that components can easily be formed therein according to need.

Taking advantage of this configuration, narrow communication passages 922 allowing communication between the main passage 921 and liquid ejection heads 91 are formed to project inside the main passage 921. This configuration allows a reduction of the size of the liquid feeding member 920. Further, the narrow communication passages 922 can reduce the adverse effect of the circulating current on meniscuses in nozzles 95 of the liquid ejection heads 91.

In this embodiment, because the openings of the narrow communication passages 922 are located at the center of the main passage 921 where the flow rate of the circulating current is high, ribs 916 having greater heights than the narrow communication passages 922 are provided. Each rib 916 includes ribs 916*a*, 916*a* which are disposed upstream and downstream with respect to the opening of the corresponding narrow communication passage 922. Each rib 916 includes further includes ribs 916*b*, 916*b* which are disposed at the side of the opening of the narrow communication passage 922 and are parallel to the direction of the liquid flow. The ribs 916 slow down the flow of the circulating current at the communication openings to the common liquid chambers 97, thereby further effectively reducing the adverse effects on the liquid ejection heads 91.

Figure 58:
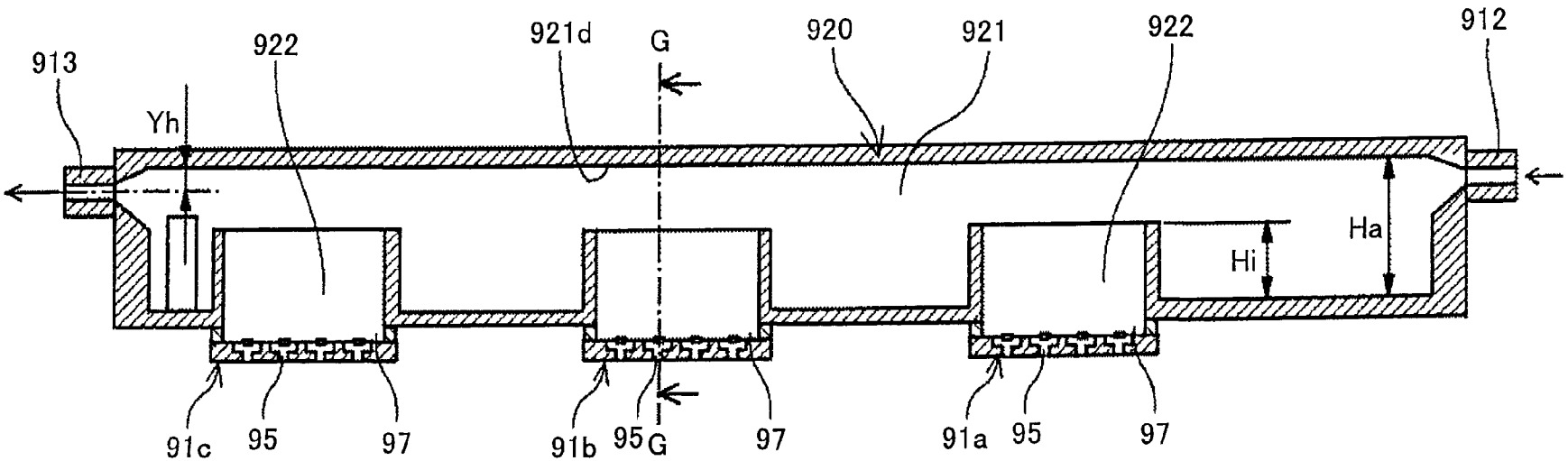
FIG. 58 is a longitudinal cut-away view schematically showing a head unit of a comparative example 7.
Figure 59:
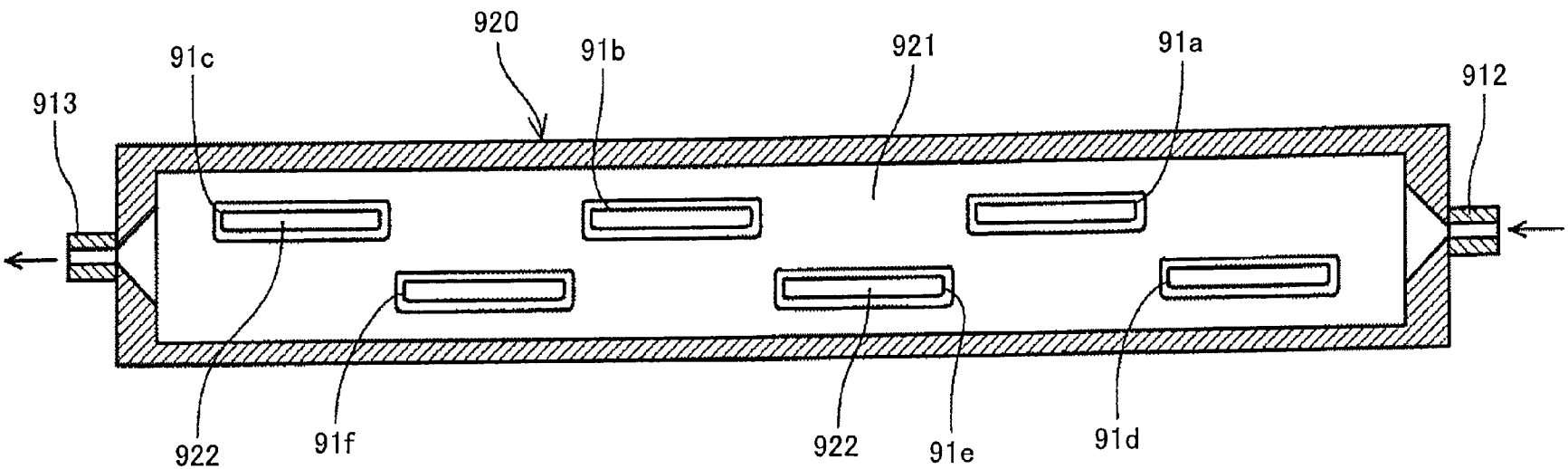
FIG. 59 is a cross-sectional view schematically showing the head unit taken along line H-H of FIG. 60.
Figure 60:
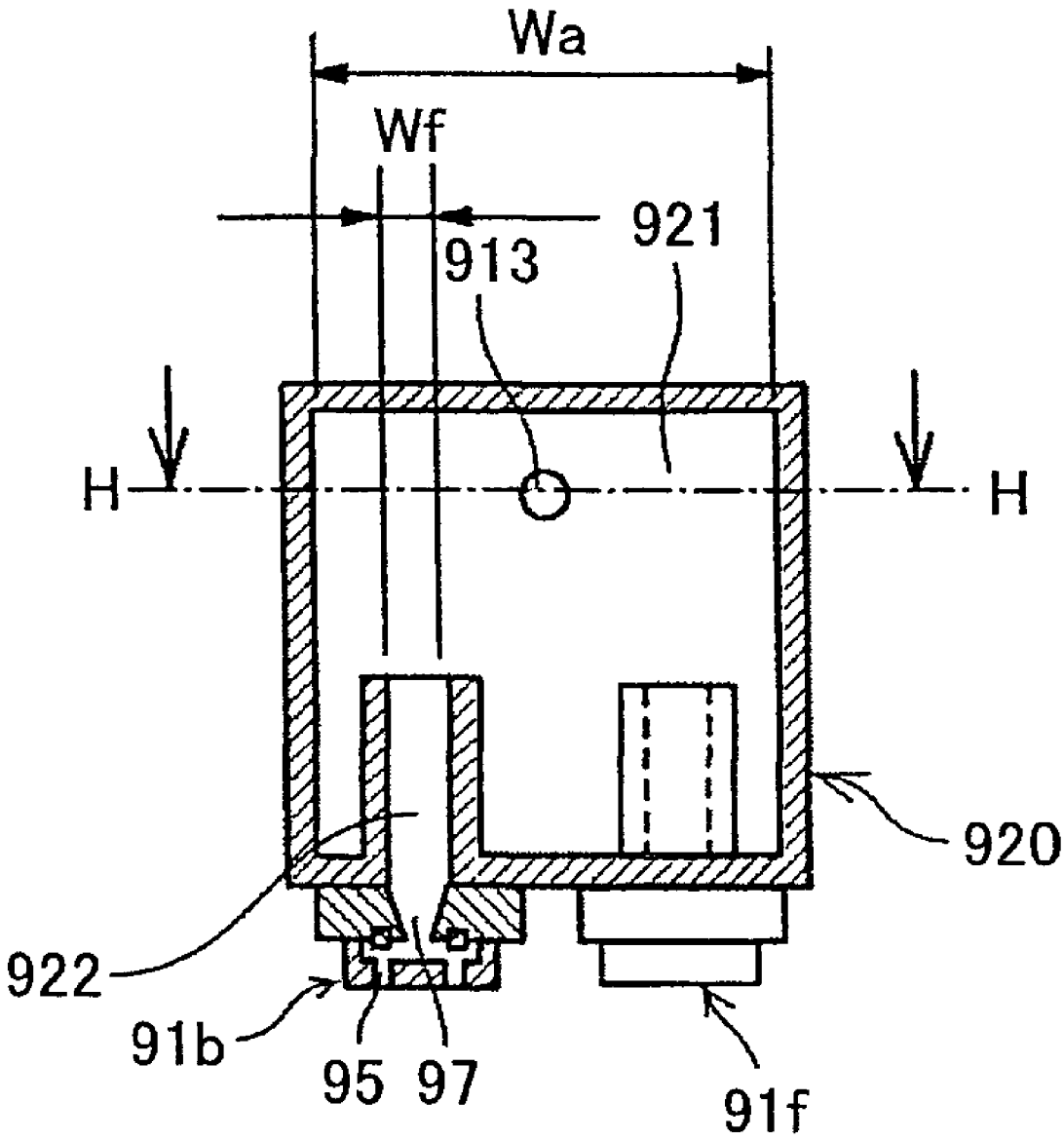
FIG. 60 is a cross-sectional view of the head unit taken along line G-G of FIG. 58.

In the case of the configuration of a comparative example 7 shown in FIGS. 58 through 60 that does not have ribs 916, because the openings of the narrow communication passages 922 are located at the center of the main passage 921 where the flow rate of the circulating current is high, the flow in the main passage 921 adversely affects the common liquid chambers 97 through the narrow communication passages 922 to break meniscuses, which might result in liquid leakage from the nozzles 95. The provision of the ribs 916 reduces the flow speed of the liquid in the vicinities of the openings and prevents such failures.

In this embodiment, there is a gap between each rib 916 and the narrow communication passage 922. In an alternative embodiment, the rib 916 may be integrally formed with a portion defining the opening.

As described above, the liquid feeding member 920 includes the liquid passage 921 through which the liquid passes in a direction parallel to the direction in which the nozzles 95 of the liquid ejection head 91 are aligned. The feed port 912 through which the liquid is supplied to the liquid passage 921 and a discharge port 913 through which the liquid is discharged from the liquid passage 921 are disposed at the opposing longitudinal ends of the liquid passage 921. In the liquid passage 921, the rib 916 is formed around each communication opening 917 connected to the corresponding common liquid chamber 97. With this configuration, it is possible to discharge, by the circulating current, the bubbles generated in the liquid ejection heads 91 or introduced into the liquid ejection heads 91 from upstream of the liquid feed path while preventing the meniscuses in the liquid ejection heads 91 from being broken.

Figure 61:
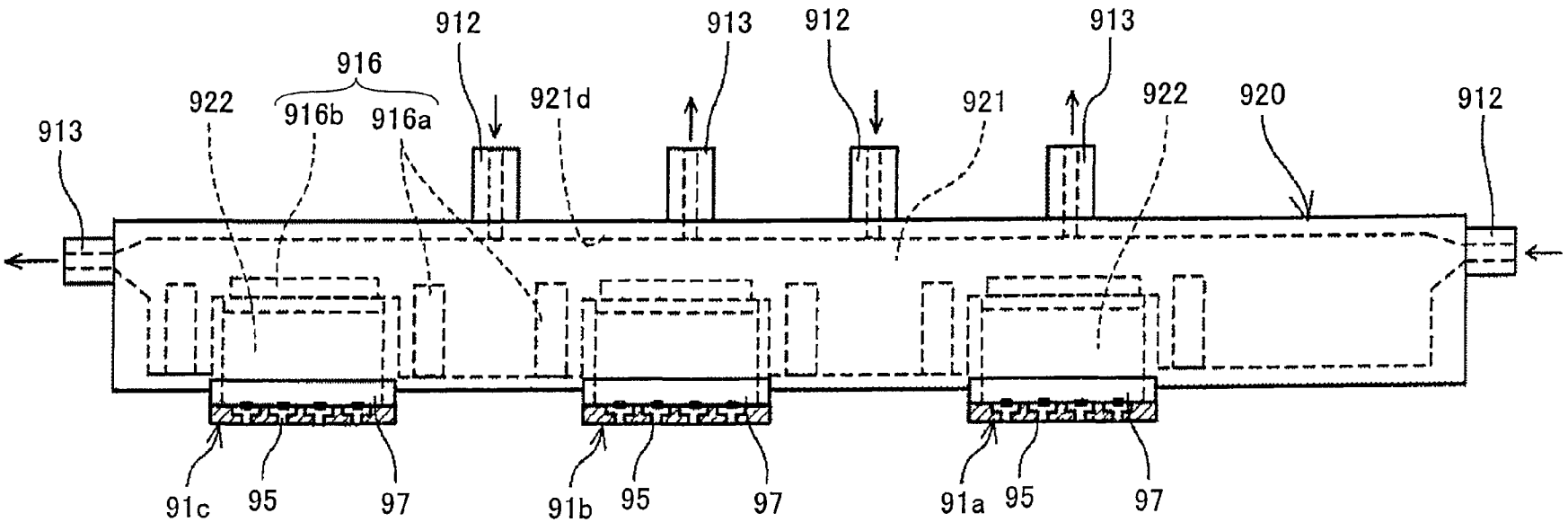
FIG. 61 is a longitudinal schematic diagram showing a head unit of a twenty-first embodiment of the present invention.
Figure 62:
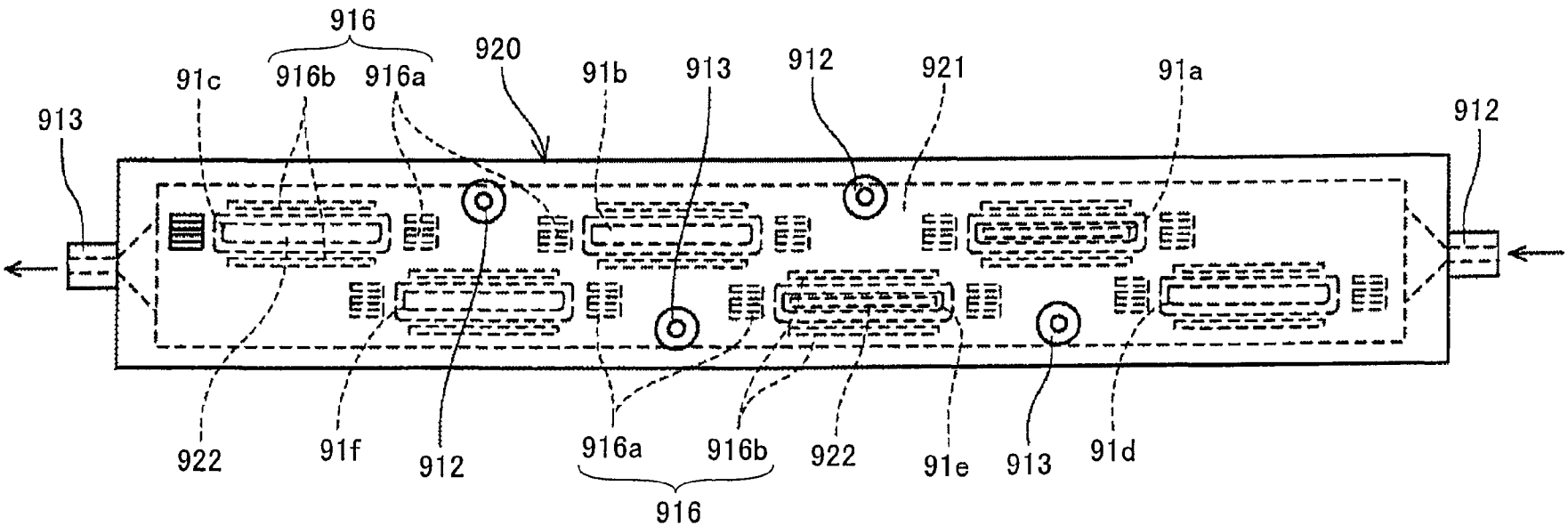
FIG. 62 is a plan view schematically showing the head unit.

A twenty-first embodiment of the present invention is described below with reference to FIGS. 61 and 62. FIG. 61 is a longitudinal schematic diagram showing a head unit according to this embodiment. FIG. 62 is a plan view of the head unit.

In a liquid feeding member 920 of this embodiment, in addition to a feed port 912 and discharge port 913 at the longitudinal ends, two feed ports 912 and two discharge ports 913 are disposed halfway through a main passage 921 in positions not facing liquid ejection heads 91. All the feed ports 912 and the discharge ports 913 may be used at the same time, or a desired combination of the plural ports may be selectively used. The provision of plural ports enables efficient discharge of bubbles from a wide passage in various modes.

In this embodiment, the feed ports 912 for introducing the liquid and the discharge ports for discharging the liquid are disposed in positions not facing the liquid ejection heads 91. Further, around the narrow communication passages 922 communicating with liquid ejection heads 91 are disposed ribs 916 that have greater heights than narrow communication passages 922. Therefore, it is possible to prevent circulating currents, which are formed according to the various bubble discharge modes, from adversely affecting meniscuses of nozzles 95 of the liquid ejection heads 91. Accordingly, it is possible to discharge bubbles while ejecting liquid droplets from the liquid ejecting heads 91.

As described above, the liquid feeding member 920 includes the liquid passage 921 through which the liquid passes in a direction parallel to the direction in which the nozzles 95 of the liquid ejection head 91 are aligned. The liquid passage 921 is provided with the feed port 912 through which the liquid is supplied to the liquid passage 921 and the discharge port 913 through which the liquid is discharged from the liquid passage 921. Either one of the feed port 912 and the discharge port 913 is disposed in a position not facing the common liquid chambers 97. In the liquid passage 921, a rib 916 is disposed around each of communication openings connected to the common liquid chambers 97. With this configuration, it is possible to discharge, by the circulating current, the bubbles introduced into the liquid ejection heads 91 from upstream of the liquid feed path while preventing the meniscuses in the liquid ejection heads 91 from being broken. Further, while preventing adverse effects on the meniscuses of nozzles 95 of the liquid ejection heads 91, it is possible to enhance the efficiency of discharging bubbles due to the reduced substantial length of the liquid feeding member 920.

In this embodiment, if either one of the feed port 912 and the discharge port 913 is located in a position facing the common liquid chamber 97, a flow guide member 918 may be provided as in the eighteenth embodiment. With this configuration, it is possible to reduce the substantial length of the liquid feeding member 920 to enhance the efficiency of discharging bubbles, while preventing adverse effects on meniscuses in the liquid ejection heads 91.

The following describes an image forming apparatus including a liquid ejection device of an embodiment of the present invention. In the following example, a liquid ejection device of an embodiment of the present invention is applied to an inkjet printer, which inkjet printer ejects ink as liquid and is applicable to facsimile machines, copiers, and multifunction machines with facsimile and copier functions. However, the liquid ejection device can be applied to a liquid ejection head or a liquid ejection device that ejects liquid which is not ink but is, e.g., DNA samples, resist, pattern materials, or to an image forming apparatus including such a liquid ejection head or a liquid ejection device.

Figure 63:
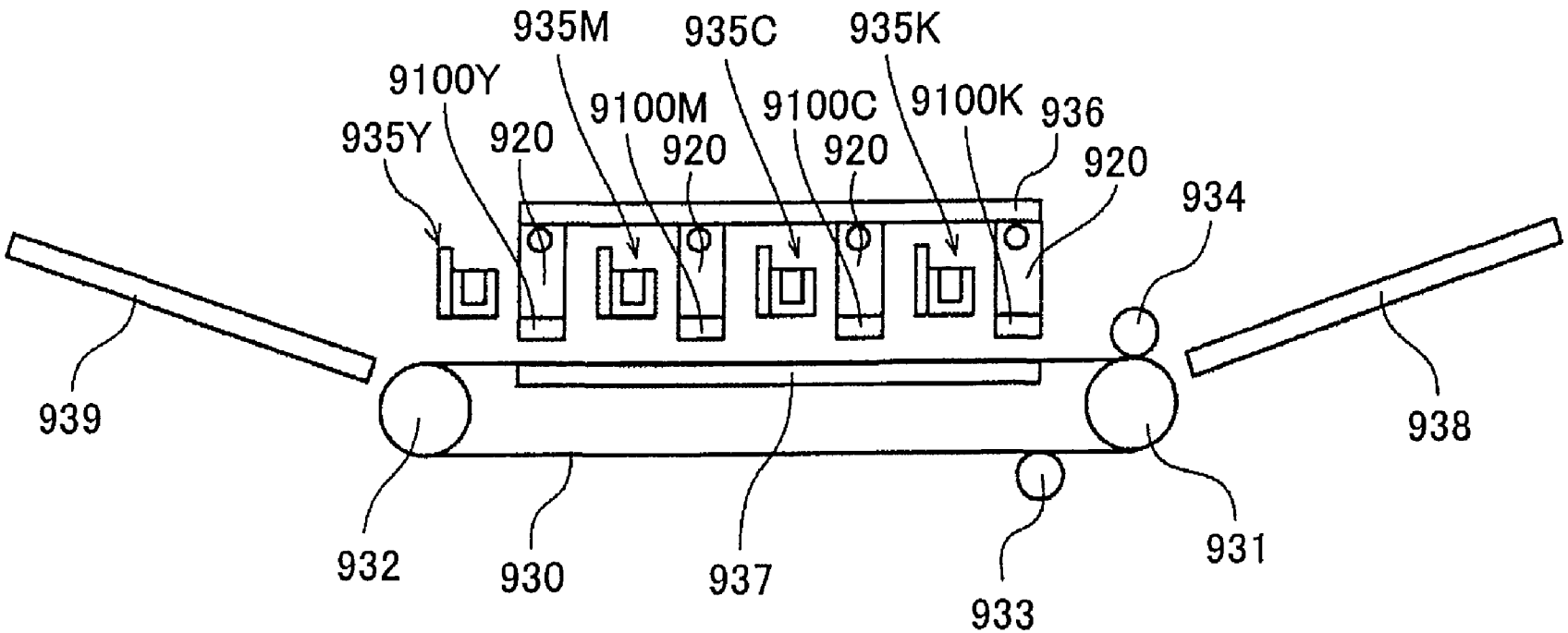
FIG. 63 is a schematic configuration diagram for illustrating an image forming apparatus of a twenty-second embodiment of the present invention.
Figure 64:
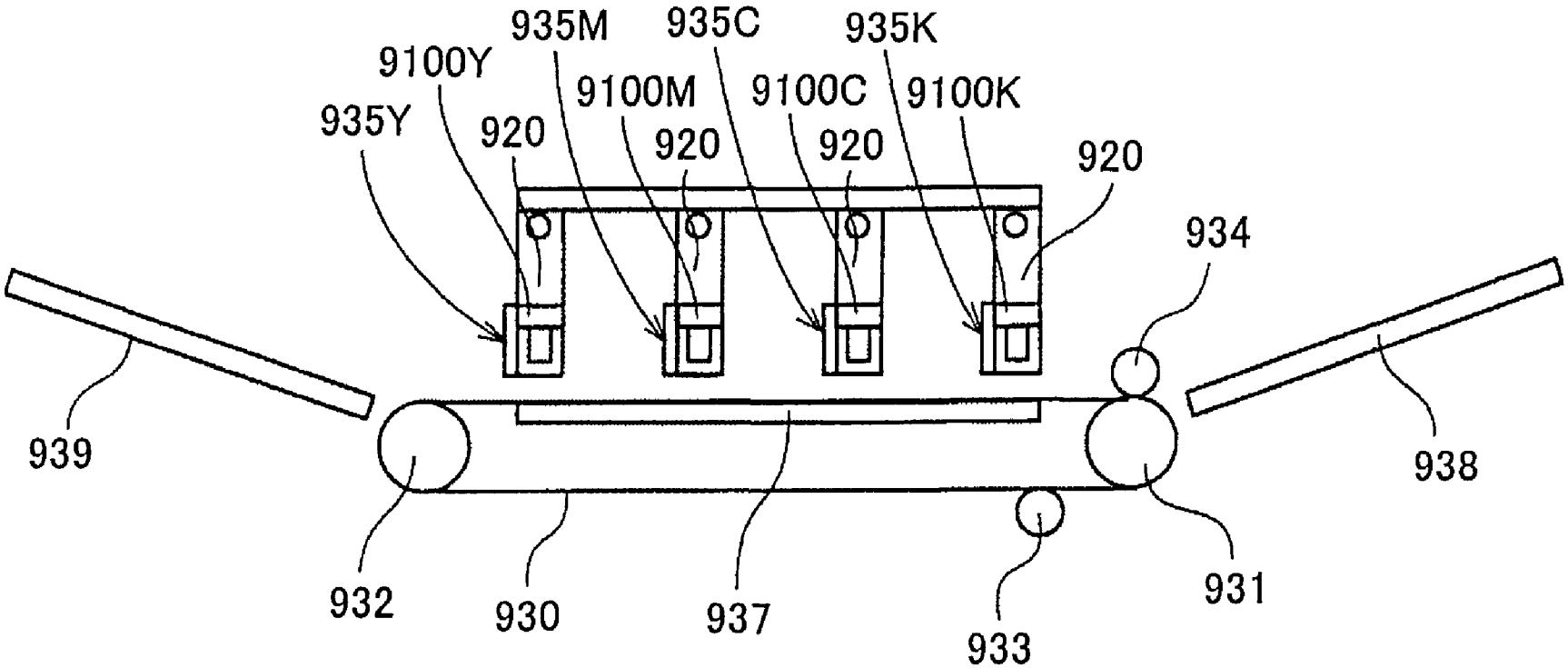
FIG. 64 is a is a diagram for illustrating a maintenance/recovery operation of the image forming apparatus.
Figure 65:
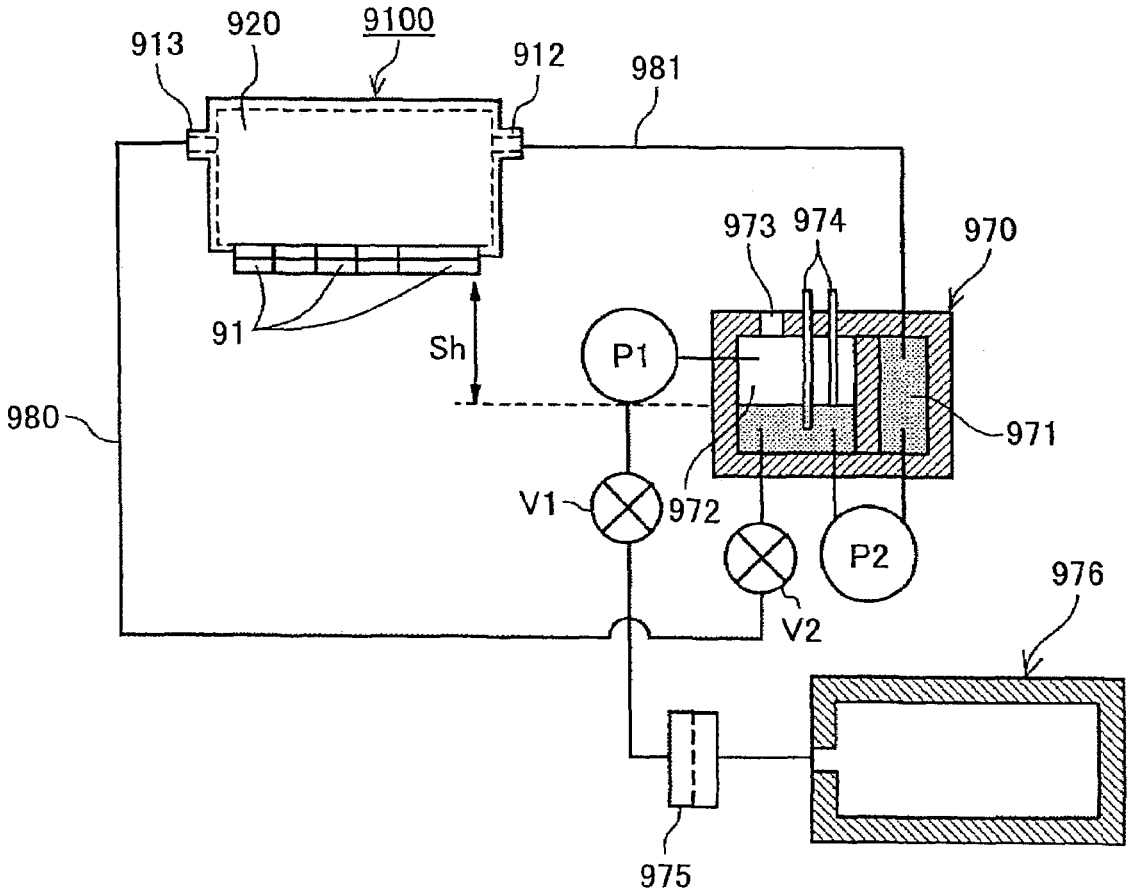
FIG. 65 is a schematic diagram for illustrating a liquid feed path of the image forming apparatus.

An image forming apparatus of a twenty-second embodiment of the present invention is described below with reference to FIGS. 63 through 65. FIG. 63 is a schematic configuration diagram of the image forming apparatus. FIG. 64 is a diagram for illustrating a maintenance/recovery operation of the image forming apparatus. FIG. 65 is a schematic diagram for illustrating a liquid feed path.

The image forming apparatus is a line printer that includes four recording heads (9100K, 9100C, 9100M, 9100Y), i.e., head units 9100, for inks of four different colors (black, cyan, magenta, and yellow). Each of the recording heads 9100 has a length corresponding to the width of the maximum size recording sheet. The four recording heads 9100 are fixed to a head frame 936 so as to be moved up and down together by a head lifting mechanism (not shown).

The recording sheet is transported directly under the recording heads 9100K, 9100C, 9100M and 9100Y so that images are recorded on the recording sheet. Recording sheets are stacked in a feed tray 938, are fed one by one by a sheet separating/feeding mechanism (not shown), are transported by a sheet transport belt 930, and, after completion of recording, are discharged into a catch tray 939.

The sheet transport belt 930 extends between a belt transport roller 931 and a tension roller 932. The sheet transport belt 930 has a double layer structure including a high-resistance layer made of a resin material as a front layer and an intermediate-resistance layer made of a resin material with carbon for resistance control as a back layer. The sheet transport belt 930 is in contact with a charger roller 933. The charger roller includes a metal roller, an intermediate-resistance layer as the outer layer of the metal roller, and a thin high-resistance layer as the outermost layer.

When a high voltage is applied to the charger roller 933, electricity is discharged in an air gap near the nip between the sheet transport belt 930 and the charger roller 933, so that electric charges are attached to the sheet transport belt 930. If an alternating current is applied to the charger roller 933, the sheet transport belt 930 is alternately positively and negatively charged. When the recording sheet is on the charged sheet transport belt 930, the recording sheet is attached to the sheet transport belt 930 due to the electrostatic effect. Thus the recording sheet is firmly attached to the sheet transport belt 930 while printing is performed. Therefore, even in the case where printing is performed while transporting the sheet at high speed, it is possible to achieve consistent high quality printing.

Each of the head units 9100 (the recording heads 9100K, 9100C, 9100M and 9100Y) includes plural liquid ejection heads 91. Each liquid ejection head 91 is a thermal type such as one described in the second embodiment, which produces ejection pressure through ink film boiling using the heating element 94 as illustrated in the sixteenth embodiment. The liquid ejection head 91 has a side shooter structure in which the direction of the ink flowing toward an ejection energy application portion (heating element portion) in each individual liquid chamber 96 is at a right angle to the center axis of the opening of the corresponding nozzle 95.

This configuration is advantageous not only in efficiently converting the energy generated by the heating element 94 into energy for forming ink droplets and propelling the ink droplets, but also in quickly restoring a meniscus by feeding ink. Further, the side shooter structure prevents a so-called cavitation phenomenon, which occurs in edge shooter structures and gradually damages the heating element 94 due to the impact of collapsing bubbles. This is because, in the side shooter structure, bubbles grow and reach the nozzle 95 to communicate with the atmosphere, which prevents contraction of the bubbles due to temperature decrease. Therefore, the recording head 91 of the side shooter structure has a longer service life.

The liquid ejection head 91 can be manufactured using the processing steps used for manufacturing the recording head 1 in the thirteenth embodiment of the present invention, for example.

With the steps described above, a short liquid ejection head 91 can be manufactured that has a 600 dpi/array, 1200 CH/array (indicating 1200 nozzles 95 in one array), and a nozzle array interval of 240 μm.

A liquid feeding member 920 used herein is the liquid feeding member 920 of the head unit of the sixteenth embodiment. A component with a path (main passages 921 and narrow communication passages 922) having a cross-sectional shape shown in FIGS. 45 through 47 is formed by cutting and pasting transparent polycarbonate resin. As shown in FIG. 44, six liquid ejection heads 91 are attached to the liquid feeding member 920 to form a head unit 9100, which can cover a printing area six times wider than an area that can be covered by a head unit having only one liquid ejection head 91.

The liquid feeding member 920 has a feed port 912 and a discharge port 913 at the opposing ends and, as shown in FIG. 46, and includes two passages 921, 921. Each of the passage 921, 921 includes a main passage 921 and a narrow communication passage 922 communicating with the liquid ejection head 91. The narrow communication passages 922 define the openings to common liquid chambers 97 of liquid ejection heads 91 and have smaller widths than the main passage 921.

Each main passage 921 has a greater width and a greater depth at regions 921*a* facing the narrow communication passages 922 than at regions 921*b* not facing the narrow communication passages 922. With reference to FIGS. 45 through 47, the specific sizes are Wg: 5 mm, Wf: 2.4 mm, Wh: 3 mm, Hg: 6 mm, Hf: 4 mm, Hh: 4 mm, and Yh: 2 mm.

This liquid feeding member 920 is connected to an ink feed system in a liquid feed path as shown in FIG. 65. In this liquid feed path (liquid feed system), a head tank 970 is disposed that has a function of feeding ink to the head unit 9100 and receiving bubbles to discharge them to the outside. The head tank 970 includes a first ink chamber 971 and a second ink chamber 972 with an atmosphere opening 973 at the top. A pump P2 can send ink from the second ink chamber 972 to the first ink chamber 971. An ink cartridge 976 is connected to the second ink chamber 972 such that ink that has been filtered by a filter 975 can be supplied to the second ink chamber 972 of the head tank 970 by a pump P1.

At the bottom of the second ink chamber 972 of the head tank 970 is an ink port, which is connected to the discharge ports 913 of the liquid feeding member 920 of the head unit 9100 through a normally-opened valve V2. The volume of the ink in the second ink chamber 972 is managed by a liquid level sensor 974 such that a height difference Sh between the ink level and the heads 91 is maintained at a constant value (10-150 mm).

During a usual image forming operation, the pumps P1 and P2 are stopped and only the valve V2 is opened. The ink is supplied to the head unit 9100 from the second ink chamber 972 through the discharge ports 913. The ink level in the second ink chamber 972 drops below the predetermined position due to use of the ink, which drop is detected by the liquid level sensor 974. In response, the valve V1 is opened and the pump P1 is activated to supply ink from the ink cartridge 976 to the second ink chamber 972. The supply is stopped according to a detection signal of the liquid level sensor 974.

Figure 66:
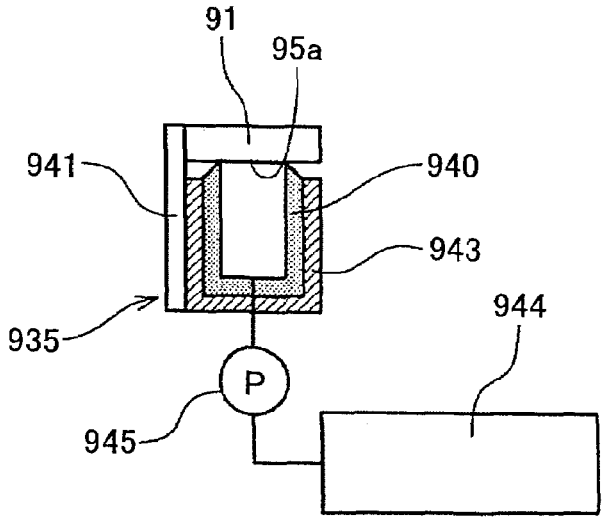
FIG. 66 is a diagram for illustrating a maintenance/recovery operation of the image forming apparatus.

In the case where the liquid ejection head 91 of the head unit 9100 is clogged, a recovery operation for the liquid ejection head 91 is performed. The head unit 9100 is moved up from the position shown in FIG. 63, and a maintenance unit 935 is horizontally moved (from the position shown in FIG. 63 to the right side in FIG. 63) to be located directly under the liquid ejection head 91. Then the liquid ejection head 91 is slightly moved down such that, as shown in FIG. 66, a nozzle face 95*a* with the nozzles 95 of the liquid ejection head 91 comes into tight contact with a cap 940 held by a holder 943 of the maintenance unit 935. Then, the valves V1 and V2 (FIG. 65) are closed, and only the pump P2 is activated for a predetermined time period.

Figure 67:
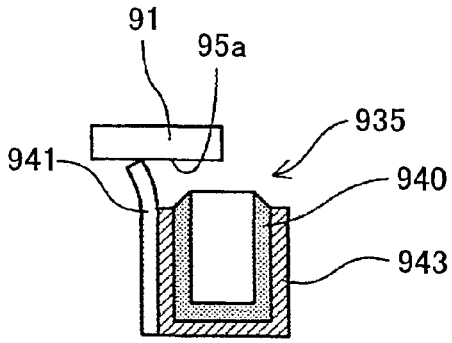
FIG. 67 is a diagram for illustrating a maintenance/recovery operation of the image forming apparatus.

Thus the ink in the first ink chamber 971 is pressurized to flow into the head unit 9100. Since the valve V2 is closed, the ink is discharged from the nozzles 95 of the liquid ejection head 91. Together with the ink, bubbles and extraneous matter clogging the liquid ejection head 91 are removed. After stopping the pump P2, the head unit 9100 is moved up to be out of contact with the cap 940. Then the maintenance unit 935 is horizontally moved (from the position shown in FIG. 66 to the right side in FIG. 66) to wipe the nozzle face 95*a* of the liquid ejection head 91 using a wiper blade 941 as shown in FIG. 67. After meniscuses are formed in the nozzles 95 due to wiping, the valve V2 is opened so that each liquid ejection head 91 is maintained at a negative pressure to have the height difference Sh.

The ink discharged from the liquid ejection head 91 is collected in the cap 940 and suctioned by a pump 945 to be discharged into a waste tank 944. In an alternative embodiment, the ink in the cap 940 may be filtered using a filer and transported not to the waste tank 944 but back to the second ink chamber 972 of the head tank 970 so as to be reused.

After that, the head unit 9100 and the maintenance unit 935 are moved vertically and horizontally, respectively, back to the positions shown in FIG. 63 to perform a recording operation. Alternatively, the head unit 9100 and the maintenance unit 935 may stay in the positions shown in FIG. 64 to wait for a recording instruction. This recovery operation removes clogging to maintain the liquid ejection heads 91 of the head unit 9100 in good condition.

In the liquid feed system shown in FIG. 65, flow passages 980 and 981 connecting the head tank 970 and the liquid feeding member 920 are usually resin tubes, and bubbles enter inside over time due to the air permeability of the tube material. If a large number of bubbles are accumulated inside the liquid feeding member 920, the bubbles are carried by the flow of ink into the liquid ejection head 91 during a recording operation, resulting in a failure of ink droplet ejection. Referring to FIG. 65, in order to remove the bubbles from the liquid feeding member 920, the valve V2 is opened and only the pump P2 is activated to feed the ink from the second ink chamber 972 to the first ink chamber 971. Then the ink flows from the first ink chamber 971 into the feed port 912 of the liquid feeding member 920, is discharged from the discharge ports 913 together with the bubbles, and flows back to the second ink chamber 972. In the second ink chamber 972, the bubbles in the ink move up to be discharged from the atmosphere opening 973.

To evaluate the performance of discharging bubbles of the liquid feeding member 920 of this image forming apparatus, bubbles were introduced into the tube through a three-way valve upstream of the liquid feeding member 920, and then introduced into the liquid feeding member 920 by the pump P2 while observing the inside of the liquid feeding member 920. The pump V2 was stopped to wait for the flow inside the liquid feeding member 920 to stop. Then, the pump V2 was restarted to circulate the ink at a flow rate of 60 ml/min. As a result, although there were small bubbles remaining at the upper corners of the liquid feeding member 920, most bubbles could be discharged. Further, no failure such as leakage of ink from the nozzles 95 was observed at the nozzle face of each liquid ejection head 91 of the head unit 9100, and image formation could be performed properly without ejection failures.

As a comparative example, a liquid feeding member was prepared that includes main passages 921 each having a uniform cross-sectional area and sizes of Wg: 5 mm, Wf: 2.4 mm, Wh: 5 mm, Hg: 6 mm, Hf: 4 mm, Hh: 6 mm, and Yh: 2 mm. Then, a head unit including this liquid feeding member was prepared in the same manner as described above and the bubble discharge performance was evaluated. As a result, although bubbles could be discharged, it took more time to discharge the bubbles compared with the above described liquid feeding member 920 having the main passages 921 each of which has a greater width and a greater depth at the regions 921*a* facing the narrow communication passages 922 than at the regions 921*b* not facing the narrow communication passages 922.

Next, a liquid feeding member 920 was prepared for this image forming apparatus, in which, as in the comparative example 6 (FIG. 50), a feed port 912 is disposed over a liquid ejection head 91, and discharge ports 913, 913 are disposed at the opposing longitudinal ends. Then the bubble discharge performance was evaluated. As a result, the time required to discharge bubbles was reduced and the efficiency of discharging bubbles was enhanced. However, the liquid level in the head tank 970 connected to the liquid feeding member 920 was high, so that ink came out of the meniscus when the height difference Sh between the nozzle faces 95*a* of the head unit 9100 and the liquid level was small.

Then, a liquid feeding member 920 as illustrated in the seventeenth embodiment (FIG. 49) was prepared in which a flow guide member 918 is disposed in a position facing a feed port 912 in each main passage 921. The flow guide member 918 has a curved upper surface to smoothly divide the flow of supplied ink into two flows toward the two discharge ports 913, 913 in the different directions, and has a sloped lower (bottom) surface 919 to prevent bubbles that have moved up from the liquid ejection head 91 from remaining thereon. The bubble discharge performance using this liquid feeding member 920 was evaluated in the same manner as described above. As a result, unlike the above-described experiment, it was possible to discharge bubbles in less time without ink coming out of meniscuses.

Next, a feeding member 920 as illustrated in the comparative liquid feeding member 920 was prepared for this image forming apparatus, in which, as in the comparative example 6 (FIG. 50), a feed port 912 is disposed over a liquid ejection head 91, and discharge ports 913, 913 are disposed at the longitudinal ends. Then the bubble discharge performance was evaluated. The liquid feeding member 920 has a configuration suitable for high speed printing, in which narrow communication passages 922 in communication with liquid ejection heads 91 are formed to project toward main passage 921 and thus the main passage 921 has a high ratio of open space relative to the outer dimensions of the liquid feeding member 920. With reference to FIGS. 58 through 60, the specific sizes are Wa: 8 mm, Wf: 1.6 mm, Ha: 6 mm, Hi: 2 mm, and Yh: 1.5 mm.

The liquid feeding member 920 of the comparative example 7 was connected to the ink feed system shown in FIG. 65 and the bubble discharge performance was evaluated. As a result it was found that, to properly discharge bubbles from the liquid feeding member 920, ink needs to be circulated at a flow rate of 200 ml/min or higher. However, when the ink was circulated under such conditions, ejection failures occurred in a subsequent ink ejection operation.

Then, a head unit 9100 was prepared that includes a liquid feeding member 920 as illustrated in the twentieth embodiment (FIGS. 55 through 57) in which ribs 916 (916*a*, 916*b*) having greater heights than narrow communication passages 922 are disposed around the openings of the narrow communication passages 922. As the rib 916, three ribs 916*a* each of thicknesses 0.4 mm are disposed at 0.9 mm pitch at each longitudinal end of each narrow communication passage 922, and one rib 916*b* of a thickness 0.6 mm is disposed at each lateral side of the narrow communication passage 922. The ribs 916*a* and 16*b* are higher than the openings of the narrow communication passages 922 by 2 mm (Hr: 4 mm). The bubble discharge performance of the head unit 9100 including this liquid feeding member 920 was evaluated in the same manner as described above. As a result, even when circulating the ink at a flow rate of 200 ml/min or greater, it was possible to properly discharge bubbles without ink ejection failures.

Next, in order to achieve a bubble discharge efficiency higher than that achieved by the twentieth embodiment, a head unit 9100 was prepared that includes a liquid feeding member 920 as in the twenty-first embodiment (FIGS. 61 and 62) which has four additional ports, namely, two additional feed ports 912 and two additional discharge ports 913, at a ceiling 921*d* of the liquid feeding member 920. The feed ports 912 and discharge ports 913 that are disposed at the ceiling 921*d* are located in the positions not over communication openings (narrow communication passages 922) to liquid ejection heads 91. The feed ports 912 and discharge ports 913 are alternately disposed.

Because the distance between the adjacent ports is reduced by the provision of the plural ports, it was possible to discharge bubbles in less time than in the case where the liquid feeding member 920 of the twentieth embodiment was used. Moreover, the provision of the plural ports enabled circulation of the liquid in a certain region. When printing images on a small size sheet, not all of the short liquid ejecting heads 91 (91*a*-91*f*) of the long head unit 9100 are driven. For example, only three heads (91*a*, 91*d*, and 91*e*) at the right side in FIGS. 55 and 56 are driven to print images. In this case, the heads (1*b*, 1*c*, and 1*f*) not in use do not require a bubble discharge operation. That is, it is possible to discharge bubbles by circulating ink using only the ports near the heads (1*a*, 1*d*, and 1*e*) in use.

As the provision of the plural ports enabled ink circulation in a certain region, it was possible to efficiently discharge bubbles without wasting electricity. That is, the provision of the plural ports enables ink circulation using a desired one of various combinations of the ports according to the situation, thereby improving the stability of the long head unit 9100 including this liquid feeding member 920 and the stability of the image recording apparatus.

Figure 68:
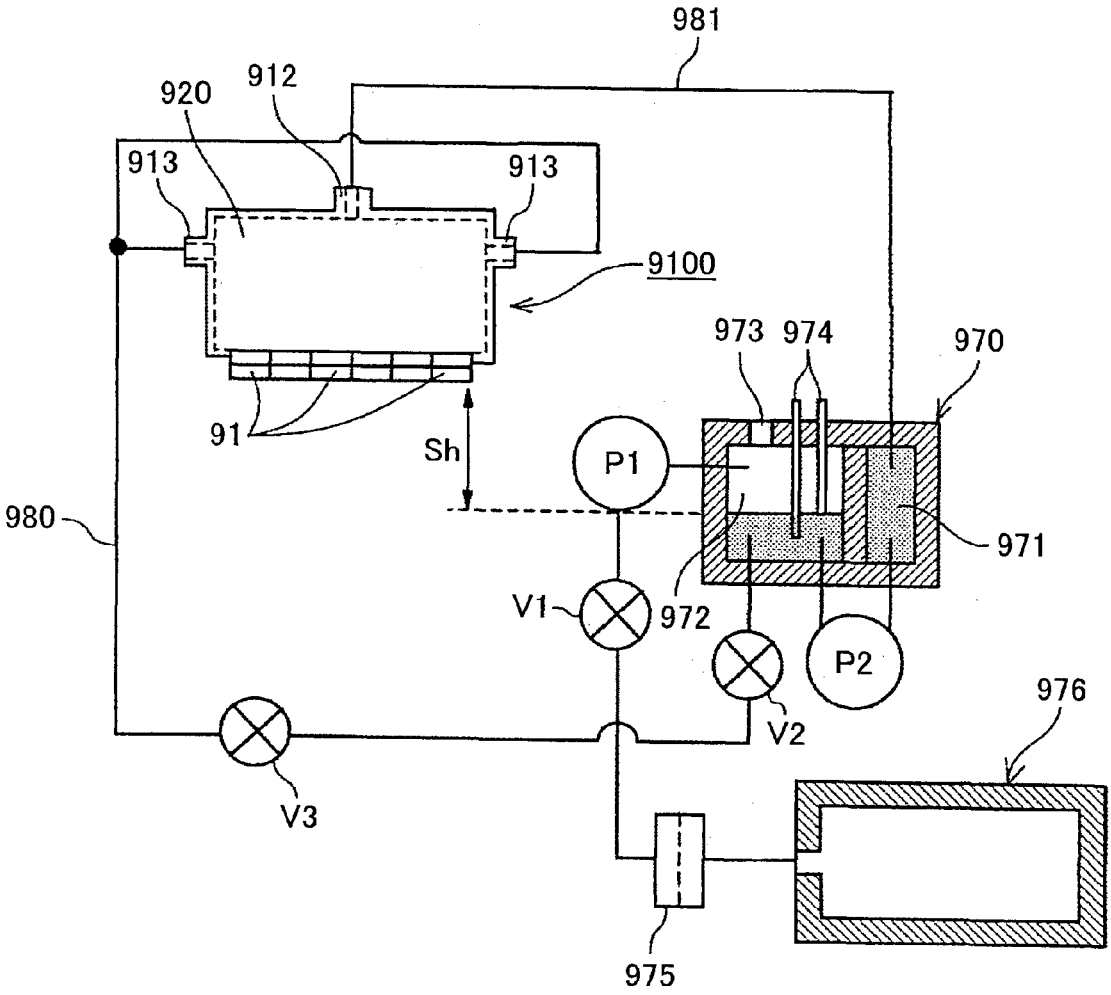
FIG. 68 is a schematic diagram for illustrating a liquid feed path of an image forming apparatus of a twenty-third embodiment of the present invention.

Next, an image forming apparatus of a twenty-third embodiment of the present invention is described below with reference also to FIG. 68.

A liquid feed path (an ink feed system) of this image forming apparatus is different from the ink feed system of FIG. 65 in that a flow regulating valve V3 is disposed downstream of discharge ports 913, 913 of the liquid feeding member 920. In this embodiment, a feed port 912 is disposed at a portion not at the longitudinal end, and the discharge ports 913, 913 are disposed at the opposing longitudinal ends.

The provision of the flow regulator V3 downstream of the discharge port 913 allows adjustment of the flow rate (Qc) of the ink discharged from the discharge port 913. The ink can be forced into the head 91 from the main passage 921 by reducing the flow rate Qc. Thus, it is possible to discharge bubbles from the main passage 921 and discharge bubbles from the liquid ejection heads 91 at the same time.

As described above, in the embodiments of the present invention, the circulating current does not adversely affect meniscuses of the nozzles. Therefore, it is possible to have a circulating current during a recording operation. Since a recording operation can be performed while circulating ink, it is possible to prevent accumulation of bubbles. That is, there is no need to suspend recording to perform a bubble discharge operation, which results in increasing recording throughput.

Although the present invention is applicable to various types of liquid ejection heads, the present invention is especially useful for thermal heads as described in the foregoing embodiments because the temperature of thermal heads together with the temperature of the ink are easily increased. Among the thermal heads, the present invention is especially useful for side shooter heads as described above because bubbles are likely to be generated in the heads and the generated bubbles are likely to move into common liquid chambers.

The present application is based on Japanese Priority Application No. 2007-033986 filed on Feb. 14, 2007, and Japanese Priority Application No. 2007-034252 filed on Feb. 15, 2007 with the Japanese Patent Office, the entire contents of which are hereby incorporated by reference.

The invention claimed is:

1. A liquid ejection device that ejects liquid droplets from a liquid ejection head, the liquid ejection device comprising:

a liquid feeding member that feeds liquid to the liquid ejection head, the liquid feeding member being connected to a liquid ejection head to feed liquid to a common liquid chamber of the liquid ejection head, which liquid ejection head includes the common liquid chamber that supplies the liquid to plural individual liquid chambers communicating with plural nozzles that eject liquid droplets, the liquid feeding member comprising:

a liquid circulation path through which the liquid circulates in a direction parallel to a direction in which the nozzles of the liquid ejection head are aligned;

wherein a feed port through which the liquid is supplied to the liquid circulation path and a discharge port through which the liquid is discharged from the liquid circulation path are disposed at opposing longitudinal ends of the liquid circulation path;

a communication opening communicating with the common liquid chamber being disposed at the side of the common liquid chamber in the liquid circulation path; and the communication opening having a smaller width than a width of the liquid circulation path.

2. A liquid ejection device as claimed in claim 1, wherein the communication opening has a greater depth at least at the feed port side or at the discharge port side than at the remaining portion.

3. A liquid ejection device as claimed in claim 1, wherein the liquid circulation path has an upward convex shape at the top in a cross section orthogonal to the flow of the liquid from the feed port toward the discharge port.

4. A liquid ejection device as claimed in claim 1, wherein no component that blocks a flow of the liquid between an upper opening of the common liquid chamber and a top ceiling of the liquid circulation path is provided therebetween.

5. A liquid ejection device as claimed in claim 1, wherein a part defining a communication opening disposed at the side of the common liquid chamber in the liquid circulation path is made of a high thermal conductive material.

6. A liquid ejection device that ejects liquid droplets from a liquid ejection head, the liquid ejection device comprising:

a liquid feeding member that feeds liquid to the liquid ejection head, the liquid feeding member being connected to a liquid ejection head to feed liquid to a common liquid chamber of the liquid ejection head, which liquid ejection head includes the common liquid chamber that supplies the liquid to plural individual liquid chambers communicating with plural nozzles that eject liquid droplets, the liquid feeding member comprising:

a liquid circulation path through which the liquid circulates in a direction parallel to a direction in which the nozzles of the liquid ejection head are aligned;

wherein a feed port through which the liquid is supplied to the liquid circulation path and a discharge port through which the liquid is discharged from the liquid circulation path are disposed at opposing longitudinal ends of the liquid circulation path;

a communication opening communicating with the common liquid chamber being disposed at the side of the common liquid chamber in the liquid circulation path; and plural ribs are disposed around the communication opening.

7. A liquid ejection device as claimed in claim 6, wherein each of the ribs has a greater height at the feed port side and the discharge port side in the liquid circulation path than at the remaining portion.

8. A liquid ejection device as claimed in claim 6, wherein the ribs are made of a high thermal conductive material.

9. A liquid ejection device that ejects liquid droplets from plural liquid ejection heads, the liquid ejection device comprising:

the plural liquid ejection heads elongated in a longitudinal direction of a liquid ejection member and arranged longitudially offset from one another in a direction orthogonal to the longitudinal direction;

the liquid feeding member connected to the plural liquid ejection heads to feed liquid to common liquid chambers of the liquid ejection heads, each of which liquid ejection heads includes the common liquid chamber from which the liquid is supplied to plural individual liquid chambers communicating with plural nozzles that eject liquid droplets, the liquid feeding member comprising:

a liquid passage through which the liquid passes in a direction parallel to a direction in which the nozzles of each of the liquid ejection heads are aligned;

wherein a feed port through which the liquid is supplied to the liquid passage and a discharge port through which the liquid is discharged from the liquid passage are provided in the liquid passage; and the liquid passage having a greater cross-sectional area at portions connected to the liquid ejection heads than at portions between the adjacent common liquid chambers.

10. A liquid ejection device as claimed in claim 9, wherein the feed port and the discharge port are disposed at opposing longitudinal ends of the liquid passage.

11. A liquid ejection device as claimed in claim 9, wherein:

at least one of the feed port and the discharge port being disposed at a portion not at a longitudinal end of the liquid passage; and a flow guide member that guides the flow of the liquid is provided between the common liquid chamber and said one of the feed port and the discharge port at the portion not at the longitudinal end.

12. A liquid ejection device as claimed in claim 9, wherein: at least one of the feed port and the discharge port being disposed not at a longitudinal end of the liquid passage but in a position facing a portion between the adjacent common liquid chambers.

13. A liquid ejection device as claimed in claim 9, wherein:

a rib being disposed around each of communication openings connected to the common liquid chambers in the liquid passage.

14. A liquid ejection device as claimed in claim 13, wherein at least one of the feed port and the discharge port being disposed not at a longitudinal end of the liquid passage but in a position facing a portion between the adjacent common liquid chambers; and a rib being disposed around each of communication openings connected to the common liquid chambers in the liquid passage.

15. A liquid ejection device as claimed in claim 13, wherein at least one of the feed port and the discharge port is disposed at a portion not at a longitudinal end of the liquid passage; and a flow guide member that guides the flow of the liquid being provided between the common liquid chamber and said one of the feed port and the discharge port at the portion not at the longitudinal end.

16. An image forming apparatus that forms an image by ejecting liquid droplets from a liquid ejection head, the image forming apparatus comprising:

the liquid ejection device as claimed in any of claim 1, 6, and 9.

* * * * *